US010322044B2

(12) United States Patent
Upchurch et al.

(10) Patent No.: US 10,322,044 B2
(45) **Date of Patent: *Jun. 18, 2019**

(54) MEDICAL SUPPORT APPARATUS

(71) Applicant: Stryker Corporation, Kalamazoo, MI (US)

(72) Inventors: Joseph Adam Upchurch, Kalamazoo, MI (US); Christopher S. Hough, Kalamazoo, MI (US); Richard A. Derenne, Portage, MI (US); Cory Patrick Herbst, Sbelbyville, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/657,571

(22) Filed: Jul. 24, 2017

(65) Prior Publication Data

US 2018/0042799 A1 Feb. 15, 2018

Related U.S. Application Data

(63) Continuation of application No. 14/212,323, filed on Mar. 14, 2014, now Pat. No. 9,713,559.

(Continued)

(51) Int. Cl.

| | |
|---|---|
| ***A61G 5/14*** | (2006.01) |
| ***A61G 5/10*** | (2006.01) |
| ***A47C 1/024*** | (2006.01) |
| ***A47C 1/032*** | (2006.01) |
| ***A47C 1/00*** | (2006.01) |

(Continued)

(52) U.S. Cl.

CPC ..... *A61G 5/14* (2013.01); *A47C 1/00* (2013.01); *A47C 1/024* (2013.01); *A47C 1/032* (2013.01); *A47C 3/20* (2013.01); *A61G 5/006* (2013.01); *A61G 5/10* (2013.01); *A61G 5/101* (2013.01); *A61G 5/1005* (2013.01); *A61G 5/1021* (2013.01); *A61G 5/1035* (2013.01); *A61G 5/1059* (2013.01); *A61G 5/122* (2016.11);

(Continued)

(58) Field of Classification Search

CPC ..... A61G 5/00; A61G 5/006; A61G 5/1005; A61G 5/1059; A61G 5/14

See application file for complete search history.

(56) References Cited

U.S. PATENT DOCUMENTS

| | | | |
|---|---|---|---|
| 196,506 | A | 10/1877 | Vose |
| 426,601 | A | 4/1890 | Muhl |

(Continued)

*Primary Examiner* — Philip F Gabler

(74) *Attorney, Agent, or Firm* — Warner Norcross + Judd LLP

(57) ABSTRACT

A medical chair includes a base, a seat, and a leg rest pivotally mounted relative to the seat and adapted to move between an extended position and a retracted position. The chair further includes a first actuator for tilting the seat with respect to the base, a second actuator for lifting the seat with respect to the base, and a leg rest actuator adapted to move the leg rest. The chair also includes a controller adapted to control the first and second actuators to move the seat between a first position and a second position such that the seat is both lifted and tilted at the same time as the seat moves from the first position to the second position, and wherein the controller is adapted to control the leg rest actuator such that the leg rest maintains a substantially constant orientation with respect to the floor.

21 Claims, 67 Drawing Sheets

Related U.S. Application Data

(60) Provisional application No. 61/791,255, filed on Mar. 15, 2013.

(51) Int. Cl.
*A47C 3/20* (2006.01)
*A61G 5/00* (2006.01)
*A61G 5/12* (2006.01)

(52) U.S. Cl.
CPC ..... *A61G 5/127* (2016.11); *A61G 5/00* (2013.01); *A61G 5/107* (2013.01); *A61G 5/12* (2013.01)

(56) References Cited

U.S. PATENT DOCUMENTS 426,602 A 4/1890 Muhl
953,872 A 4/1910 Vrba
2,727,561 A 12/1955 Bank et al.
3,140,893 A 7/1964 Schliephacke
3,216,026 A 11/1965 Mann
3,492,045 A 1/1970 Schefthaler
3,756,651 A 9/1973 Sloan
3,790,211 A 2/1974 Caldwell
3,842,449 A 10/1974 Geurtsen et al.
4,719,655 A 1/1988 Dean
4,819,987 A 4/1989 Stringer
5,333,818 A 8/1994 Brandt et al.
5,352,020 A 10/1994 Wade et al.
5,366,036 A * 11/1994 Perry ..... A61G 5/006 180/65.1
5,427,431 A 6/1995 Saul et al.
5,507,562 A 4/1996 Wieland
5,782,535 A 7/1998 Lafer
5,918,942 A 7/1999 Olsen
6,030,033 A 2/2000 Schultz
6,227,489 B1 5/2001 Kitamoto et al.
6,375,266 B1 4/2002 Ferguson et al.
6,496,993 B2 12/2002 Allen et al.
6,517,160 B2 2/2003 Marcantoni
6,557,940 B2 * 5/2003 Hayashi ..... A61G 5/14 297/330
6,611,979 B2 9/2003 Welling et al.
6,651,273 B2 11/2003 Vilsmeier
6,652,033 B2 11/2003 Satoh
6,663,184 B2 12/2003 Hagiike
6,692,078 B2 2/2004 Pham et al.
6,754,923 B2 6/2004 Borders et al.
6,773,074 B2 8/2004 Flory et al.
6,783,178 B2 8/2004 Kasahara
6,926,366 B2 8/2005 Wolters
6,929,323 B2 8/2005 Enno
7,080,887 B2 7/2006 Tseng
7,201,451 B2 4/2007 Baumann
7,216,384 B2 5/2007 Allen et al.
7,273,257 B2 9/2007 De Vroe
7,296,312 B2 11/2007 Menkedick et al.
7,350,249 B2 4/2008 Jacobs et al.
7,406,731 B2 8/2008 Menkedick et al.
7,428,761 B2 9/2008 Engels et al.
7,520,006 B2 4/2009 Menkedick et al.
7,610,637 B2 11/2009 Menkedick et al.
7,784,128 B2 8/2010 Kramer
7,934,276 B2 5/2011 Newkirk et al.
RE43,155 E 2/2012 Allen et al.
RE43,532 E 7/2012 Menkedick et al.
8,353,071 B2 1/2013 Turner et al.
8,444,225 B2 5/2013 Behe
8,474,076 B2 7/2013 Hornbach
8,615,828 B2 12/2013 Schermel
8,662,595 B2 3/2014 Kramer et al.
9,713,559 B2 * 7/2017 Hough ..... A61G 5/14
2002/0014751 A1 * 2/2002 Hanson ..... A61G 5/006 280/15
2004/0021354 A1 2/2004 Hogg
2005/0000020 A1 1/2005 Schermel
2005/0172405 A1 8/2005 Menkedick et al.
2006/0186721 A1 8/2006 Flory et al.
2011/0240797 A1 10/2011 Behe
2012/0073052 A1 3/2012 Meyer
2012/0091779 A1 4/2012 Chang et al.
2012/0104827 A1 5/2012 Murphy et al.
2012/0198627 A1 8/2012 Turner et al.
2012/0267921 A1 10/2012 Lafer
2014/0132039 A1 5/2014 Lu et al.

* cited by examiner

MEDICAL SUPPORT APPARATUS

The present application is a continuation of U.S. patent application Ser. No. 14/212,323, filed Mar. 14, 2014, which claims the benefit of U.S. Provisional Application, entitled MEDICAL SUPPORT APPARATUS, Ser. No. 61/791,255, filed Mar. 15, 2013, which are incorporated by reference herein in their entireties.

TECHNICAL FIELD AND BACKGROUND

The present invention relates to a patient support apparatus, and more particularly to a medical recliner chair.

It is well known in the medical field that a patient's recovery time can be improved if the patient becomes more mobile. However, egress and exit from a traditional hospital bed can be challenging. One step on the pathway to becoming more mobile is to have a patient be transitioned to sitting in a chair, for example a reclining chair, for at least part of the time, which generally provides greater ease of egress and exit.

SUMMARY

According to one embodiment, a medical chair is provided that includes a base, a seat, first and second actuators, and a controller. The first actuator is for tilting the seat with respect to the base and the second actuator is for lifting the seat with respect to the base. The controller controls the first and second actuators to move the seat between a sitting position and a standing position. The controller controls this movement in such a way that the seat is both lifted and tilted at the same time as the seat moves from the sitting position to the standing position.

According to another embodiment, a medical chair is provided that includes a base, a wheel coupled to the base, a seat, a brake for the wheel, and a control system. The control system is adapted to move the seat between a sitting position and a standing position in response to a user input. The control system is further adapted to automatically check the status of the brake in response to the user input and prior to moving the seat from the sitting position to the standing position.

According to another embodiment, a medical chair is provided that comprises a base, a seat, a backrest, and a controller. The controller is adapted to control the movement of the seat between a sitting position and a standing position such that the seat is both lifted and tilted at the same time as the seat moves from the sitting position to the standing position. The controller is further adapted to control the pivoting of the backrest with respect to the seat such that the backrest and the seat form a first angle therebetween when the seat is in the sitting position, and the backrest and seat form a second angle therebetween when the seat is in the standing position. The second angle is greater than the first angle.

According to other aspects, the medical chair may remain substantially vertically oriented when the seat is in the standing position.

A pair of arm rests may be included that remain in a substantially constant orientation as the seat moves between the sitting position and the standing position. The arm rests each have a forward portion and a rearward portion, and the forward portion has a higher elevation with respect to the base than the rearward portion.

The controller may be adapted to move the backrest in such a manner that a person's upper body remains generally vertically aligned with the person's hips during movement of the seat from the sitting position to the standing position.

The medical chair may further comprise a wheel coupled to the base, a brake for the wheel, and a brake sensor. The brake sensor is in communication with the controller and the controller is adapted to determine if the brake is in a braked state prior to moving the seat from the sitting position to the standing position and to prevent movement of the seat from the sitting position to the standing position if the brake is indeed in the unbraked state. The controller may additionally or alternatively be adapted to automatically change the brake to the braked state prior to movement of the seat from the sitting position to the standing position.

A leg pivotally mounted relative to the base and the seat may be included that tilts inwardly when the seat is moved from the sitting position to the standing position.

The controller may drive the first and second actuators in a manner that creates a virtual pivot for the seat which is between a back edge of the seat and a front edge of the seat.

In other aspects, the control system prevents movement of the seat from the sitting position to the standing position if the brake is not in the braked state. Alternatively, the control system is adapted to automatically change the brake from the unbraked state to the braked state in response to the user input, and to thereafter move the seat from the sitting position to the standing position.

According to another embodiment, a medical chair includes a base and a pair of arm rests supported by the base for movement between a raised position and a lowered position. At least one of the arm rests has a raised position that is upward and forward (relative to the footprint of the base) from its lowered position to provide support to the patient when exiting the chair.

In one aspect, each of the arm rests has a raised position that is upward and forward from its lowered position to provide support to a patient when exiting the chair. For example, each of the arm rests may be mounted at the base by a slide, such as a linear slide.

In other aspects, each of the arm rests has an arm rest cushion, with the arm rest cushions each having an orientation. The orientations of the arm rest cushions remain generally unchanged when the arm rests are moved between their lowered and raised positions.

In other aspects, the chair may include a pair of locking mechanisms wherein each of the arm rests is lockable in at least one position. Optionally, each of the arm rests is lockable in a plurality of the positions between the lowered and raised positions, including in the raised position.

In a further aspect, the chair also includes a manual releases to release the or each locking mechanism. The chair may include a pair of manual releases to release the locking mechanisms.

In any of the above chairs, the chair may include one or more safety releases that are configured to release the or each locking mechanism when the arm rest or arm rests are lowered and encounter an object. Each arm rest may include a safety release which is configured to release a respective locking mechanism when the respective arm rest is lowered and encounters an object of sufficient stiffness to trigger the safety release. For example, each of the safety releases may comprise a mechanical mechanism, such as a rod or bar, supported at a lower end of the arm rests, and which optionally may extend along the full length of the respective arm rests.

In any of the above chairs, at least one arm rest includes a spring assist to reduce the apparent weight of the at least one arm rest to facilitate movement. For example, the spring assist may comprise a constant force spring, including a coiled plate spring. Further, each arm rest may include a spring assist to lower the apparent weight of the arm rest to facilitate movement.

According to yet other aspects, the chair further includes a lift and a chassis that is supported by the lift, wherein the lift is operable to raise and lower the chassis with respect to the base. The chassis supports the arm rest or rests and a seat section.

In any of the above, the base includes a base frame, and optionally a wheeled base frame.

According to yet another embodiment, a medical chair includes a base and an arm rest supported relative to the base for movement between a raised position and a lowered position. The chair further includes a locking mechanism operable to lock the arm rest in at least one of the raised and lowered positions and a safety release mechanism to prevent the locking mechanism from locking when the arm rest encounters an object while it is being lowered.

For example, the safety release mechanism may include a rod or bar at a lower end of the arm rest. Further, the rod or bar may extend along the full length of the lower end of the arm rest.

Additionally, the locking mechanism may selectively lock the arm rest in a plurality of positions between the lowered and raised positions.

The chair may also include a manual release to release the locking mechanism. Further, the safety release mechanism may be coupled to the manual release mechanism and actuate the manual release mechanism to release the locking mechanism.

In another embodiment, a recliner includes a wheeled base and a support surface, such as a segmented support surface, that is supported on the wheeled base by two X-frames. The X-frames are interconnected by a cross-member offset from the pivot joint of the X frames, which provides a mount for a cylinder actuator, which is coupled to the cross-member on one end and coupled to the base at its opposed end by a pivotal mount so that when it is extended or contracted it unfolds or folds the X frames about their pivot axes to thereby form a lift mechanism for the support surface. One set of the upper pivot and lower pivot points are fixed while the other set is slidably mounted to avoid binding when being folded or unfolded.

In another aspect, a medical recliner includes an arm rest that is guided on a path from a lowered position to a raised position that is upward and forward from the lowered position. Further, the arms rest is lockable in several positions by a locking mechanism to accommodate both ingress and egress. Incorporated into the arm rest is a manual release for the locking mechanism, which allows the caregiver to raise or lower the arm rest. To assist in raising or lowering of the arm rest, the arm rest also incorporates a constant force spring, which reduces the force necessary to raise or lower the arm rest. The upper surface of the arm rest can be lowered so that it is generally planar with or below the seat section to facilitate the lateral transfer of a patient supported on the chair when the support surface of the chair is in a horizontal position.

In yet another aspect, a medical recliner includes a leg rest that includes three nesting sections that are joined and guided by rails. The sections are extended by a scissor mechanism with linkages that are coupled to each section. The first and innermost section is pivotally mounted to the recliner's support surface support frame by a transverse shaft. The innermost section is pivoted about the shaft by an actuator, which mounts to the inner section at its distal end via a transverse rod, which is mounted to the innermost section. The scissor mechanism is secured to the first section at one end by a pin mounted in a slotted bracket to form a sliding joint. The pin then couples to a link that is fixed to the support surface support frame on its opposed end and has a fixed length such that when the first section is rotated about its hinged connection to the support surface support frame by the actuator (which pushes and pulls on the transverse rod), the link pulls or pushes on the pin to cause the scissor mechanism to extend or contract.

The scissor mechanism may be stabilized by two gas springs that help the mechanism collapse and support the intermediate channel while allowing the scissor mechanism to extend and contract. Alternately, the scissor mechanism may be stabilized by guide pins that slidingly engage the underside of two or more sections.

In another embodiment, a medical recliner chair includes a lowered leg rest that has a built in deployment delay, which may be handled electronically. When the chair is in the upright position and a recline button is pressed, the leg rest will not start deploying immediately. This is to allow the patient to adjust the backrest angle a few degrees for comfort purposes while still in an "upright" chair position. Therefore, the actuator that moves the leg rest is not powered until after the back is lowered to a preselected degree.

In other aspects, a medical recliner includes an adjustable arm rest with a locking mechanism that is biased into a locking position and released from its locked position by a handle. For example, the handle maybe coupled to the locking mechanism by a cable so that when the handle is pulled, the cable will release the locking mechanism. The arm rest may also include a mechanical release mechanism, in the form of a rod or bar at its lower end that is also coupled to the locking mechanism so that if an object is below the arm rest when it is lowered and is contacted by the rod, the object will push on the rod which will release the locking mechanism and the arm rest will be free to move up. For example, the rod may extend the full length of the outer lower edge of the arm rest. The arm rest additionally may include a constant force spring that provides an assist to the arm rest so that some of the arm rest weight is borne by the spring.

In yet another aspect, a medical recliner includes a support surface, a lift to raise and lower the support surface, a controller for actuating the lift, and an obstacle detection sensor in communication with the controller, wherein the controller stops the lift from lowering the support surface when an obstacle is detected.

In one aspect, the sensor comprises a pressure sensor, such as a plunger switch.

In another aspect, the medical recliner includes an arm rest, with the sensor mounted to the lower end of the arm rest.

In yet another aspect, the arm rest is movable relative to the support surface.

In yet another aspect, a medical recliner includes with seat and backrests that each have a shell and a foam layer over the shell. In the seat section, the shell forms a recess and a shelf adjacent the recess, which extends laterally under a person's thighs when seated on the seat section. The backrest shell is formed with two forwardly projecting "wings" on either side of the central portion of the backrest shell. The foam is generally uniform in thickness except at the head end of the backrest where it is thickened to form a rounded head rest.

According to yet another embodiment, a medical recliner includes a seat section elevating and tipping forward to help the patient into the upright position. In addition, the arm rests of the arms are curved to provide continuous support to a person when being tilted forward to the egress position. Further, the seat section can be independently raised in a manner that it is higher than the arm rests so that a patient can be more easily rolled, lifted, or otherwise moved from the recliner to a bed, or vice versa. The back, seat and foot sections are also mounted for movement so that they can be arranged generally in a flat or trend position, which can be controlled by a button on the nurse control panel.

In yet another embodiment, a medical chair includes a base, a seat frame, a backrest bracket, an actuator, and a backrest. The backrest bracket is pivotally coupled to the seat frame about a first pivot axis. The actuator is supported on the seat frame and coupled to the backrest bracket, and the actuator is adapted to pivot the backrest bracket about the first pivot axis. The backrest is pivotally coupled to the backrest bracket about a second pivot axis and movable between an upright position and a lowered position. The actuator causes the backrest to pivot about the first pivot axis during a first portion of movement between the upright position and the lowered position, and to pivot about the second pivot axis during a second portion of movement between the upright position and the lowered position.

In other aspects, the first pivot axis is positioned at a location between a front end of the seat frame and a rear end of the seat frame where a patient's buttocks typically is positioned when a patient is seated on the patient support apparatus. The backrest pivots about the first pivot axis exclusively during the first portion of movement, and the backrest pivots about the second pivot axis exclusively during the second portion of movement in at least one form.

In at least one embodiment, the first portion of movement corresponds to movement between the upright position and an intermediate position, and the second portion of movement corresponds to movement between the lowered position and the intermediate position.

The first pivot axis may be positioned forward of a front end of the backrest, and the second pivot axis may be positioned at a higher height than the first pivot axis.

The actuator may include a first end coupled to the seat frame and a second end coupled to a pin, wherein the pin is configured to ride in an elongated channel defined on the seat frame as the backrest pivots between the upright and lowered positions. The elongated channel is straight and oriented generally horizontally. A pin guide member may be fixedly attached to the backrest bracket wherein the pin guide member includes a pin channel defined therein positioned for the pin to ride in during pivoting of the backrest between the upright and lowered positions. The pin channel may include a first section that is arcuately shaped and a second section that is generally straight. Still further, the pin may ride in the generally straight section of the pin channel when the backrest moves between the lowered position and the intermediate position, while the pin rides in the arcuately shaped section when the backrest moves between the intermediate position and the upright position.

A linkage assembly that includes a plurality of links may be included between the backrest and the backrest bracket. The linkage assembly may include a four bar linkage subassembly. The linkage assembly may include a channel link member having an arcuate channel defined therein and configured to allow the pin to ride therein. The pin remains at a first end of the arcuate channel while the backrest pivots between the intermediate position and the lowered position, and the pin moves to a second end of the pin channel when the backrest pivots from the intermediate position to the lowered position. The arcuate channel may include a shape that is substantially the same shape as the arcuately shaped section of the pin channel of the pin guide member. The arcuate channel and the arcuately shaped section of the pin channel are aligned with each other during movement of the backrest between the upright and intermediate positions. The arcuate channel and the arcuately shaped section of the pin channel become misaligned with each other during movement of the backrest between the intermediate and lowered positions.

In another embodiment, a patient support apparatus, such as a medical chair, including a medical recliner chair, includes a base, at least one wheel coupled to the base, and a seat supported by the base. The apparatus further includes a brake system supported at the base, which includes a cable and a brake pedal coupled to a first end of the cable. A second end of the cable is coupled to a brake associated with the wheel, which is configured such that pushing down on the brake pedal allows the mechanical cable to move closer to the brake, and the movement of the mechanical cable closer to the brake causes the brake to brake the wheel.

Optionally, the brake system further includes a toggle plate adapted to hold the brake pedal in either a braked position or an unbraked position while allowing the brake pedal to move there between when an external force is applied to the brake pedal. For example, the external force may be exclusively a downward force.

In another aspect, the apparatus may include a toothed gear coupled to the wheel and a brake pivot positioned adjacent the toothed gear and adapted to pivot into and out of engagement with the toothed gear, with the brake pivot pivoting into engagement with the toothed gear when the pedal is pressed.

Optionally, a brake spring can be positioned inside each of the brake, which is adapted to exert a force on the cable that urges the mechanical cable toward the brake.

The apparatus may include a generally vertical swivel lock pin positioned inside the brake and a swivel lever positioned inside of each of the brake, which is adapted to urge the swivel lock pin upward when the pedal is pressed.

In yet another aspect, the braking system may include an annular castle member with a generally vertical central axis, which is adapted to remain stationary as the wheel swivels about a generally vertical axis. For example, the annular castle member may include an annular ring of alternating slots and projections. Further, the generally vertical axis and the generally vertical central axis are optionally aligned. Additionally, when a swivel lever is present, the swivel lever may urge the swivel lock pin into engagement with the annular castle member.

In another aspect, a swivel spring may be coupled to the swivel lever, which compresses if the swivel lock pin engages one of the projections on the annular castle member when the brake pedal is pressed. The swivel spring may be adapted to not compress if the swivel lock pin extends into one of the slots on the annular castle member when the brake pedal is pressed.

In any of the above, pressing on the brake pedal may prevent the wheels from both rotating and swiveling.

In any of the above, the apparatus is a recliner and includes a backrest pivotal between an upright position and a lowered position.

In any of the above, the apparatus may include a toggle spring coupled to the brake pedal, which is adapted to urge the brake pedal toward an unbraked position.

In any of the above, the apparatus may include two or more wheels, each with a brake.

According to yet another embodiment, a patient support apparatus, for example, a medical chair, including a medical recliner chair, includes a base with caster wheels and a braking system for braking at least one of the caster wheels. The braking system has an actuator for braking the at least one caster wheel and a manually operable input mechanism configured to actuate the actuator. The apparatus further includes a control system having a user interface configured to actuate the actuator. The braking system is configured to allow either the manually operable input mechanism or the user interface to actuate the actuator to thereby lock the at least one caster wheel and to allow either the manually operable input mechanism or the user interface to disengage the actuator to thereby unlock the at least one caster wheel.

In one aspect, the manually operable input mechanism comprises a pedal.

In another aspect, the user interface comprises an electrical operated button.

In yet a further aspect, the actuator drives the manually operable input to actuate the actuator.

According to yet another aspect, the control system includes a solenoid, which when actuate drives the operable input mechanism to actuate the brake.

According to yet another embodiment, a medical chair includes a base having at least one wheel having a brake, a manual braking mechanism for selectively actuating the brake at the wheel, and a control system operable to control the brake in response to a signal or lack of signal at the chair.

In one aspect, the control system includes an actuator, and the actuator coupled to the manual braking mechanism to move the manual braking mechanism to a braking or unbraking position.

For example, the actuator may comprise a solenoid, a center-lock actuator, or other type of actuator which is coupled to the manual braking mechanism.

In another aspect, the control system includes a sensor to generate the signal in response to detecting motion of the chair. The control system is operable to prevent braking of the brake when the sensor detects motion of the chair or operable to actuate the brake when the sensor does not detect motion of the chair. For example, sensor may comprise an accelerometer.

According to yet other aspect, the control system includes a sensor that generates the signal when detecting motion of the chair, with the control system operable to actuate the brake when the signal is not received, for example, after a pre-selected passage of time.

In yet other aspects, the chair further includes a support surface and at least one actuator for adjusting the configuration or orientation of the support surface, and wherein the signal is generated in response to the configuration or orientation being adjusted.

According to another embodiment, a medical chair is provided that includes a seat frame and a backrest. The backrest is pivotally coupled to the seat frame such that the backrest pivots with respect to the seat frame about a first pivot axis during movement of the backrest between an upright position and an intermediate position, and the backrest pivots with respect to the seat frame about a second pivot axis during movement of the backrest between the intermediate position and a lowered position. The first pivot axis is located below a top face of the seat frame.

According to another embodiment, a medical chair is provided that includes a seat frame, a backrest, and a link. The backrest is adapted to pivot with respect to the seat frame about a first pivot axis during movement of the backrest between an upright position and an intermediate position, and to pivot with respect to the seat frame about a second pivot axis during movement of the backrest between the intermediate position and a lowered position. The link is pivotally coupled between the backrest and the seat frame, and the link has a first end coupled to the seat frame at a location aligned with the first pivot axis and a second end coupled to the backrest at a location aligned with the second pivot axis.

According to other embodiments, the second pivot axis is located at a height lower than a height of the first pivot axis when the backrest is in the intermediate position. The second pivot axis may also be located at a position closer to the backrest than the first pivot axis. The first pivot axis may be positioned at a location between a front end of the seat frame and a rear end of the seat frame where a patient's buttocks typically is positioned when a patient is seated on the medical chair.

In other aspects, the medical chair may further comprise a pivot bracket coupled to the backrest, a bearing supported by the bracket, and a channel defined in the seat frame. The bearing is positioned to move within the channel from a first end of the channel to a second end of the channel during movement of the backrest between the upright position and lowered position. The channel may include a first section and a second section that, in combination, form an L-shape. The first section is oriented substantially vertically when the backrest is in the upright position. The bearing is also positioned at a junction of the first and second sections when the backrest is in the intermediate position.

In other aspects, the medical chair includes a backrest actuator coupled between the seat frame and the backrest. The backrest actuator is movable between an extended position and a retracted position, whereby the backrest actuator is in the extended position when the backrest is in the upright position and the backrest actuator is in the retracted position when the backrest is in the lowered position. A controller may also be provided that is adapted to electrically control both the backrest actuator and a seat frame actuator that is adapted to pivot the seat frame. The controller is configured to pivot a rear end of the seat frame initially downwardly and then subsequently upwardly as the backrest pivots downwardly from the upright position to the lowered position.

The first pivot axis may remain stationary with respect to the seat frame during movement of the backrest between the upright position and the intermediate position, and the second pivot axis may rotate about the first pivot axis during movement of the backrest between the upright position and the intermediate position.

A link may be provided between the backrest and the seat frame wherein the link is coupled at a first end to the seat frame at a location aligned with the first pivot axis, and the link is coupled at a second end to the backrest at a location aligned with the second pivot axis.

In other aspects, the backrest pivots with respect to the seat frame exclusively about the first pivot axis during movement between the upright position and the intermediate position, and the backrest pivots with respect to the seat frame exclusively about the second pivot axis during movement between the intermediate position and the lowered position.

In other aspects, the medical chair includes a pivot bracket coupled to the backrest, a bearing supported by the bracket, and a channel defined in the seat frame. The bearing is positioned to move within the channel from a first end of the channel to a second end of the channel during movement of the backrest between the upright position and lowered position.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE EMBODIMENTS

Figure 2:
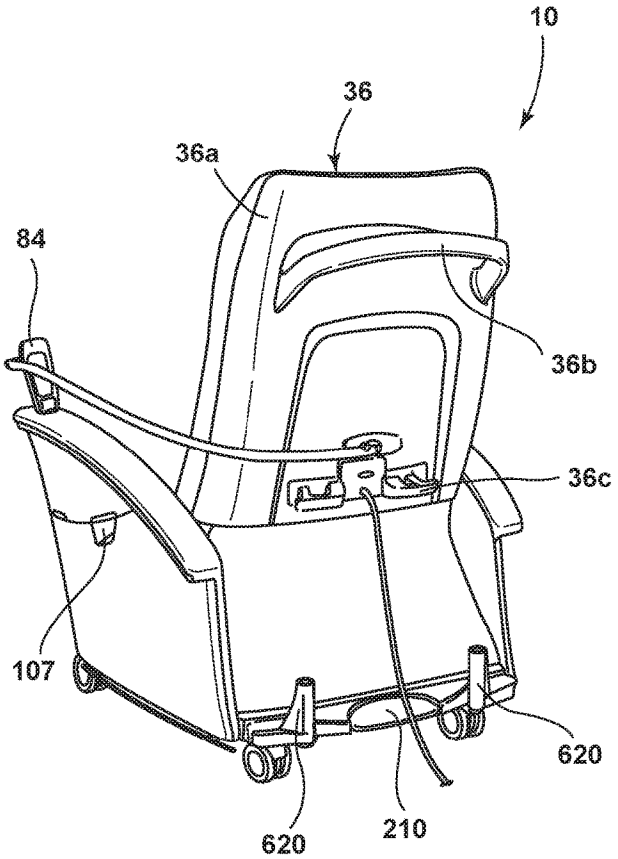
FIG. 2 is a rear perspective view of a chair of FIG. 1.
Figure 1:
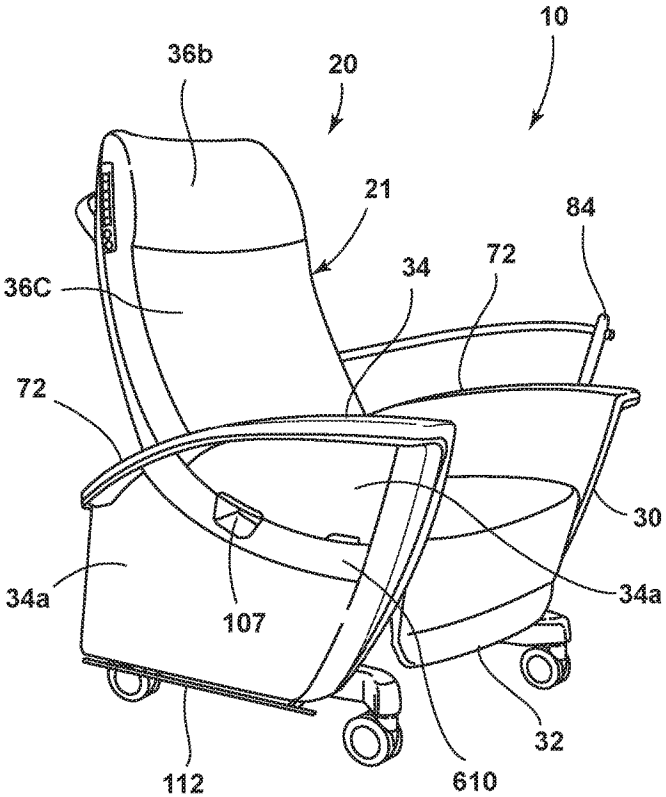
FIG. 1 is a respective view of a patient support apparatus in the form of a medical recliner chair.

Referring to FIG. 1, the numeral 10 generally designates a patient support apparatus in the form of a recliner chair 20. As will be more fully described below, recliner chair 20 includes a support surface 21, which is configured so that it can be reconfigured from a seated position to a reclined configuration, such as shown in FIGS. 1, 3, 3A and 3B, and further reconfigured to provide a sit-to-stand configuration, such as shown in FIGS. 4, 5, 9, 9A, and 9B. Additionally, support surface 21 may be arranged to provide a generally horizontal support surface to provide support to a patient in a supine position, such as shown in FIG. 10.

Figure 3:
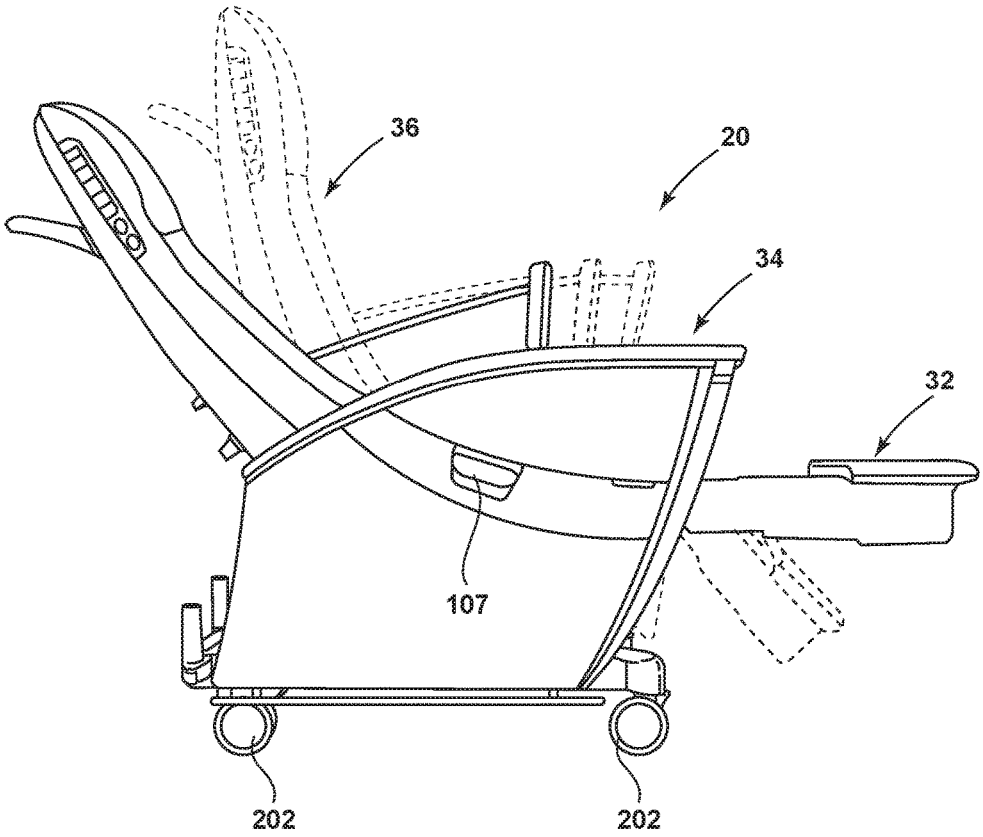
FIG. 3 is a side elevation view of the chair of FIG. 1 showing the chair in a reclined position.
Figure 3A:
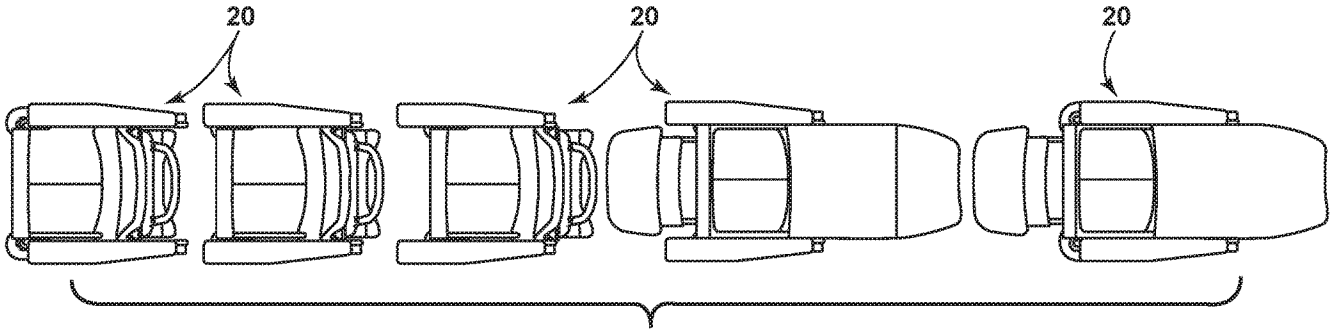
FIG. 3A is series of plan views showing the change in support surface of the chair as it moves from a sitting position to a reclined position.
Figure 3B:
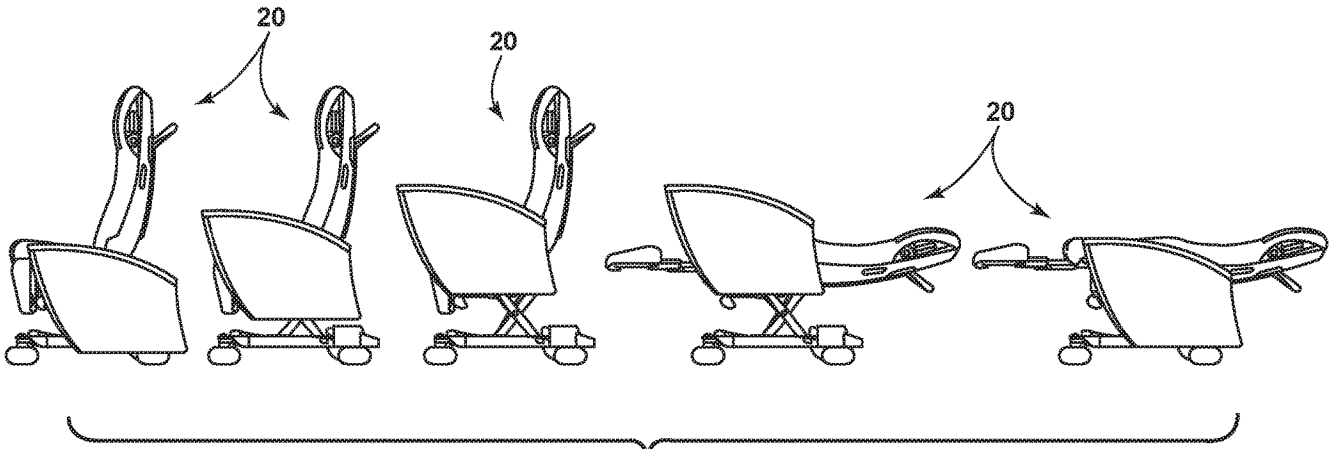
FIG. 3B is a series of side elevation views showing the chair moving to a reclined position.
Figure 3C:
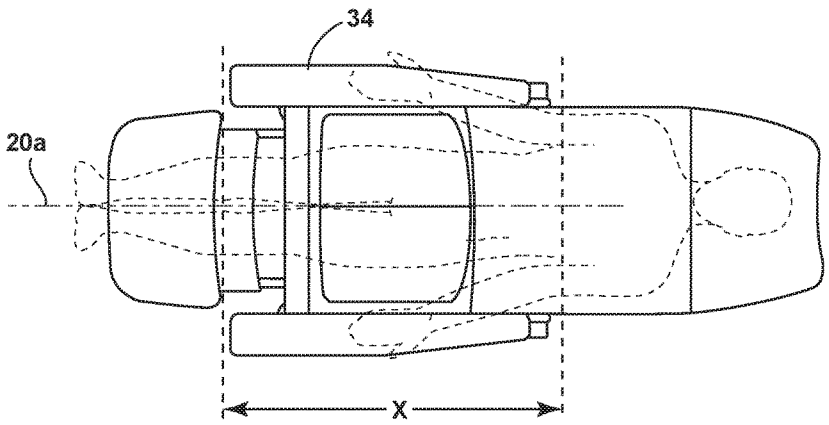
FIG. 3C is a plan view of the chair in the reclined position with the arm rests raised.
Figure 3D:
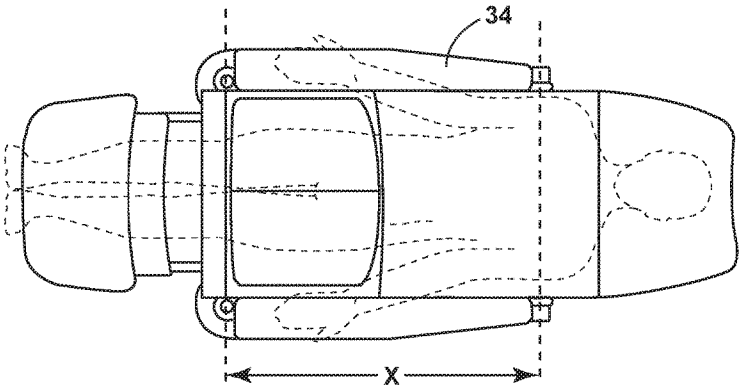
FIG. 3D is a plan view of the chair in the reclined position with the arm rests raised.
Figure 5:
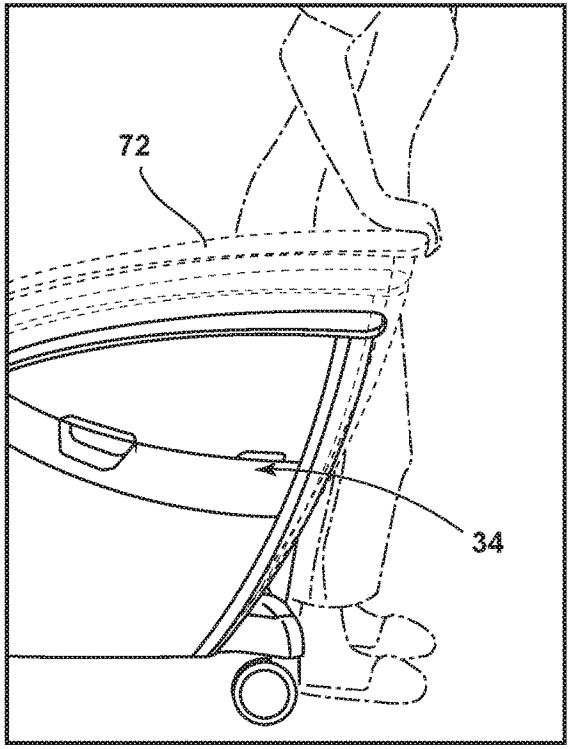
FIG. 5 is an enlarged perspective view of the arm rests of FIG. 4.
Figure 4:
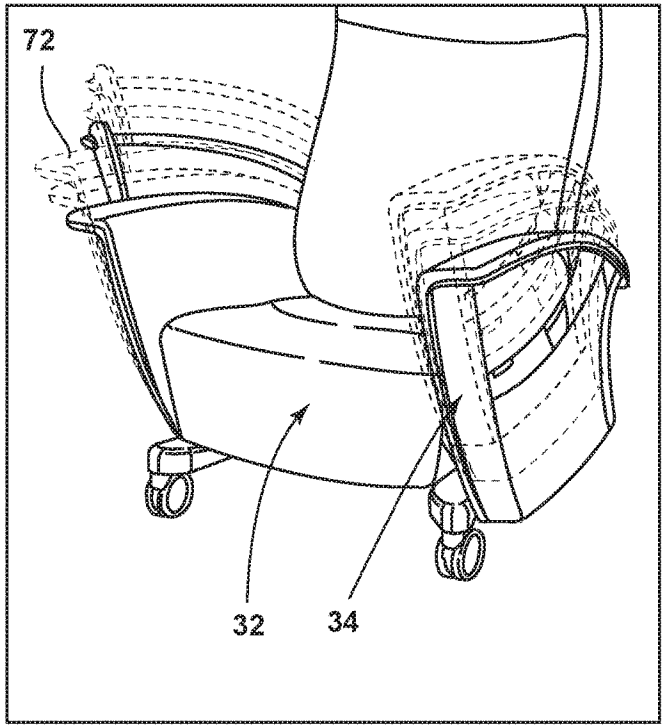
FIG. 4 is a front perspective view of the recliner chair of FIG. 1 illustrating the arm movement of the chair when providing a sit-to-stand function.
Figure 6:
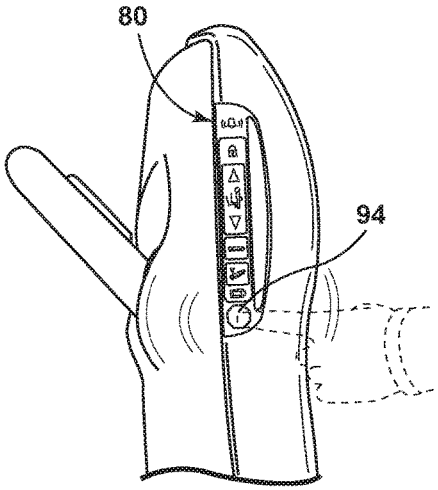
FIG. 6 is an enlarged view of the head section of the recliner illustrating one of the chair based control units.
Figure 6A:
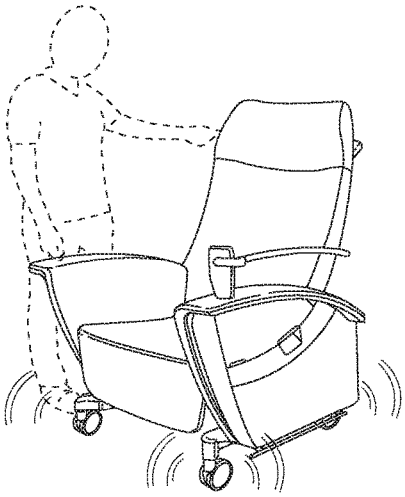
FIG. 6A is a perspective view of the chair showing a user accessing the control unit of FIG. 6.
Figure 10:
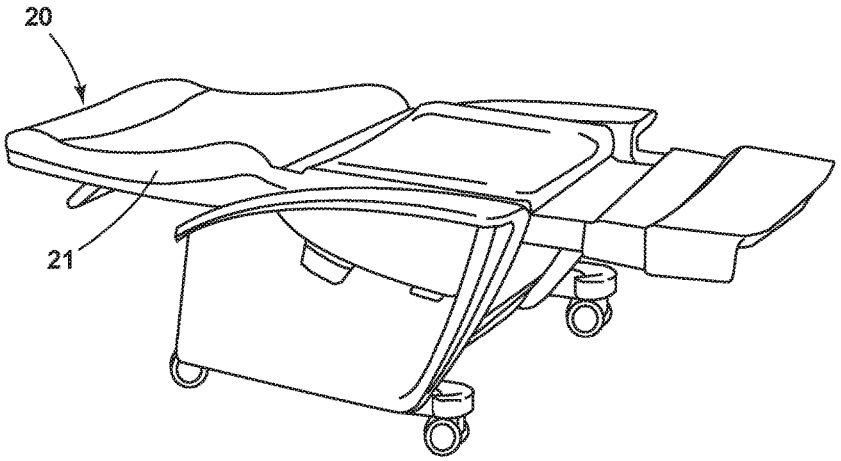
FIG. 10 is a perspective view of the recliner in a bed based configuration to support the patient in a supine position.

In addition, chair 20 includes a pair of arm rests 34 that are moveably mounted relative to the base of the chair and further movable in a manner to assist a person exiting the apparatus, such as shown in FIGS. 3B, 4 and 5, and further are moveable to a lowered position wherein the upper surface of the arm rests are at most planar or recessed below the support surface to allow a patient transfer such as shown in FIGS. 3B and 10. Additionally, as shown in FIGS. 3C and 3D, arm rests 34 are sized so that they have a length X (as measured along the longitudinal axis 20*a* of chair 20), which is sufficient to align with both a lower portion of a person's torso and the person's knees and thighs (based on an adult person of average height) when the arm rests are in a raised configuration but then are more centrally located adjacent the middle portion of the person's body (e.g. a greater portion the person's torso and the upper portion of the thighs) when lowered so that the arm rests align with the patient's center of gravity and can provide a bridge when a lateral transfer is desired.

Figure 11:
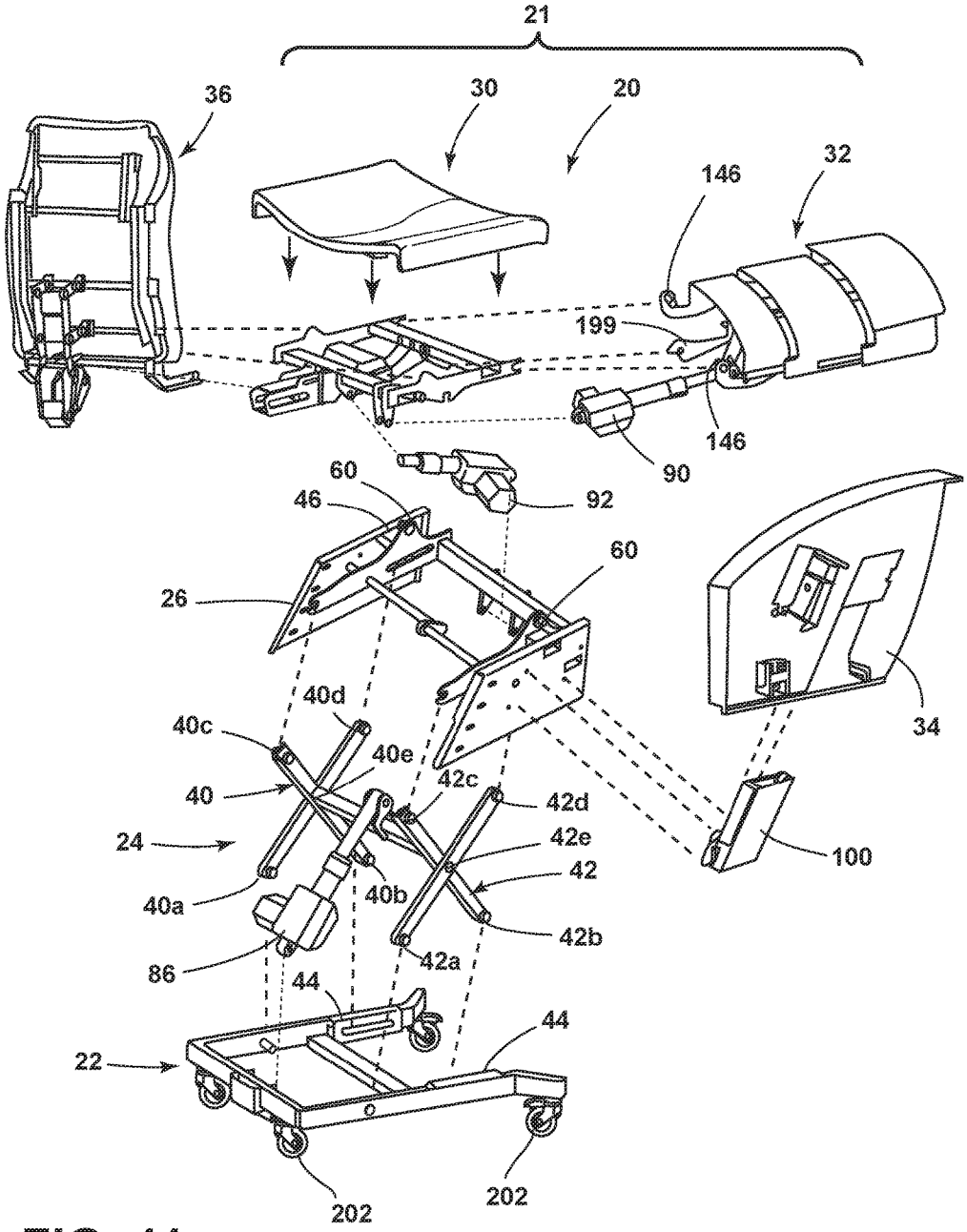
FIG. 11 is an exploded perspective view of the chairs internal components.

Referring to FIG. 11, chair 20 includes a base 22, a lift with a lift mechanism 24, which supports a chassis 26 on the base for movement between a lowered position and a raised position. Mounted to chassis 26 are a pair of arm rests 34 (only one shown in FIG. 11) and further support surface 21. Support surface 21 is formed by a seat section 30, a leg rest 32, and a backrest 36, which are respectively pivoted relative to chassis 26 to allow the respective sections to be moved, as will be more fully described below and as shown, for example, in FIGS. 19-27.

Figure 12:
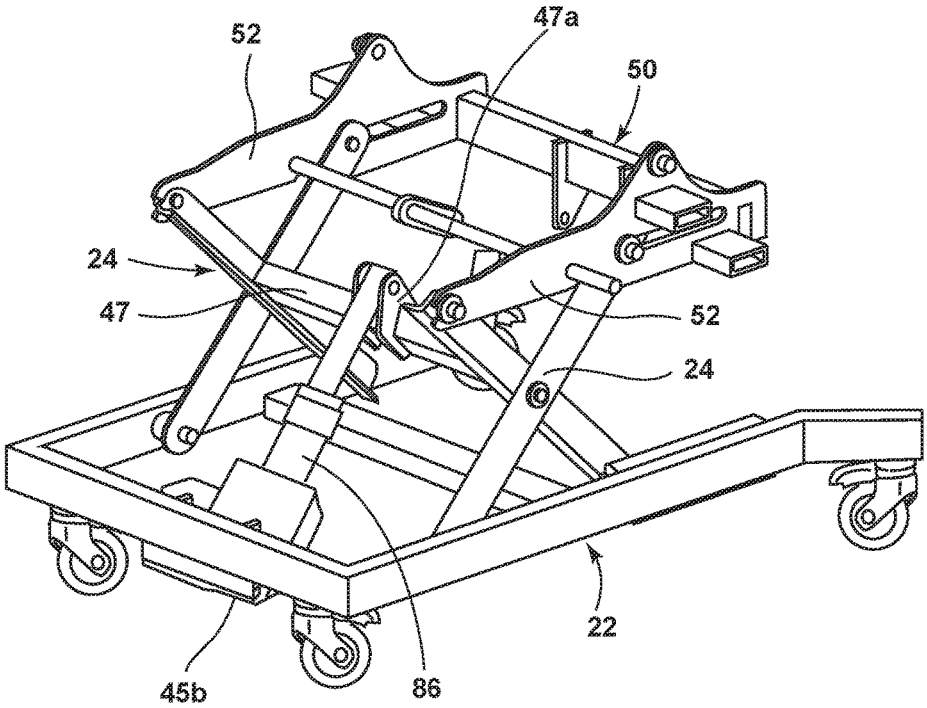
FIG. 12 is an enlarged perspective view of the base of the chair.
Figure 13:
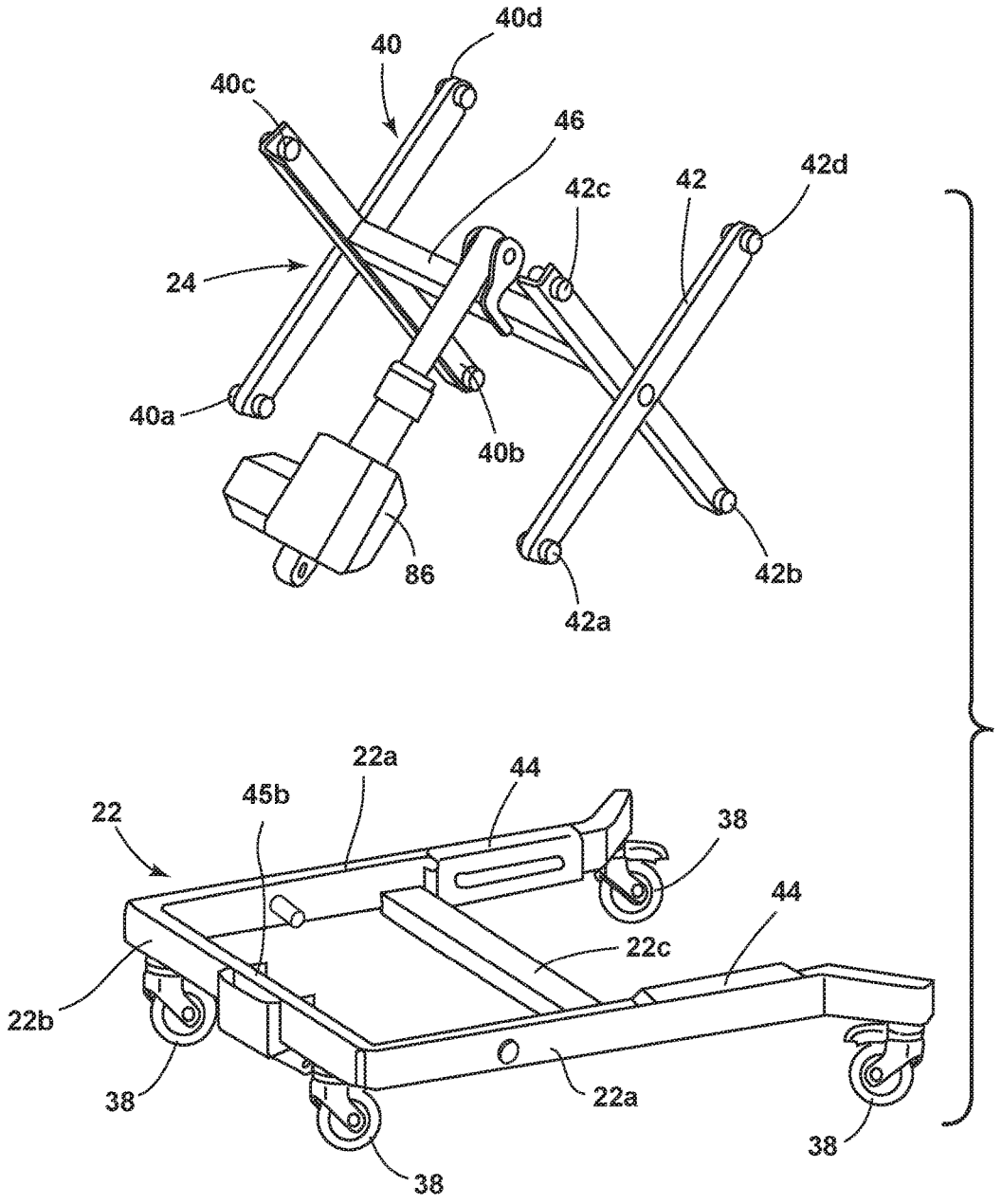
FIG. 13 is an exploded perspective view of the base and lift mechanism.

Base 22 includes a plurality of caster wheels 202 (describe below in reference to the braking system) which are mounted for rotation and swivel movement and which are braked by a braking system more fully described in reference to FIGS. 29-36. The lift mechanism comprises a pair of X-frames 40 and 42, each with lower ends 40*a* and 40*b* and 42*a* and 42*b* which are mounted to base 22 by pins or bushings, with lower ends 40*a* and 42*a* pinned to the frame of base 22 by pins or bushings, and with lower ends 40*b* and 42*b* of X-frames 40, 42 being mounted in slotted channels 44 mounted to the frame of base 22. Similarly, upper ends 40*c* and 40*d* of X-frame 40 and upper ends 42*c* and 42*d* of X-frame 42 are mounted to chassis 26 with ends 40*c* and 42*c* pinned at chassis 46 and ends 40*d* and 42*d* slidably pivotally mounted to chassis 26 in slotted openings 46 provided in chassis 26. In this manner, when X-frames 40 and 42 are collapsed or extended about their respective axis 40*e* and 42*e*, chassis 26 will be raised and lowered with their respective base 22. Further, as best seen in FIG. 13, X-frames 40 and 42 are joined by a cross bar 47 to provide a mounting surface for an actuator (86), which is mounted to cross bar 47 by a bracket 47*a* (FIG. 12), which is centrally located between X-frames 40 and 42 on one end and pivotally mounted to base 22 at its opposed end by a bracket 45*b* to thereby form the lift.

Figure 14:
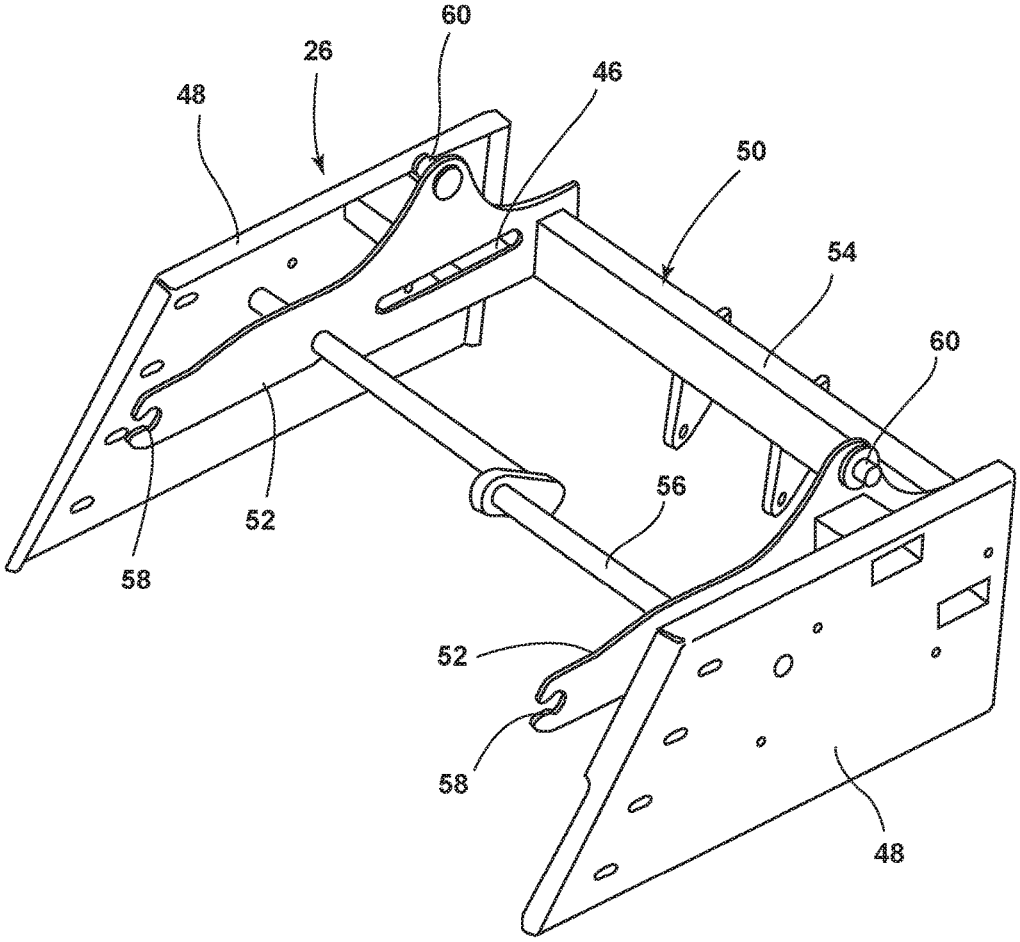
FIG. 14 is an enlarged perspective view of the chassis.

Referring to FIG. 14, chassis 26 includes pair of spaced apart side walls 48, which support a chassis frame 50 there between. Chassis frame 50 includes a pair of side frame members 52 and cross frame members 54 and 56, which together form the frame for mounting support surface 21 and for mounting a seat actuator (92) described more fully below. Member 52 includes a slotted opening 46 for receiving the pins on the upper ends 40*d* and 42*d* of X-frames 40 and 42. The distal end of the side frame members includes slotted openings 58 for receiving the pins of upper ends 40*c* and 42*c* of frames 40 and 42. Side walls 48 also provide a mounting surface for arm rests 34, which are mounted with respect to side walls 48 for linear movement, as will be more fully described below. Side members 52 further support pins 60 for pivotally mounting seat section 30 to chassis 26.

Figure 15:
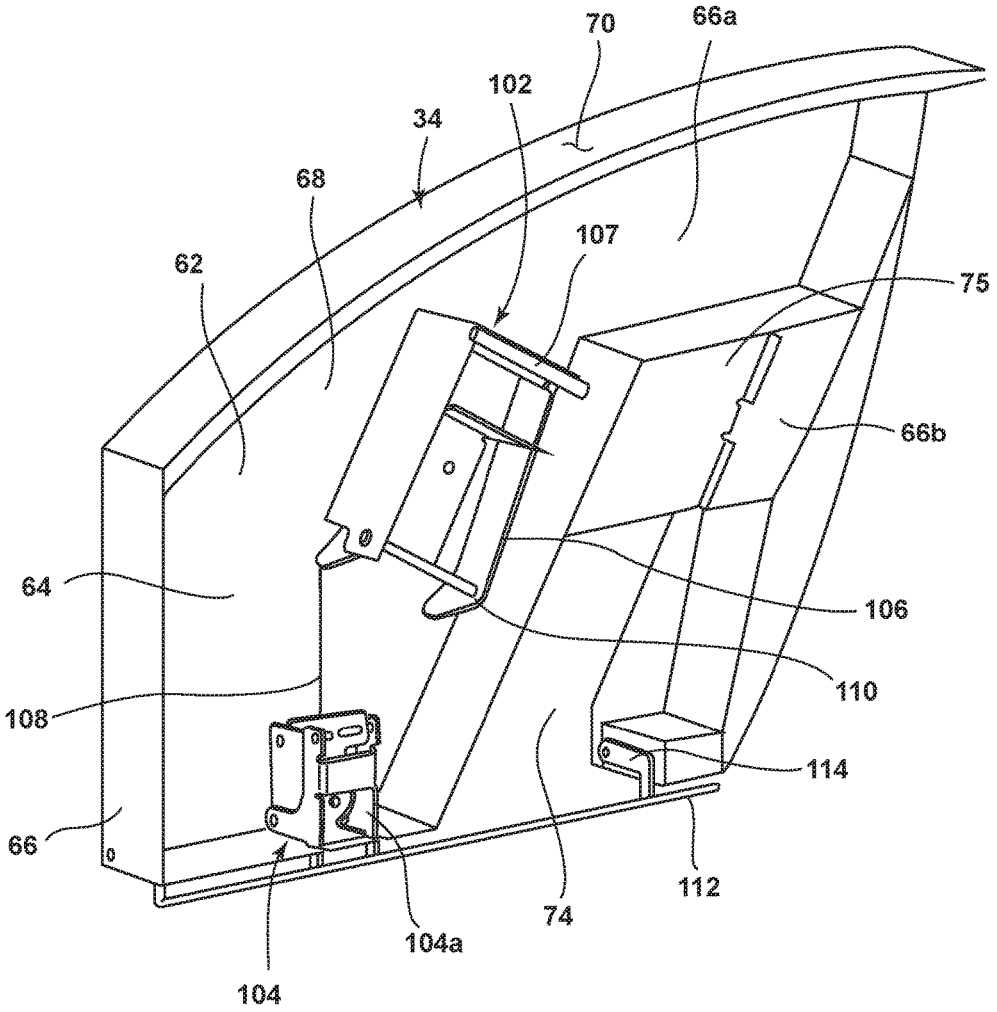
FIG. 15 is an enlarged perspective view of an arm rest illustrating a manual release mechanism and a safety release mechanism.

Referring to FIG. 15, arm rests 34 include an arm rest body 62 which is formed, for example, from a web of material, such as sheet metal, which includes a central web 64 and perimeter flange 66 which provides a reinforcement to web 64 and further forms a cavity 68 for housing a locking mechanism 104 for the arm rest. The cavity is enclosed by a cover, such as plastic shell, that mounts to body 62. Flange 66 also forms a mounting surface 70 for mounting an arm rest cushion 72. Web 64 additionally includes a slotted opening 74 extending up from the lower end of the arm rest body to receive an arm rest slide mount, more fully described in reference to FIG. 16. To reinforce web 64 along both sides of slotted opening 74, arm rest 34 also includes a pair of parallel spaced flanges 66*a* and 66*b*, with flange 66*a* providing a bearing surface for an arm rest slide mount 100.

Mounted in cavity 68 is a handle 102 and locking mechanism 104 for locking the position of the arm rest with respect to the arm rests slide mount. Handle 102 includes a rocker arm 106, which is pivotally mounted to flange 66*a* and also coupled to locking mechanism 104 by way of a cable 108. In this manner, when rocker arm 106 is pulled about its pivot axis 110 by pulling on an edge 107 (which is accessible at the side of the arm rest 34 as shown for example in FIGS. 1 and 3), rocker arm 106 will pull on cable 108 to release the locking mechanism.

In addition, as best seen in FIG. 15, locking mechanism 104 includes a rocker arm 104*a*, which supports a rod 112, and which is pivotally mounted by the rocker arm to locking mechanism adjacent one end and pivotally mounted at another portion (e.g. adjacent or near its opposed end) to flange 66*b* by a lever arm 114 so that when rod encounters an object with sufficient stiffness when arm rest is lowered, it will release the locking mechanism to prevent it from locking the arm rest in a lowered position. Optionally, rod may extend the full length of arm rest 34 to thereby provide a safety release for the locking mechanism.

Figure 16:
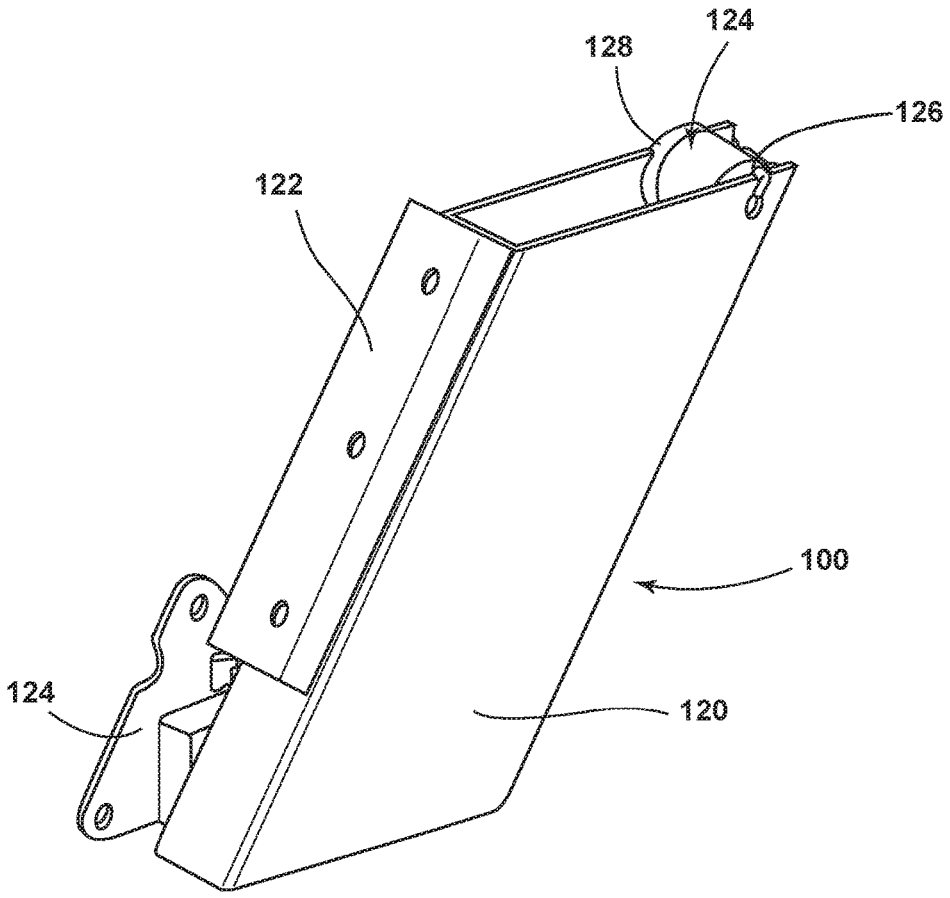
FIG. 16 is an enlarged perspective view of the arm rest slide mount.

Referring to FIG. 16, arm rest slide mount 100 includes a channel member 120 which supports a low friction pad 122 (e.g. made from plastic, such as high density polyethylene (HDPE) or the like) with a generally channel shape to provide a guide for arm rest 34 along mount 100. Optionally, flange 66*a* may support a rail on its inwardly facing surface that nests with the channel to facilitate the guiding of arm rest 34 from is lower position to its raised position. Channel member 120 includes a mounting flange 124 for mounting to chassis 26 and more specifically to chassis side wall 48. It should be understood that while one arm rest is illustrated and described, the same details may apply to the opposed arm rest. Mounted in channel 120 is a constant force spring 124. Constant force spring 124 includes a rolled ribbon of metal, typically spring steel, which is secured on one end to the arm rest body, e.g. flange 166*b*, and at its coiled upper end, as shown, in channel 120. Thus, the spring is relaxed when it is fully rolled up. As it is unrolled, a restoring force is generated from the portion of the ribbon near the roll (at the top of channel 120). Because the geometry of that region remains nearly constant as the spring unrolls, the resulting force is nearly constant. Thus when arm rest 34 is translated along mount 100, spring 124 will generate resistance to reduce the apparent weight of arm rest 34.

As best understood from FIG. 11, when arm rest 34 is mounted to arm rest mount 100 and is moved relative to arm mount 100, arm rest 34 moves forward (relative to the footprint of the chair) and upward relative to seat section 30. The upward position is not only higher (high enough for someone to reach the arm rest without bending over) but horizontally forward of the chair's original footprint so that the person can hold the arm rest earlier when approaching the chair or later when leaving the chair. Also, as noted above, having the arm rest move horizontally back when in its lowest position allows for better alignment with the patient's center of gravity when doing a lateral transfer.

In the illustrated embodiment, arm rests 34 are mounted to a linear slide to move in a linear path when moved from their lowered to raised positions, which is angled with respect to base 22. However, a linear slide is just one way to accomplish the final position. Other mechanisms that may be used to achieve this upward and forward motion include a 4-bar linkage, a scissor linkage, rack and pinion, gears, and cams or the like.

Figure 9:
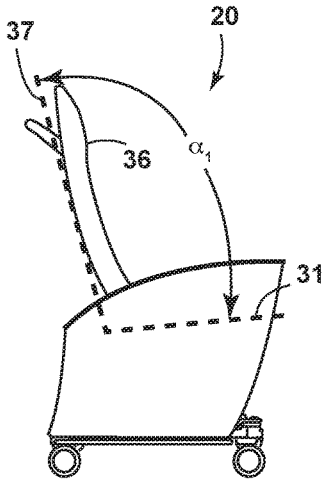
FIG. 9 is a side elevation view illustrating the recliner in a first one of a sequence of moves of a sit-to-stand function.

Referring to FIGS. 4, 5 and 9, when arm rest 34 is raised, and arm rest 34 moves forward and upward, it allows a patient to support themselves on the forward edge of the arm rest to facilitate their transition between a sitting and standing position. Furthermore, because of the curved shape of the arm rest cushion or pad 72, arm rest pad 72 provides support for a person when seated in chair 20 when in a seated configuration, and also provides similar support to the patient when the patient has been moved by the articulation of the seat to the chair's sit-to-stand position, the patient is closer to standing and therefore is helped by higher arm rests, again such as shown in FIG. 5.

Figure 9A:
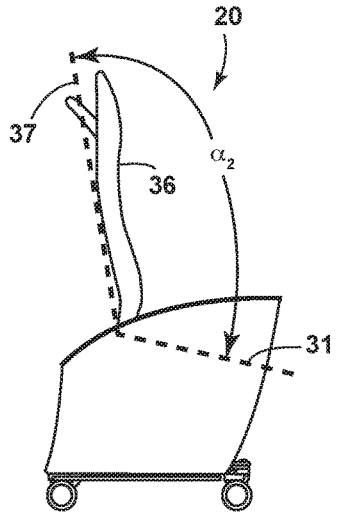
FIG. 9A is a side elevation view illustrating the recliner in an intermediate one of a sequence of moves of the sit-to-stand function.
Figure 9B:
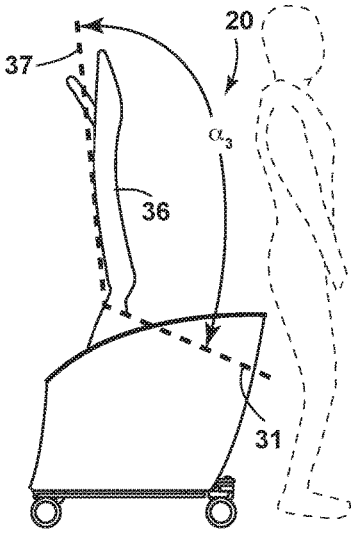
FIG. 9B is a side elevation view illustrating the recliner in a final one of a sequence of moves of the sit-to-stand function.

Referring specifically to FIGS. 9, 9A, and 9B, it can be seen that backrest 36 generally defines a backrest plane 37 and seat section 30 generally defines a seat section plane 31. Further, when support surface 21 is in the seated configuration (FIG. 9), seat plane 31 and backrest plane 37 are oriented with respect to each other at an angle $\alpha_1$. When a user transitions the chair from this seated configuration toward the sit-to-stand configuration (FIG. 9B), the angle alpha increases. In other words, as shown in FIG. 9A, the angle $\alpha_2$ is greater than the angle $\alpha_1$ (FIG. 9), and the angle $\alpha_3$ (FIG. 9B) is greater than the angle $\alpha_2$ (FIG. 9A). However, throughout this movement from the seated to the sit-to-stand configuration, backrest 36 remains generally vertically oriented (e.g. within about 10 degrees from vertical). This helps ensure that the occupant's shoulders are kept generally vertically aligned with his or her hips while transitioning from a seated position to a standing position, or vice versa. This shoulder to hip alignment helps prevent the occupant from feeling or becoming unbalanced during sit-to-stand movement or stand-to-sit movement.

With continued reference to FIGS. 9, 9A, and 9B, the angular increase in the angle alpha when the chair moves to the sit-to-stand configuration is primarily due to the tilting of seat frame 130. In addition to tilting the occupant forward when assisting him or her into the standing position, lifting mechanism 24 is adapted to raise the overall height of seat frame 130 in order to facility the occupant's transition to the standing position.

Figure 23A:
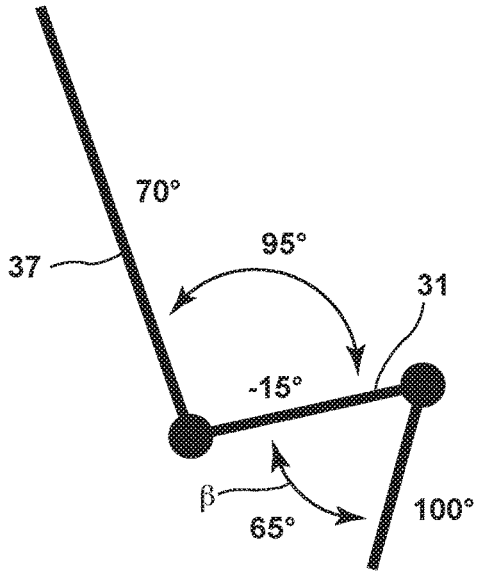
FIG. 23A is a schematic representation of the angles of the chair as shown in FIG. 23.
Figure 25A:
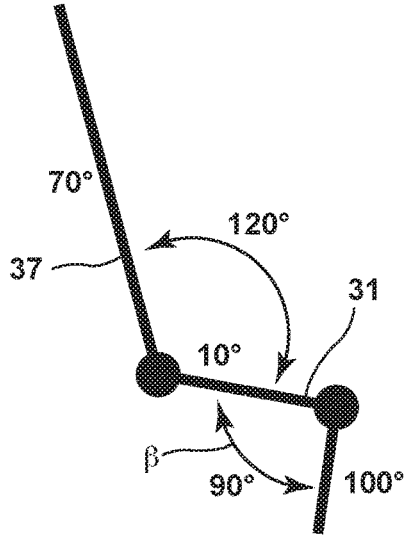
FIG. 25A is a schematic representation of the angles of the chair as shown in FIG. 25.

During the transition of seat section 30 from the sitting position to the standing position (illustrated in FIGS. 9, 9A, and 9B), seat section 30 forms an angle β with respect to the seat plane 31, as illustrated in FIGS. 23A and 25A. Further, when seat section 30 is in the sitting position (FIG. 23A), the angle β is smaller than what it is when the seat section 30 is in the standing position (FIG. 25A). In FIGS. 23A and 25A, the angle β changes from sixty-five degrees to ninety-degrees. This angular increase is carried out by leg rest actuator 90 under the control of controller 82. In one embodiment, controller 82 controls leg rest 32 during movement between the sitting and standing positions such that leg rest 32 maintains a substantially constant orientation with respect to the floor. By maintaining this orientation, leg rest 32 does not tilt inwardly into the space underneath seat section 30, thereby avoiding any potential mechanical interference between leg rest 32 and the components of chair 20 that are positioned underneath seat section 30.

During movement of seat frame 30 between the sitting and standing positions, controller 82 controls the movement of seat frame 30 and lift mechanism 24 such that a virtual pivot point is created at a location generally adjacent the front edge of seat frame 30 where the back of an occupant's knee would typically be located. This location of the virtual pivot point generally aligns the chair motion with the natural pivot point of the occupant and results in motion that essentially mimics the human body motion of standing up. Chair 20 therefore assists an occupant into a standing position in a manner that feels natural and comfortable to the user.

Figure 17:
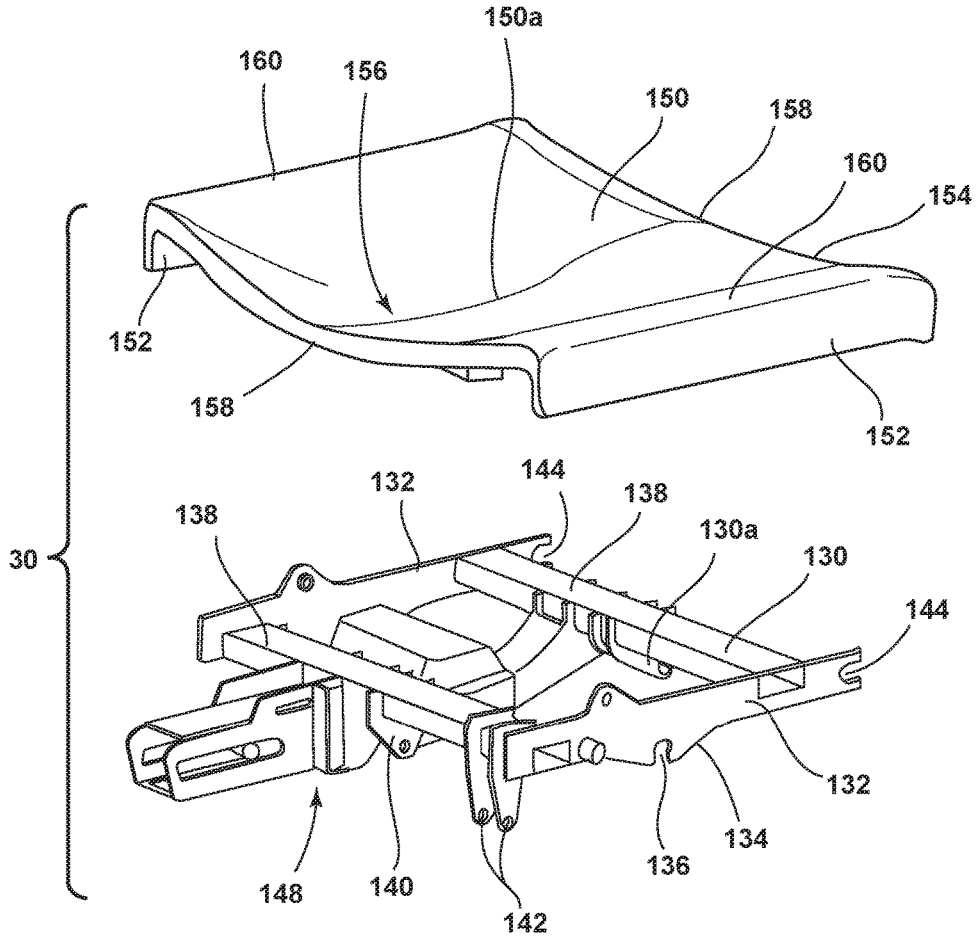
FIG. 17 is an exploded perspective view of the seat and seat frame.

Referring to FIG. 17, seat section 30 includes a seat frame 130. Frame 130 includes opposed side frame members 132 with downwardly depending flanges 134 with slotted openings 136 to provide a pivotal mount for seat frame 130 to chassis 26. As best understood from FIG. 11, seat frame 130 is mounted to chassis 26 by way of pivot pins 60, which are received in slotted openings 136, to thereby pivotally mount seat frame 130 to chassis 26. Seat frame 130 further includes cross members 138, which provide mounts for seat actuator 92 by way of bracket 140 and further provide mounts for the leg extension actuator 90. For example, seat frame 130 may include a pair of flanges 142 that form a bracket for mounting actuator 90, which is configured to extend and contract leg rest 32, described more fully below.

In addition, side frame numbers 132 include slotted openings 144 at their respective ends to receive pins 146 of leg rest 32 to thereby pivotally couple leg rest 32 to seat section 30. Additionally, seat frame 130 includes mounting structures 148 for providing a mount for backrest 36, more fully described below.

Mounted to seat frame 130 is a seat base 150, which may be formed from metal, plastic, wood shell, or the like, or a combination thereof. Base 150 forms a recess and a shelf adjacent the recess, which extends laterally under a person's thighs when seated on the seat section. Seat base 150 includes downwardly depending sides 152 which extend over frame 130 and further a forward downwardly depending flange 154, which extends over cross member 138. As best seen in FIG. 17, base 150 is contoured with a generally recessed central portion 156, as noted, which extends from the back edge 158 of base 150 and tapers upwardly to the shelf, which is also formed by rounded portion 158*a*. In this manner, opposed sides 160 of seat base 150 are raised relative to the central portion 156 but taper inwardly toward the central axis 150*a* of seat base 150 to form the central recessed region, as noted, for the pelvic area of the patient. Seat base 150 is covered by a cushioning layer, such as foam or a gel layer.

Backrest 36 is similar formed by a shell (not shown) which forms two forwardly projecting "wings" on either side of a central portion of the backrest shell. The shell is covered by a cushioning layer, such as foam, which is generally uniform in thickness except at the head end of the backrest where it is thickened to form a rounded head rest. Alternately, the cushioning layer may be formed form gel.

Suitable dry polymer gels or gelatinous elastomeric materials for forming the gel core may be formed by blending an A-B-A triblock copolymer with a plasticizer oil, such as mineral oil. The "A" component in the A-B-A triblock copolymer is a crystalline polymer like polystyrene and the "B" component is an elastomer polymer like poly(ethylene-propylene) to form a SEPS polymer, a poly (ethylene-butadyene) to form a SEBS polymer, or hydrogenated poly(isoprene+butadiene) to form a SEEPS polymer. For examples of suitable dry polymer gels or gelatinous elastomeric materials, the method of making the same, and various suitable configurations for the gel layer reference is made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,843,873; 6,865,759; 7,060,213; 6,413, 458; 7,730,566; 7,823,233; 7,827,636; 7,823,234; and 7,964,664, which are all incorporated herein by reference in their entireties. Other suitable configurations are described in copending application, entitled PATIENT SUPPORT, Ser. No. 61/697,010, filed Sep. 5, 2012 (STR03A P-405)), which has been refiled as U.S. non-provisional application Ser. No. 14/019,353, both of which are incorporated herein by reference in their entireties and are commonly owned by Stryker Corp. of Kalamazoo, Mich.

Other formulations of gels or gelatinous elastomeric materials may also be used in addition to those identified in these patents. As one example, the gelatinous elastomeric material may be formulated with a weight ratio of oil to polymer of approximately 3.1 to 1. The polymer may be Kraton 1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated with a weight ratio of oil to copolymers of approximately 2.6 to 1. The copolymers may be Septon 4055 and 4044 which are available from Kuraray America, Inc., which has a place of business in Houston, Tex., or it may be other copolymers. If Septon 4055 and 4044 are used, the weight ratio may be approximately 2.3 to 1 of Septon 4055 to Septon 4044. The oil may be mineral oil and one or more stabilizers may also be used. Additional ingredients—such as, but not limited to—dye may also be added. In addition to these two examples, as well as those disclosed in the aforementioned patents, still other formulations may be used.

Figure 18:
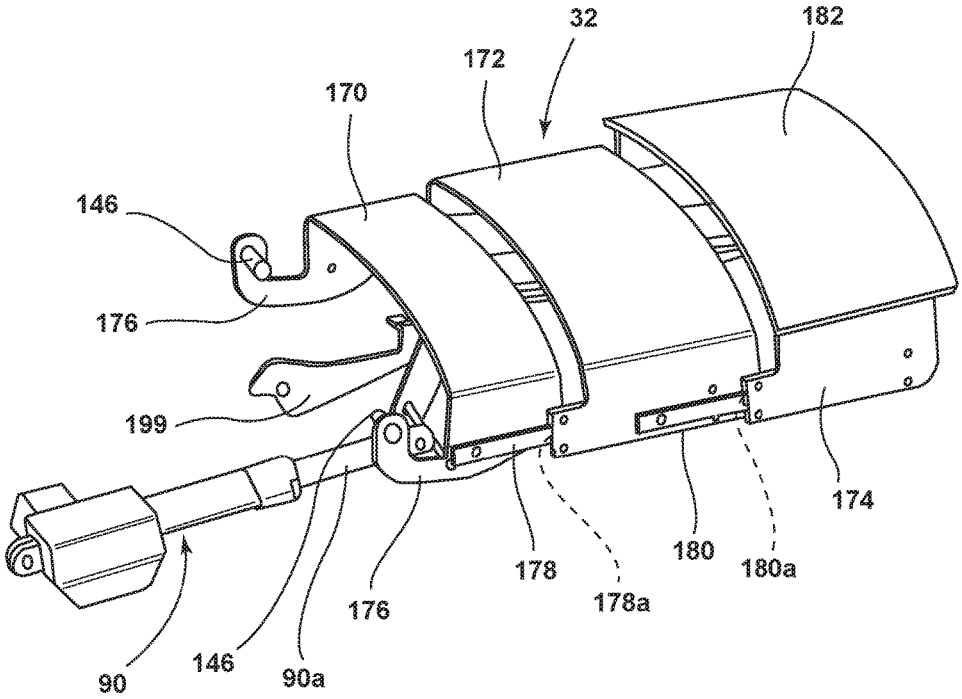
FIG. 18 is an enlarged perspective view of the leg rest shown in an extended position.
Figure 19:
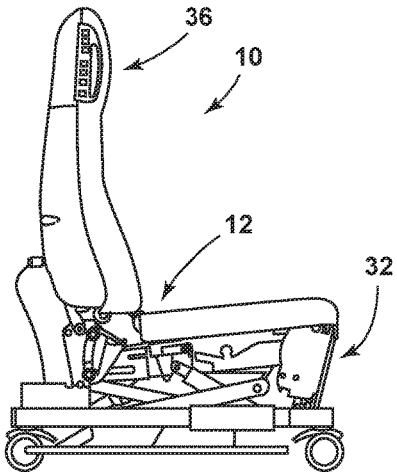
FIG. 19 is side elevation view illustrating the sequence of the extension of the leg rest.
Figure 20:
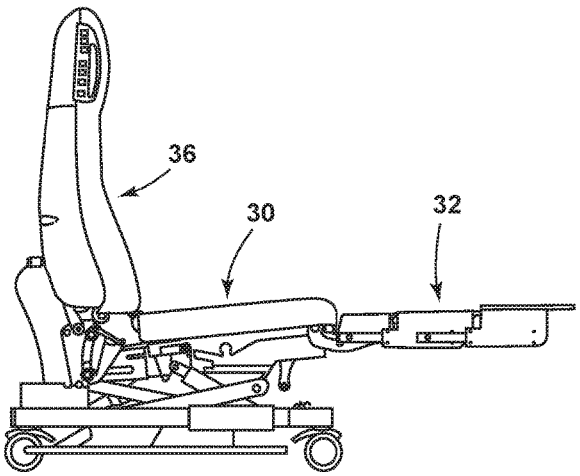
FIG. 20 is another side elevation view illustrating the sequence of the extension of the leg rest.

Referring to FIG. 18, as previously noted, apparatus 10 includes an extendable leg rest 32. The leg rest is formed by a plurality of nesting channel members 170, 172, and 174, with channel member 170 including rearwardly extending arms 176, which support pins 146 for pivotally coupling leg rest 32 to seat section 30. Channel members 172 and 174 are respectively mounted by rails 178 and 180, which extend in to corresponding channels 178*a* and 180*a* (see FIG. 21) provided or formed on the inwardly facing side of channel members 178 and 180. For example, channel 178*a* and 180*a* may be formed from low friction materials, such as plastic, including, for example, high density polyethylene (HDPE), to provide a sliding connection between the rails and the channels. In this manner, channels 170, 172 and 174 may be moved between a nested position, such as shown in FIG. 19, and a fully extended position such as shown in FIG. 20, by linear relative motion between the channel members. Additionally, outer most channel member 174 includes a cushion layer 182, such as foam, so that when the respective channel members are returned to their nested position, such as shown in FIGS. 1-19, cushion layer 182 will extend over the full width of the leg rest and further will continue to provide the same width of support even when in its fully extended position. In this manner, when a patient is seated on chair 20, the patient's feet can be supported by the same surface as the leg extension is moved between its retracted seated position and its fully extended position shown in FIG. 20.

Figure 21:
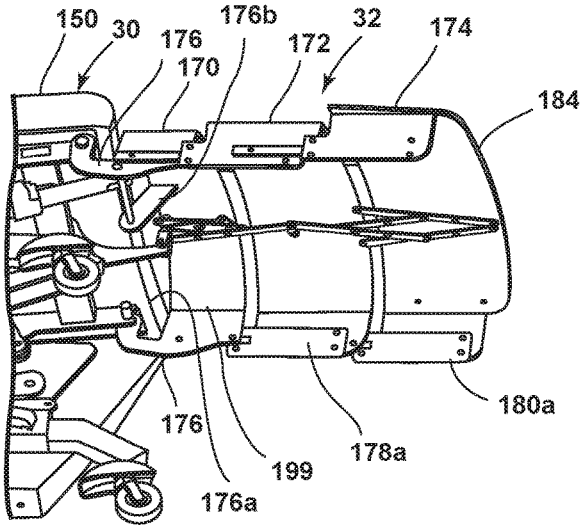
FIG. 21 is a bottom view of the foot section of the recliner in an extended configuration.
Figure 21A:
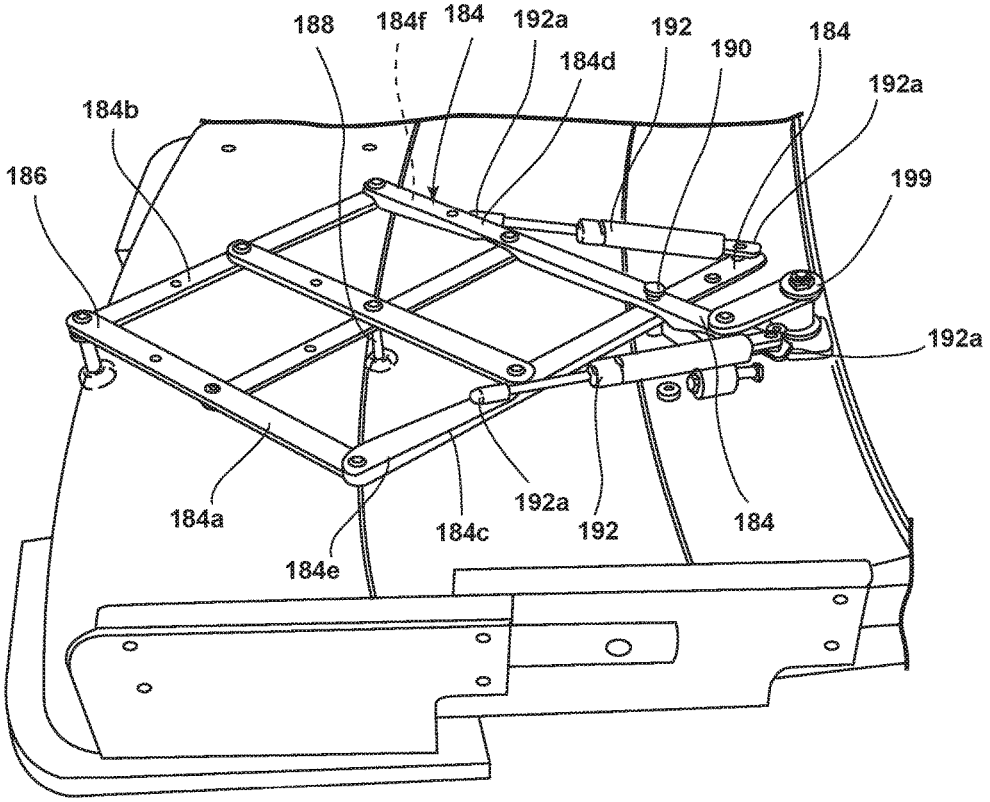
FIG. 21A is an enlarged perspective view of the scissor mechanism of the leg rest shown in an extended configuration.

Referring to FIG. 21, leg rest channel members 170, and 172, and 174 are moved from their nested seat position to their extended position by a scissor mechanism 184. Referring to FIG. 21A, scissor mechanism 184 is pinned on one end by a post 186 that mounts to the underside of outer most channel member 174. A medial portion of scissor mechanism 184 is pinned by a post 188 to the underside of intermediate channel member 172. Adjacent the opposed ends of scissor mechanism 184, scissor mechanism 184 includes a third post 190, which is secured to the inner most channel member 170. In this manner, when scissor mechanism 184 is compressed to the right as shown in FIG. 121, channel members 174, 172 and 170 will be pulled in to their nested configuration. Similarly, when the scissor mechanism 184 is extended, such as shown in FIG. 21A, the respective channel members are moved to their extended and outer most positions.

Figure 21B:
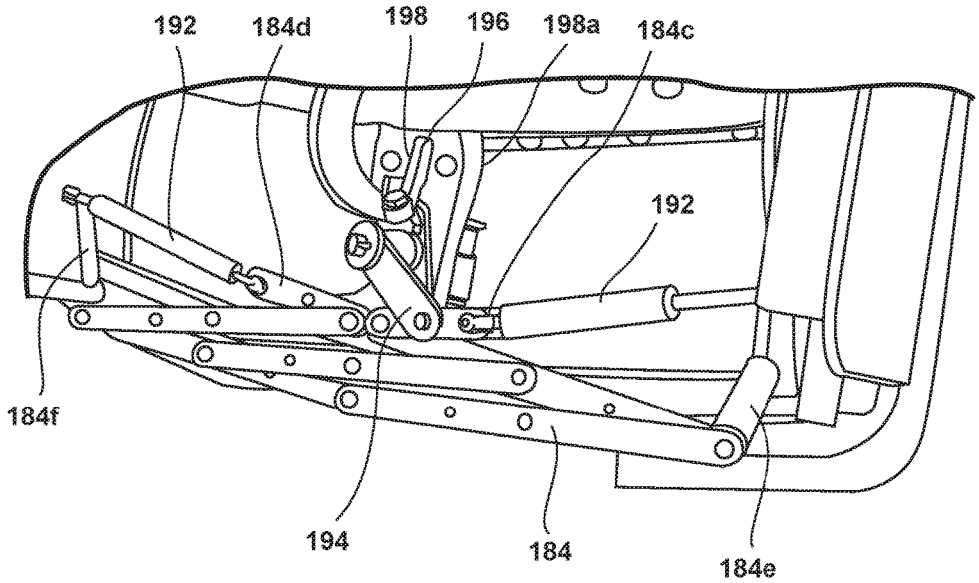
FIG. 21B is an enlarged perspective view of the scissor mechanism of the leg rest shown in a retracted configuration.
Figure 22:
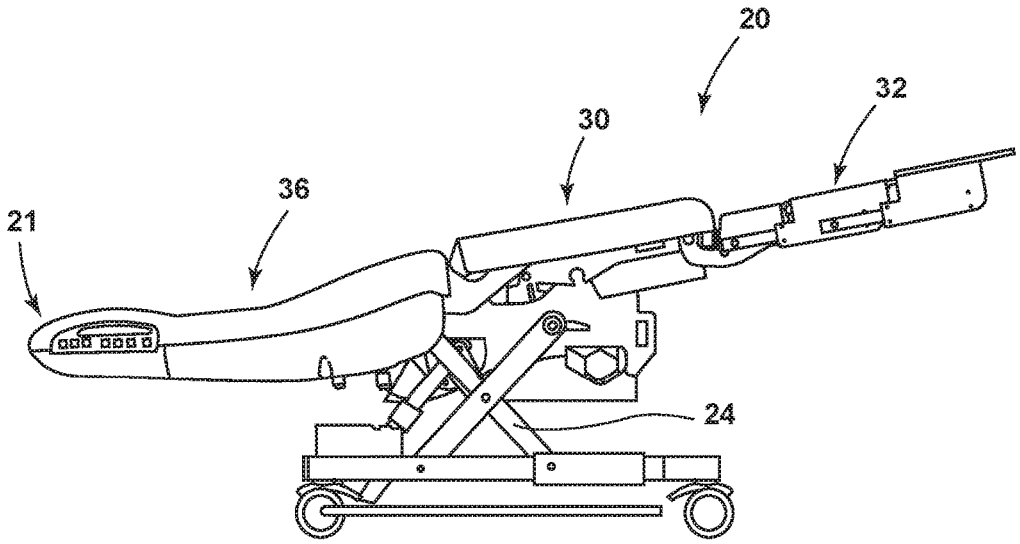
FIG. 22 is a side elevation view similar to FIG. 11 illustrating the support surface of the chair in a Trendelenburg position.

Referring to FIG. 21B, when scissor mechanism 184 is contracted, all of the nested channel members are pulled into their respective nested and overlapping configurations with channel member 174 extending straddling each of the intermediate and inner most channel members. As best seen in FIG. 21B, mounted to the inner end of scissor mechanism 184 is a link 194 which couples to a guide pin or post 196. Guide pin 196 is captured and guided along an elongated slotted opening 198 formed, for example, in a bracket 198*a*, which is mounted to the underside of inner most channel member 170. In this manner, when post 198 is pulled, scissor mechanism 184 will extend, such as shown in FIG. 21A, and when pushed to the position such as shown in FIG. 21B, scissor mechanism 184 will contract. As will be more fully described below, post 196 is pushed and pulled by a bracket 199.

Referring again to FIG. 21A, to facilitate expansion and contraction of scissor mechanism 184, scissor mechanism 184 may include a pair of gas cylinders 192 which are pinned at one end to the free ends of linkages of 184*c* and 184*d* and pinned at their opposed ends to guide linkages 184*e* and 184*f* mounted to linkages 184*c* and 184*d*. Gas cylinders 192 provide additional stiffness to the scissor mechanism 184 when moved from its contracted position, such as shown in FIG. 21B, to its fully extended position, such as shown in FIG. 21A.

As best seen in FIGS. 11 and 18, bracket or linkage 199 extends rearwardly of scissor mechanism 184 and is mounted to seat frame at bracket 130*a*, such as shown on FIG. 17. Referring again to FIG. 21, mounted between rearwardly depending arms 176 of channel member 170, is a transverse rod 176*a* to which actuator 90 is coupled. Transverse rod 176*a* is offset from the pivot connections formed by pins 146 with seat frame 130, so that when actuator 90 is extended or contracted, actuator 90 induces rotation of leg rest 32.

As best seen from FIG. 21, because the moveable end of scissor mechanism 184 is coupled to bracket 199, which is fixed to the seat frame, extension and contraction of actuator 90 will cause leg rest 152 to pivot about pivot pins 146 and further cause the respective channel members to translate with respect to each other. Thus, as pin 196 slides in the sliding joint formed by pin 196 and bracket 198, scissor mechanism 184 will extend or contract.

Figure 23:
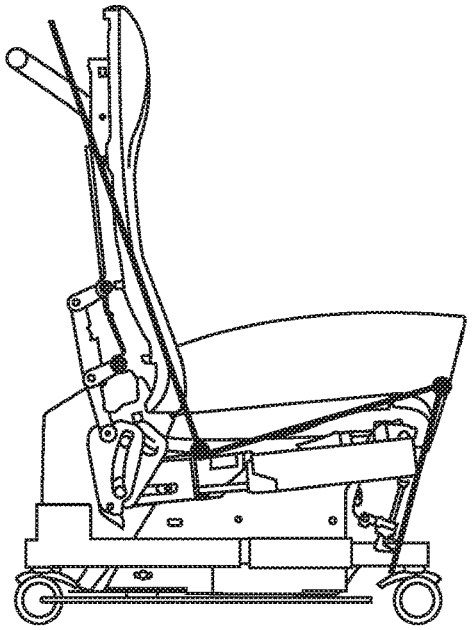
FIG. 23 is a side elevation view of a cross section through the recliner chair illustrating the upright position of the chair.
Figure 24A:
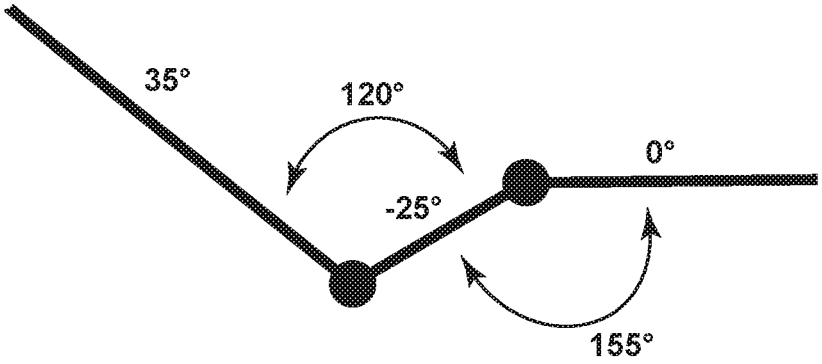
FIG. 24A is a schematic representation of the angles of the chair as shown in FIG. 24.
Figure 24:
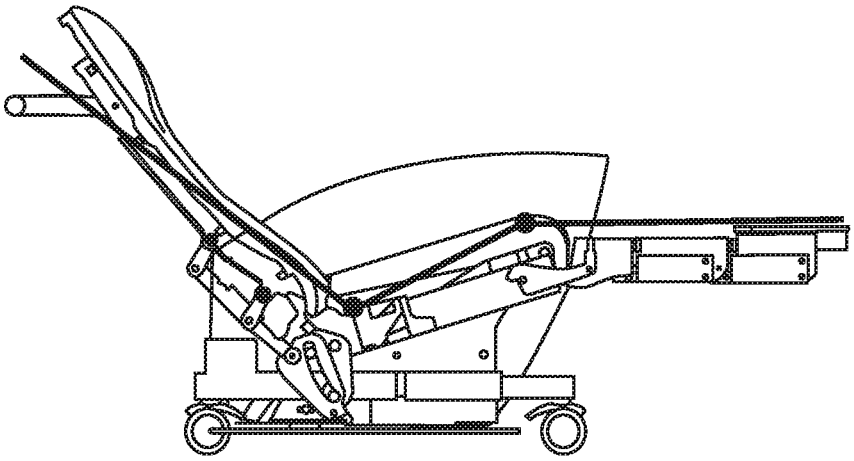
FIG. 24 is a cross section view to the chair illustrating the reclined position of the chair.
Figure 25:
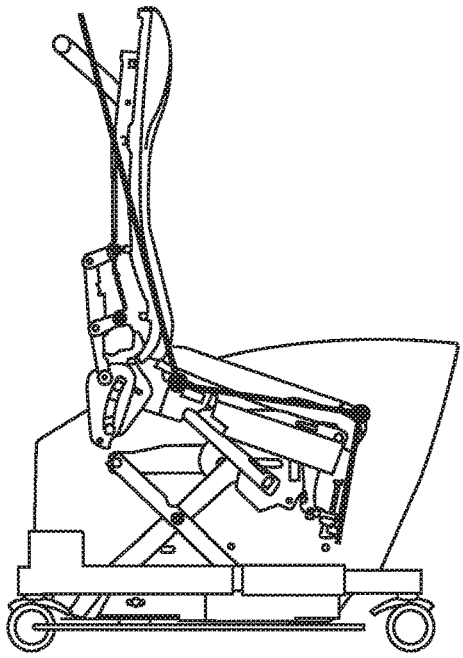
FIG. 25 is a cross section through the chair illustrating a sit-to-stand configuration.
Figure 26B:
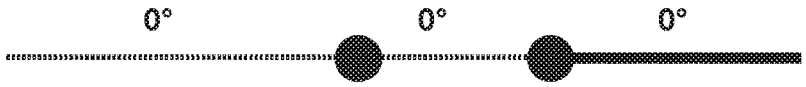
FIG. 26B is a schematic representation of the angles of the chair as shown in FIG. 26.
Figure 26A:
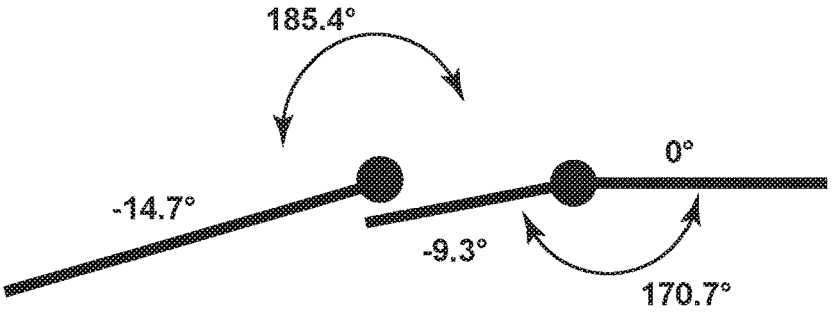
FIG. 26A is a schematic representation of the angles of the chair as shown in FIG. 26.
Figure 26:
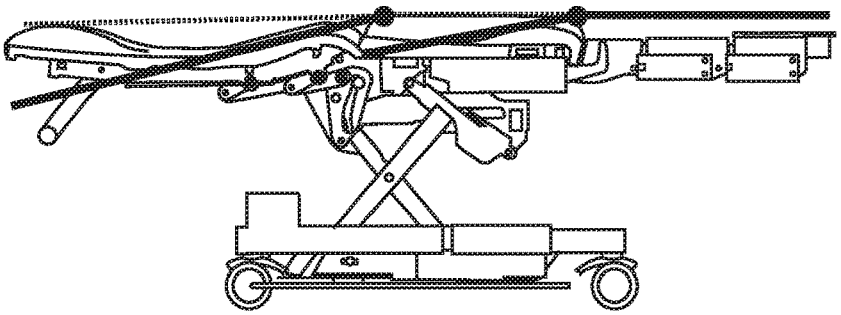
FIG. 26 is a cross section view of the chair illustrating the lateral transfer position of the chair.

Referring to FIGS. 22-27, as being more fully described below, various actuators and connections between the head section and the seat section and the seat section and the leg rest allow the support surface 21 to move from a generally upright seated position, such as shown in FIG. 23, to a reclined position such as shown in FIG. 24. Further, the support surface 21 is adapted to be reconfigured to a sit-to-stand configuration in which the seat, as described previously, is lifted and tilted forwardly to a standing position, such as shown in FIG. 25. The support surface is further configured and arranged to allow the support surface to move to a generally horizontal configuration, such as shown in FIG. 26, to thereby support a patient in a supine position. Additionally, the support surface is configured and arranged to assume a Trendelenburg position with the head section tilted downwardly while the leg rest is tilted upwardly. For example, in the seat configuration, the leg rest may be angled in a range of 95 to 100 degrees relative to the floor in which the apparatus is supported and optionally about 100 degrees, while the seat section may be tilted at an angle in a range of −20 to −10 relative to the floor. And, the backrest may be positioned at an angle in a range of 65 to 75 degrees including, for example, 70 degrees relative to the floor.

Referring to FIGS. 24 and 24A, when in the reclined position, the leg rest may be positioned generally parallel to the floor, while the seat section may be oriented with a −20 to −30 degree angle or optionally about −25 degree angle with respect to the floor, while the backrest may be oriented at an angle in a range of approximately 30 to 40 degrees, and optionally about 35 degrees.

Referring to FIGS. 25 and 25A, when the apparatus is in its standing configuration, the leg rest may be positioned in a range of about 95 to 105 degrees relative to the floor and optionally at an angle of about 100 relative to the floor, while the seat section may be angled at an angle 5 degrees to 15 degrees, and optionally at an angle of about 10 degrees relative to the floor. Further, the backrest may be angled with respect to the floor in a range of 65 to 75 degrees and optionally at an angle of about 70 degrees.

Referring to FIGS. 26A and 26B, the angle of the seat section may be generally horizontal while the angle of the seat section may be in a range of −14 to −5 and optionally at about −9 degrees or at about −9.3 degrees. In this configuration, the head section may be tilted backwards in a range of about −9 degrees to −19 degrees and optionally at about −14.7 degrees. As shown in FIG. 26, these angles are taken at the edge of the back and seat frames. When the angles are defined in the DIOV (seat edge plane & head/lumber plane, FIG. 26B), the angles of each section are approximately zero. In other words, the sections are generally horizontal.

Figure 27B:
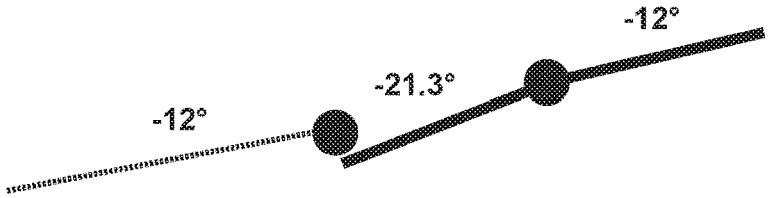
FIG. 27B is a schematic representation of the angles of the chair as shown in FIG. 27.
Figure 27A:
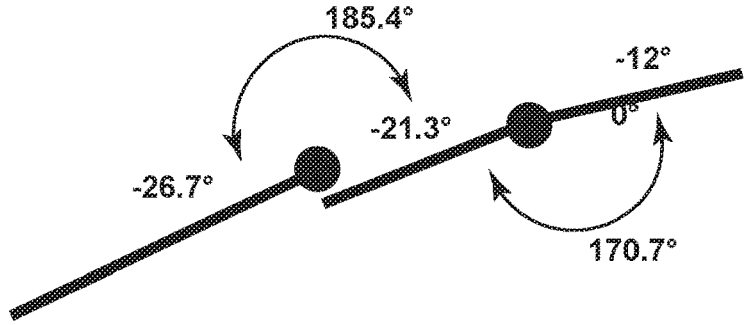
FIG. 27A is a schematic representation of the angles of the chair as shown in FIG. 27.
Figure 27:
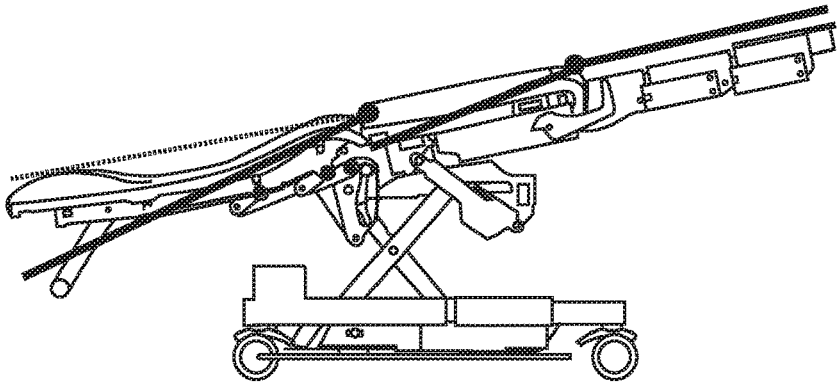
FIG. 27 is a cross section of the recliner chair of FIG. 1 illustrating the support surface of the recliner chair in a Trendelenburg position.

In a Trendelenburg position, as illustrated in FIG. 27A, the foot section may be moved to an angle in the range of −15 to −10 degrees or optionally −12 degrees from horizontal, while the seat section is moved to an angle in a range of −18 to −25 degrees and optionally about −21.3 degrees. Further, the head section may be angled at an angle in the range of −21 to −30 degrees and optionally about −26.7 degrees. When defined in DIOV, as illustrated in FIG. 27B, the angle includes the leg rest in a range of an angle from −9 to −15 degrees or approximately −12 degrees, with the seat section falling in a range of about −18 degrees to −25 degrees and optionally of about −21.3 degrees. However, in this configuration, the head section is angled in a range of about −9 to −15 degrees and optionally about −12 degrees. Note that all of these angles are in reference to the floor surface on which the apparatus is supported.

Patient support apparatus 10 includes a control system 78 (FIG. 28) that controls the electrical aspects of patient support apparatus 10. Control system 78 includes a controller 82 that is in communication with lift actuator 86, an exit detection system 96, a backrest actuator 88, right and left control panels 80, a leg rest actuator 90, a brake mechanism 308, a pendant 84, and seat actuator 92. Controller 82 is constructed of any electrical component, or group of electrical components, that are capable of carrying out the functions described herein. In many embodiments, controller 82 will be microprocessor based, although not all such embodiments need include a microprocessor. In general, controller 82 includes any one or more microprocessors, microcontrollers, field programmable gate arrays, systems on a chip, volatile or nonvolatile memory, discrete circuitry, and/or other hardware, software, or firmware that is capable of carrying out the functions described herein, as would be known to one of ordinary skill in the art. Such components can be physically configured in any suitable manner, such as by mounting them to one or more circuit boards, or arranging them in other manners, whether combined into a single unit or distributed across multiple units.

In one embodiment, controller 82 communicates with individual circuit boards contained within each control panel 80 using an I-squared-C communications protocol. It will be understood that, in alternative embodiments, controller 82 could use alternative communications protocols for communicating with control panels 80 and/or with the other components of control system 78. Such alternative communications protocols includes, but are not limited to, a Controller Area Network (CAN), a Local Interconnect Network (LIN), Firewire, or other serial communications.

Control system 78 may be configured to generate a built in deployment delay for the leg rest, which may be handled electronically. When the chair is in the upright position and a recline button (which may be provided on control panel 80 shown in FIGS. 6 and 7) is pressed, the leg rest will not start deploying immediately to allow the patient to adjust the backrest angle a few degrees for comfort purposes while still in an "upright" chair position. Therefore, the control system does not power the actuator that moves the leg rest until after the backrest is lowered to a preselected degree.

Figure 29:
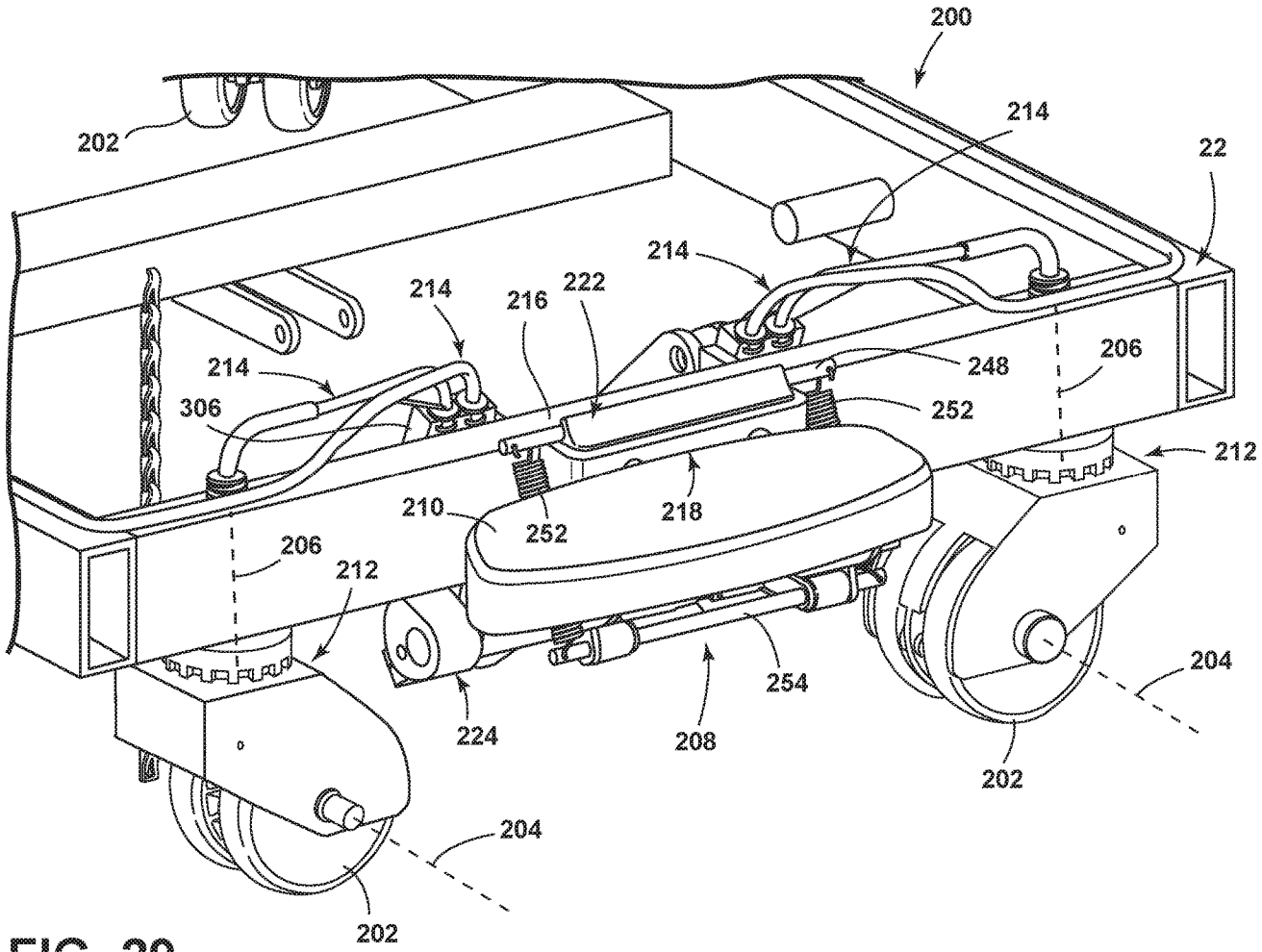
FIG. 29 is a partial, perspective view of a brake system according to one embodiment.

Control system 78 may also be configured to form an electric brake. Referring again to FIG. 11, base 22 includes a plurality of caster wheels 202 that are attached thereto (FIG. 29). Each wheel 202 is configured to be able to rotate about its generally horizontal wheel axis 204 (FIG. 29). Further, each wheel is configured to be able to swivel about a generally vertical swivel axis 206. A brake system 200 is provided with patient support apparatus 10 that, when actuated, prevents all four wheels 202 from both rotating about their respective horizontal wheel axes 204 and swiveling about their respective vertical swivel axes 206. Actuating brake system 200 therefore effectively immobilizes patient support apparatus 10 from movement across the floor in any direction.

As can be seen in FIG. 29, brake system 200 includes, in addition to wheel 202, a brake pedal assembly 208 having a brake pedal 210, a plurality of individual brake assemblies 212, and a plurality of mechanical cables 214 that each extend from brake pedal assembly 208 to one of the individual brake pedal assemblies 208. More specifically, patient support apparatus 10 includes four wheels 202, four individual brake assemblies 212, four mechanical cables 214, and one brake pedal assembly 208. Each mechanical cable 214 extends from brake pedal assembly 208 to one of the individual brake assemblies 212. Mechanical cables 214 may be Bowden cables, or any comparable types of cables that are capable of transferring the motion of brake pedal assembly 208 to each of the individual brake assemblies 212.

Brake pedal assembly 208 is positioned near the bottom of the rear side of patient support apparatus 10 where it does not interfere with the ingress and egress of a patient into and out of the patient support apparatus. More specifically, brake pedal assembly 208 is attached to a rear base bar 216 (FIG. 29) that is part of base 22. Brake pedal assembly 208 is configured such that, when a user pushes down on brake pedal 210, mechanical cables 214 are allowed to move toward their respective individual brake assemblies 212, which, as will be discussed in greater detail below, actuates both the braking of the wheels rotation and their swiveling. When brake pedal 210 returns upward to its unbraked position, brake assembly 208 is configured to pull on each of the mechanical cables 214—moving them away from their respective brake assemblies 212—which causes the wheels 202 to become unbraked and free to both rotate and swivel.

Brake pedal assembly 208 is configured such that, when a user pushes pedal 210 completely down to the brake position, it will automatically remain in this brake position until the user supplies additional downward force on pedal 210. When a user supplies the additional downward force, the brake pedal 210 will be released, thereby allowing it to return upward to its unbraked position. Brake pedal assembly 208 therefore automatically toggles brake pedal 210 between the braked (down) and unbraked (up) positions. Moving between these two positions is accomplished by the user applying a first downward force, and then applying a second downward force. The manner in which this function is achieved will now be described in more detail.

Figure 30:
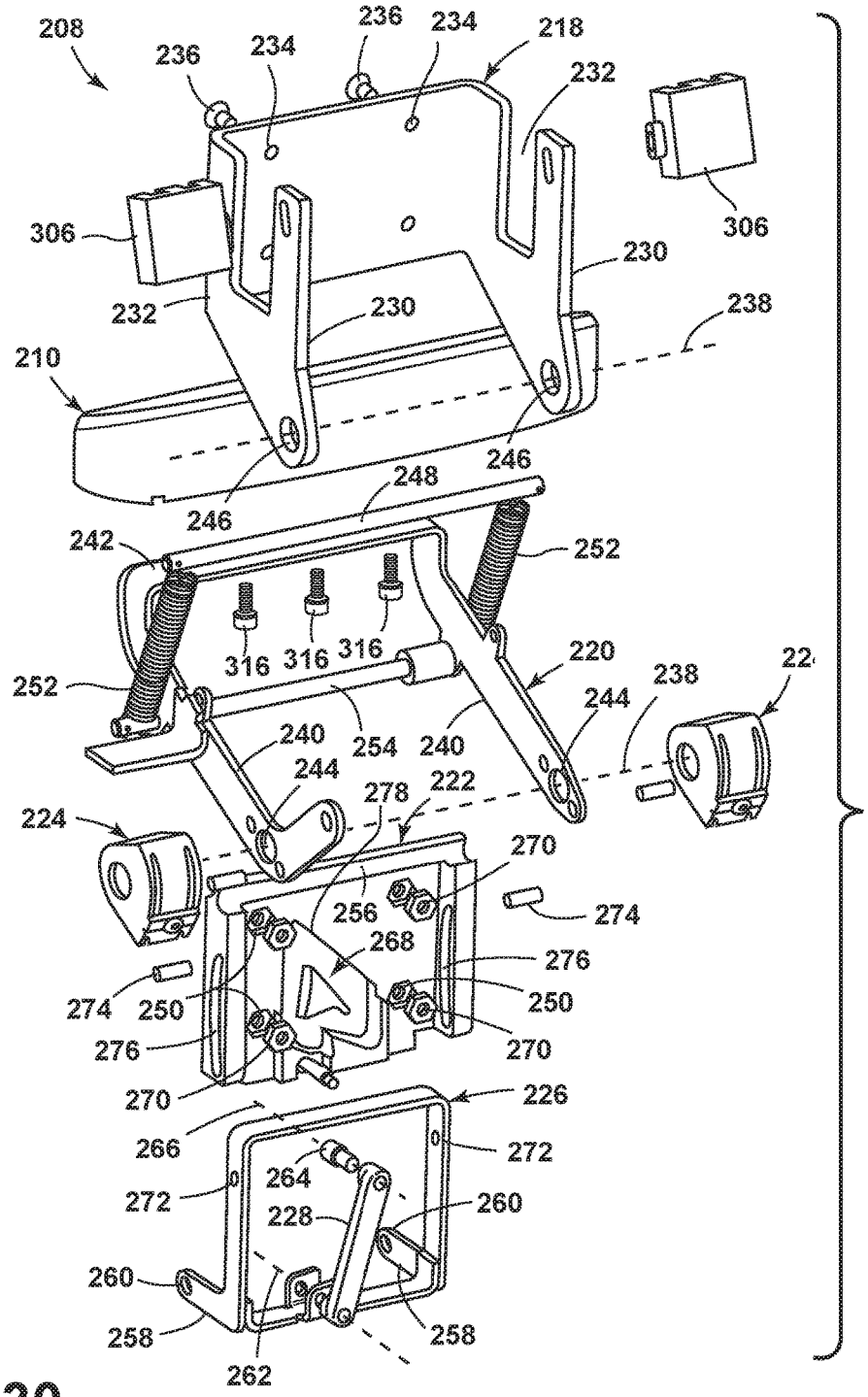
FIG. 30 is an exploded, perspective view of brake pedal assembly of the brake system.

As shown in more detail in FIG. 30, brake pedal assembly 208 includes a brake bracket 218, pedal 210, a pedal support 220, a toggle plate 222, a pair of cable attachments 224, and a toggle frame 226 having a pivotal toggle finger 228 coupled thereto. Brake bracket 218 includes a pair of flanges 230 that each have a cutout 232 defined therein. Cutout 232 is sized and positioned so as to receive, and fit around, rear base bar 216 of base 22 (FIG. 29). Brake bracket 218 further includes a plurality of apertures 234 into which respective fasteners 236 are inserted. In addition to passing through apertures 234, fasteners 236 are inserted into corresponding holes (not shown) in rear base bar 216 so that brake bracket 218 is immovably affixed to rear base bar 216. Still further, as will be described in greater detail below, fasteners 236 also fit into corresponding toggle plate apertures 250 defined in toggle plate 222 so that toggle plate 222 is rigidly attached to rear base bar 216 by way of fasteners 236, as well.

Pedal support 220 is pivotally coupled to brake bracket 218 (FIG. 30). Pedal support 220 includes a pair of spaced apart pedal support arms 240 that are connected together by a pedal support body 242. Brake pedal 210 fits over pedal support body 242 and is supported by pedal support body 242. Brake pedal 210 may be secured to pedal support 220 in any conventional manner, such as by the use of fasteners 316. Pedal support 220 is pivotally coupled to brake bracket 218 such that it is able to pivot about a generally horizontal pedal pivot axis 238. Each pedal arm 240 includes a pivot aperture 244 defined therein that aligns with a corresponding bracket aperture 246 defined in bracket 218. Pedal arms 240 are pivotally coupled to bracket 218 by way of pins (not shown), or other suitable attachment structures, that fit into both pivot apertures 244 and bracket apertures 246.

An upper horizontal bar 248 is coupled to respective top ends of a pair of pedal springs 252 (FIG. 30). The bottom end of each pedal spring 252 is coupled to a lower horizontal bar 254 that is oriented generally parallel to upper horizontal bar 248. Lower horizontal bar 254 is coupled near each of its ends to each of the pedal support arms 240. Upper horizontal bar 248 is rigidly seated in a bar channel 256 defined in a top edge of toggle plate 222. Because toggle plate 222 is rigidly mounted to rear base bar 216 of base 22, and upper horizontal bar 248 is rigidly seated in bar channel 256 of toggle plate 222, horizontal bar 248 does not move as brake pedal 210 pivots between the braked and unbraked position. However, because lower horizontal bar 254 is coupled to pedal support arms 240, which do pivot as brake pedal is pivoted between the braked and unbraked positions, lower horizontal bar 254 will move as the pedal 210 moves. That is, lower horizontal bar 254 will move further away from upper horizontal bar 248 when brake pedal 210 is pushed down to the braked position, and will move close toward upper horizontal bar 248 when brake pedal 210 is released to the unbraked position.

Pedal springs 252 are adapted to urge lower horizontal bar 254 upwards. Because lower horizontal bar 254 is also coupled to a bottom portion of toggle frame 226, pedal springs 252 will urge toggle frame 226 (and toggle finger 228) upwards. This upward force is greater when pedal 210 is in the braked positioned (down) than when pedal 210 is in the unbraked (up) position.

Turning to toggle frame 226, it can be seen that toggle frame 226 includes a pair of spaced apart lower arms 258 that are generally parallel to each other and that extend away from the body of toggle frame 226. Each lower arm 258 includes an arm aperture 260 defined adjacent its distal end. Arm apertures 260 are dimensioned to receive lower horizontal bar 254 of pedal support 220. As lower horizontal bar 254 moves up and down in conjunction with the upward and downward movement of brake pedal 210, so too will toggle frame 226 (because of the connection of lower horizontal bar 254 through arm apertures 260.

Toggle finger 228 of toggle frame 226 is pivotally coupled to toggle frame 226 such that toggle finger 228 is able to pivot about a toggle finger pivot axis 262. The end of toggle finger 228 opposite its pivotal connection to toggle frame 226 is coupled to a roller 264. Roller 264 is secured to toggle finger 228 in a manner that allows it to rotate about a rotational axis 266 that is generally parallel to toggle finger pivot axis 262, and generally orthogonal to the plane defined by toggle plate 222. Roller 264 is positioned to roll within a looped channel 268 defined in toggle plate 222. The interaction of roller 264 within looped channel 268 is what holds brake assembly 212 in the respective braked and unbraked positions, and allows brake pedal 210 to move between these two positions in response to a downward force applied thereon. The manner of this interaction is described in more detail below.

As was noted above, toggle plate 222 is fixedly secured to brake bracket 218 by way of fasteners 236, which also fixedly secure both toggle plate 222 and brake bracket 218 to rear base bar 216 of base 22. More specifically, brake bracket 218 is sandwiched between rear base bar 216 and toggle plate 222. Fasteners 236 may be any suitable fasteners. In the embodiment shown, fasteners 236 have threaded ends to which threaded nuts 270 are attached after the body of fasteners 236 have been inserted through apertures 234 and 250, and corresponding apertures (not shown) in rear base bar 216 (FIG. 30).

Figure 31:
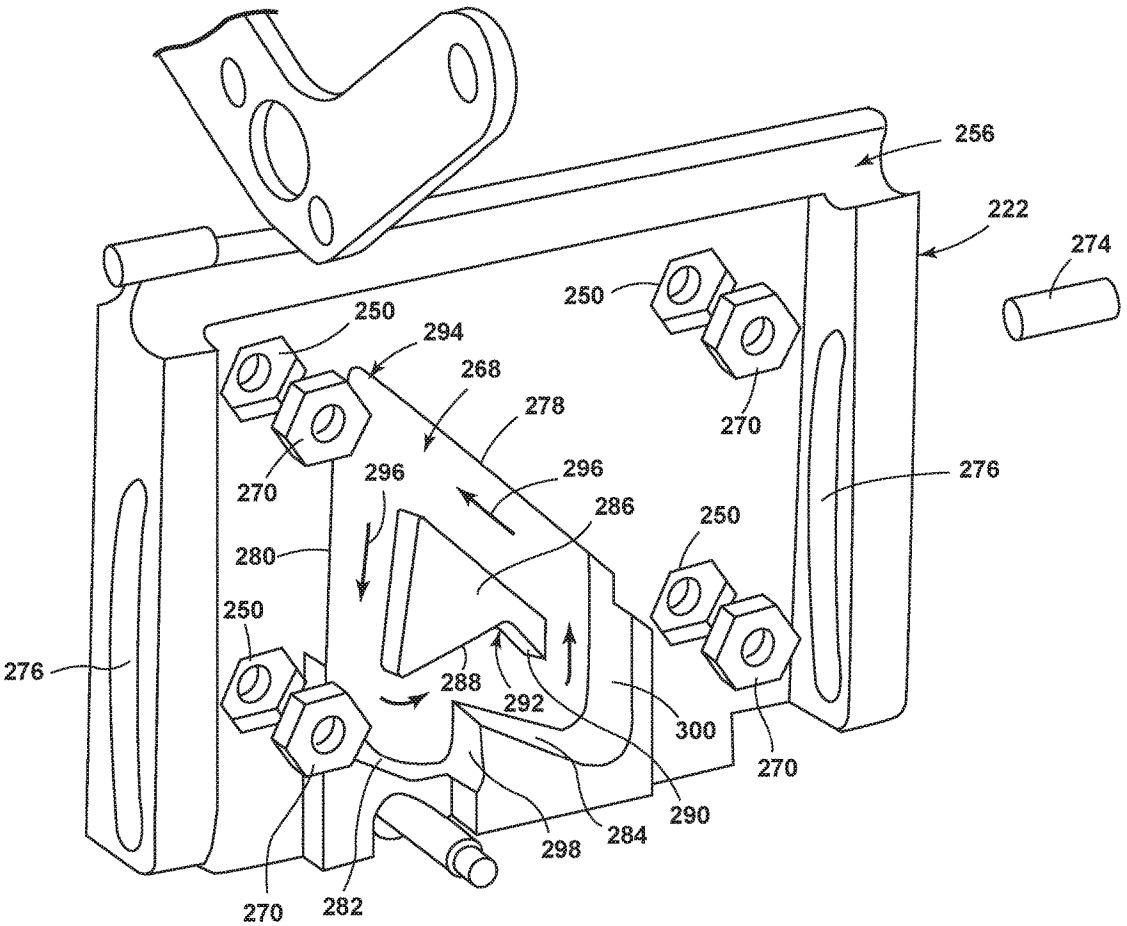
FIG. 31 is a close up perspective view of a toggle plate of the brake assembly.

Toggle frame 226 further includes a pair of upper apertures 272 defined in its respective side members. Upper apertures 272 each receive a guide pin 274. Each guide pin 274 is positioned to ride within a corresponding guide channel 276 defined in toggle plate 222 (FIG. 31). The riding of guide pins 274 within guide channel 276 maintains the close relationship between toggle frame 226 and toggle plate 222 as the brake pedal 210 moves between the up and down position. This close relationship ensures that toggle roller 264 attached to toggle finger 228 remains in looped channel 268 of toggle plate 222 at all times throughout the up and down motion of the brake pedal 210.

As was noted earlier, the interaction of roller 264 of toggle finger 228 within looped channel 268 ensures that brake pedal 210 remains in either the up or down position, and can be moved between these two positions by a user exerting a downward force on the brake pedal. The manner in which toggle finger 228, roller 264, and channel 268 accomplish this will now be described with respect to FIG. 31. As can be seen in FIG. 31, looped channel 268 includes a sloped top wall 278, a left side wall 280, a sloped bottom wall 282, and a right sloped bottom wall 284. Looped channel 268 further includes a center projection 286 that defines a center left sloped wall 288 and a center right sloped wall 290. The junction of center left sloped wall 288 and center right sloped wall 290 defines a brake seat 292 where roller 264 is seated when brake pedal 210 is in the braked position (see FIG. 33). The junction of sloped top wall 278 and left sidewall 290 defines an unbraked seat 294 where roller 264 is seated when brake pedal 210 is in the unbraked position (see FIG. 32).

During movement of brake pedal 210 between the braked and unbraked positions, roller 264 moves within looped channel 268 in a direction defined by arrows 296. Thus, as can be seen in FIG. 31, roller 264 moves in a counterclockwise direction as brake pedal 210 moves between the braked and unbraked position. More specifically, roller 264 will make one complete circuit around looped channel 268 whenever brake pedal 210 moves from its initial position (braked or unbraked) to its other position and then returns back to its initial position.

The movement of roller 264 around looped channel 268 is guided by the various walls defining looped channel 268. This can be better understood by describing the movement of roller 264 from an initial position, say, the unbraked position, to the braked position, and back, which will now be done. When brake pedal 210 is in the unbraked position (up), roller 264 is seated in unbraked seat 294. Roller 264 remains in unbraked seat 294 because pedal springs 252 urge toggle frame 226 upwardly, which in turn urges toggle finger 228 and roller 264 upwardly. This upward urging force on roller 264 causes it to remain seated in unbraked seat 294 in the absence of any external forces applied by a user. In other words, left side wall 280 prevents roller 264 from moving leftward (as viewed in FIG. 31), and sloped top wall 278 prevents roller 264 from moving rightward because any such rightward movement would—due to the sloped nature of wall 278—urge roller 264 downward, which, in the absence of external user applied forces, is prevent by springs 252.

When a user presses on brake pedal 210 and brake pedal 210 is initially in the unbraked position, brake pedal 210 moves downward which, due to the corresponding movement of toggle frame 226 and toggle finger 228, causes roller 264 to move downward (in FIG. 31). Because there are no lateral forces acting on roller 264, roller 264 moves downward with little or no lateral movement. This downward movement continues until roller 264 reaches left sloped bottom wall 282. Because of the sloped configuration of left bottom wall 282, wall 282 will urge roller 264 rightwards (in FIG. 31) as roller 264 continues its downward journey. This rightward movement will continue until roller 264 reaches the lowermost point of left sloped bottom wall 282, at which point any further rightward movement of roller 264 will be prevented by a stop wall 298 positioned between left sloped bottom wall 282 and right sloped bottom wall 284. At the time roller 264 reaches this trough, brake pedal 210 will have reached the lowermost point in its downward movement.

When roller 264 is positioned at the lower most portion of left sloped bottom wall 282 (i.e. adjacent stop wall 298—see FIG. 31), roller 264 will remain in this position for so long as the user continues to maintain a sufficient downward force on brake pedal 210. When the user releases this downward force, roller 264 will be free to move upward (due to the urging of pedal springs 252). This upward movement will continue with little or no lateral movement until roller 264 comes into contact with left central sloped wall 288. When contact is made between roller 264 and left central sloped wall, any further upward movement of roller 264 will cause roller 264 to also move laterally to the right (from the viewpoint of FIG. 31). This is because of the angular nature of sloped wall 288. This rightward movement will continue until roller 264 encounters right middle sloped wall 290, which is downwardly sloped, and acts as a stop on further rightward movement of roller 264 (when the user has released pedal 210). Therefore, when roller 264 reaches the junction between left and right central sloped walls 288 and 290, roller 264 will be held in this position by the upward urging of springs 252. And, as noted, this position defined the brake seat 292. Pressing down on brake pedal 210 will therefore move pedal 210 downward and automatically hold the brake pedal 210 in the downward position when the user releases pedal 210. The brakes will therefore remain on.

When a user wishes to release the brakes from the braked position, the user simply pushes downwardly again on brake pedal 210. This causes roller 264 to move downward out of the brake seat 292 position. This downward movement will continue with little or no lateral movement (as viewed in FIG. 31) until roller 264 comes into contact with right sloped bottom wall 284. When contact is made with right sloped bottom wall 284, the angular nature of bottom wall 284 will impart a rightward force on roller 264. This rightward and downward movement of roller 264 will continue until roller 264 reaches the trough defined at the junction of right sloped bottom wall 284 and a right side wall 300. Further downward movement of the brake pedal 210 at this point is no longer possible, and in order for the user to complete the releasing of the brakes, the user must then release his or her downward force on brake pedal 210.

When the user releases his or her downward force on brake pedal 210, roller 264 will move upward from the trough position defined at the junction of right side wall 300 and right sloped bottom wall 284, due to the upward urging of pedal springs 252. This upward movement of roller 264 will continue with little or no lateral movement (as viewed in FIG. 31) until roller 264 contacts sloped top wall 278. At that point, the upward movement of roller 264 will include a lateral movement component as well, due to the sloped nature of wall 278. This lateral component will be generally leftward (as viewed in FIG. 31). This upward and lateral movement of roller 264 will continue until roller 264 returns to the unbraked seat 294 defined at the junction of sloped top wall 278 and left side wall 280. When roller 264 reaches this seat, brake pedal 210 will have reached its uppermost position, and roller 264 will remain in this unbraked seat position until the user decides to press down on the pedal again. When the user presses downward again, roller 264 will move in the direction already described and eventually complete another circuit around looped channel 268.

As was described above, the upward and downward movement of brake pedal 210 causes pedal support arms 240 to also pivot upwardly and downwardly. This upward and downward movement of support arms 240 causes changes in the tension applied to mechanical cables 214 in a manner that will now be described. As can be seen in FIG. 30, each cable attachment 224 is coupled to one of the two support arms 240. The upward and downward pivoting of support arms 240 therefore causes the cable attachments 224 to pivot upwardly and downwardly. As can be seen more clearly in FIGS. 32 and 33, each mechanical cable 214 is made up of an inner cable 302 that is slidably contained within an outer sleeve 304. The inner cables 302 of two of the mechanical cables 214 are attached to a first one of cable attachments 224, and the inner cables 302 of the other two mechanical cables 214 are attached to the second one of cable attachments 224. Consequently, the upward and downward movement of cable attachments 224 will cause the inner cables 302 to slide within their outer sleeves 304 (one end of each of the sleeves is fixedly attached to a cable housing 306 that does not move).

Pressing down on the brake pedal 210 to move it to the braked position causes the distance between cable attachments 224 and the cable housings 306 to decrease, thereby allowing the inner cables 302 to slide toward their respective individual brake assemblies 212. Releasing the brake pedal 210 causes the distance between the cable attachments 224 and the cable housing 306 to increase, thereby exerting a pulling force on inner cables 302 that pulls the inner cables 302 away from their respective individual brake assemblies 212. The manner in which this movement of the inner cables 302 causes the individual brake assemblies to actuate and deactuate the brakes will be described in more detail below.

In addition to being able to actuate and deactuate the brakes of patient support apparatus 10 by manually pushing downward on pedal 210, patient support apparatus 10 is also equipped, in at least some embodiments, with an electrical brake. The electrical brake is actuate by way of a user interface, such as a brake button 94 positioned on each of the control panels 80. In the illustrated embodiment, there are two such control panels 80, one on each side of the backrest 36. Pressing the brake button 94 once changes the brake system 200 from its current status (braked or unbraked) to its opposite status. Pressing brake button 94 again changes status of brake system 200 again. The brake button therefore acts as an electronic toggle that, upon repeated pressing, repeatedly switches the brake system 200 between being on and off.

Figure 28:
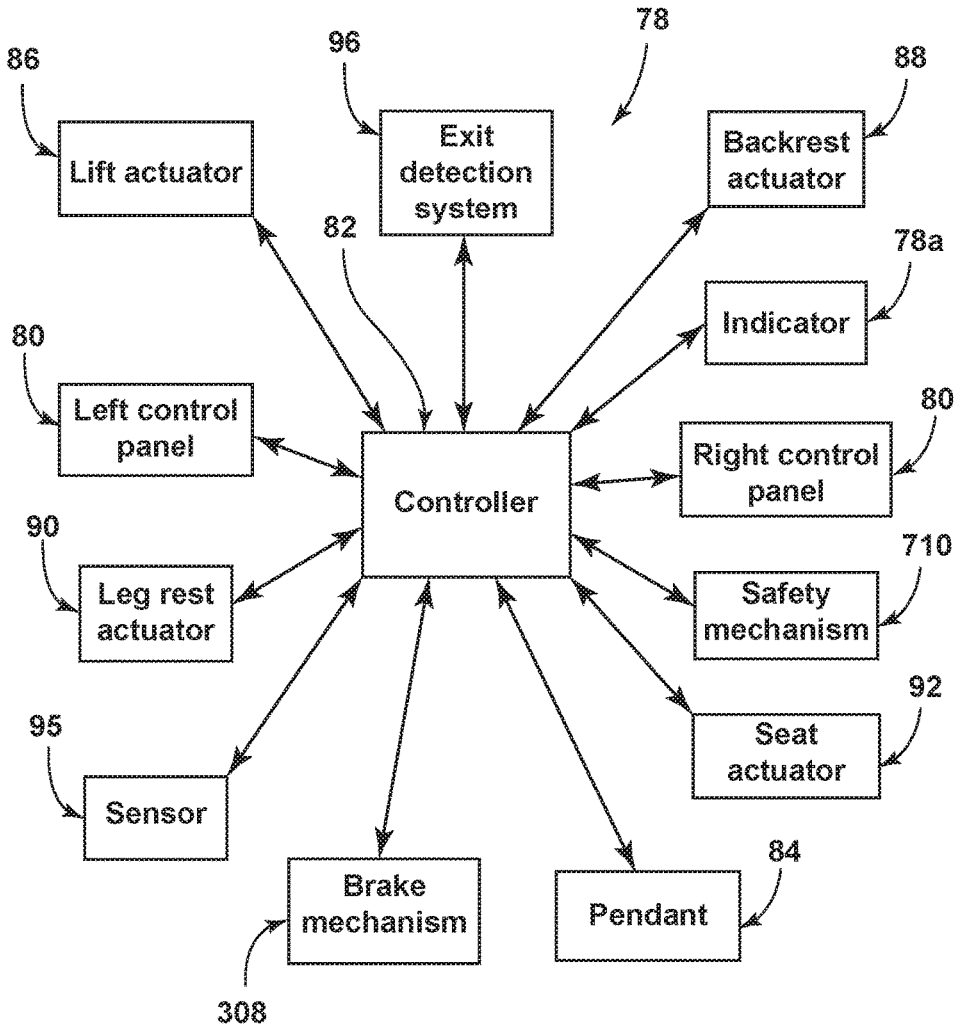
FIG. 28 is a diagram of a control system for the chair.

Each brake button 94 is in electrical communication with controller 82 (FIG. 28). Further, controller 82 is in electrical communication with a brake mechanism 308, such a solenoid or an actuator, including a center-lock actuator (see FIG. 28A). When controller 82 detects that either of brake buttons 94 have been pressed, it changes the state of brake mechanism 308, which in turn causes the brake system 200 to change its state.

Figure 32:
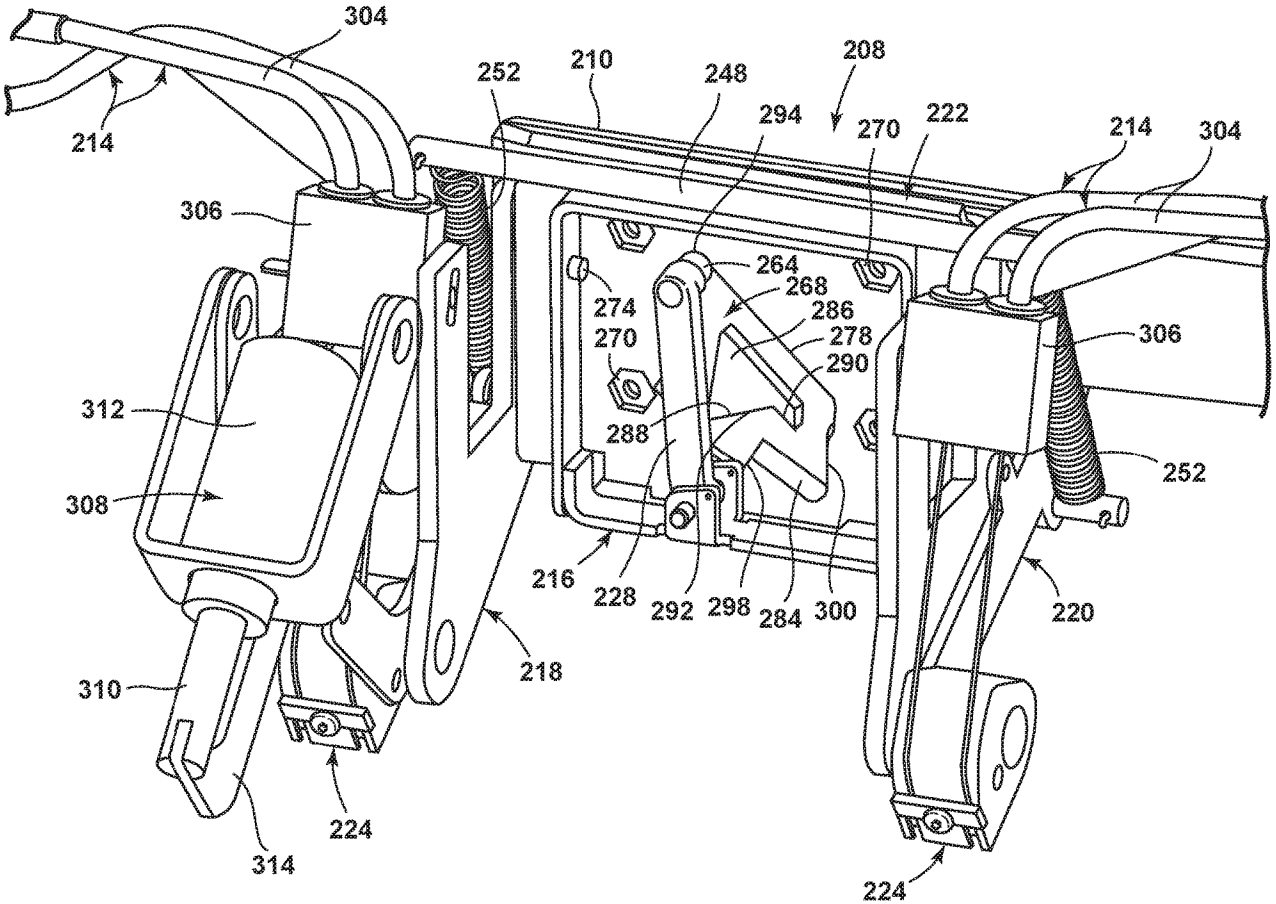
FIG. 32 is a rear, perspective view of the brake pedal assembly shown in an unbraked position.
Figure 33:
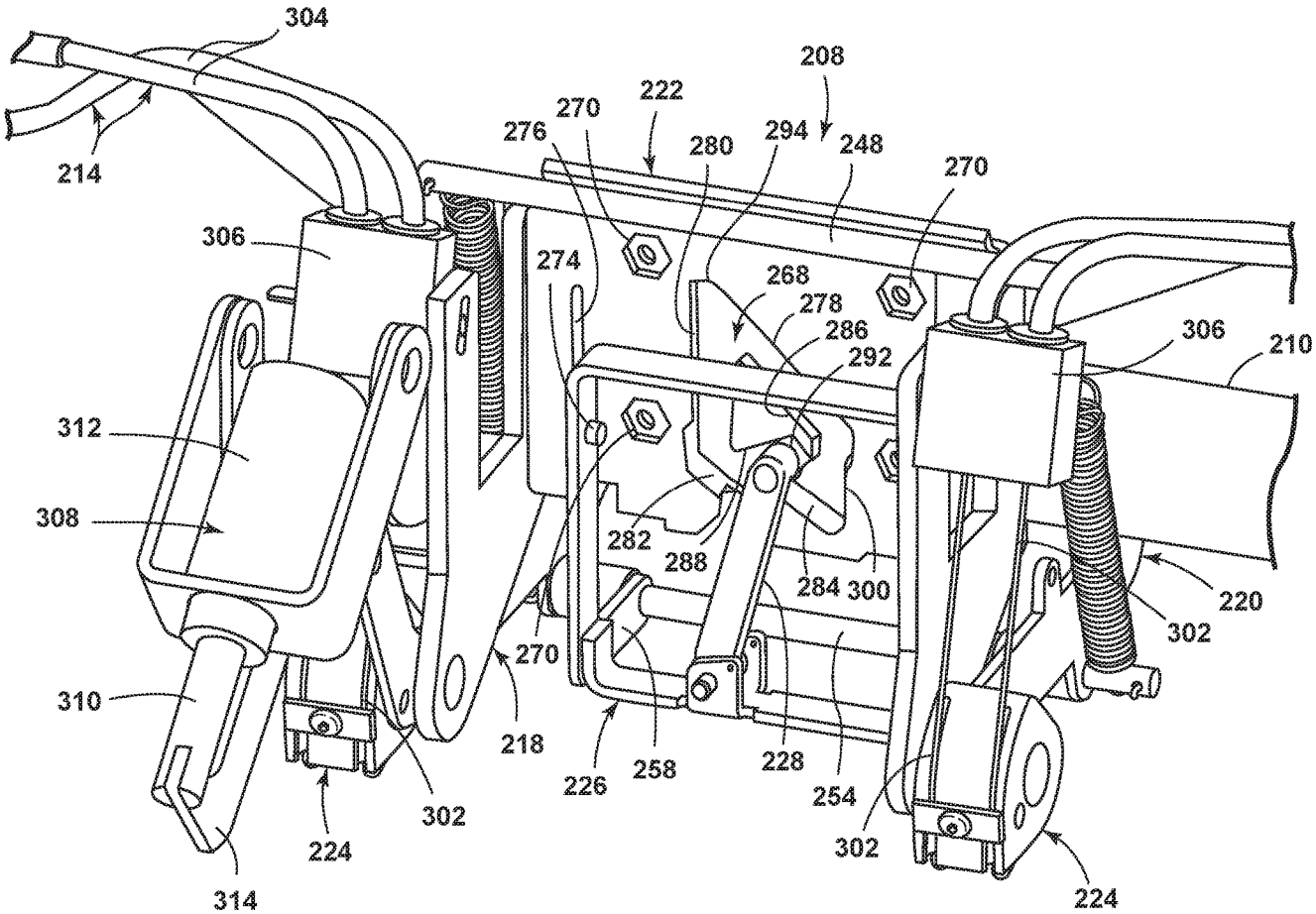
FIG. 33 is a rear, perspective view of the brake pedal assembly shown in the braked position.

FIGS. 32 and 33 illustrate the location of brake mechanism 308. In the illustrated embodiment, brake mechanism 308 comprises a solenoid with an extendable and retractable shaft 310 that selectively extends out of, and retracts into, a solenoid body 312. The distal end of shaft 310 is affixed to an arm 314 that, although not visible in FIGS. 32 and 33, is connected at its opposite end to a distal end of one of pedal support arms 240 (the leftmost arm 240 in FIG. 30). When shaft 310 extends out of, and retracts into, body 312, body 312 remains stationary with respect to base 22, while the movement of shaft 310 causes arm 314 to move with respect to base 22. Further, the movement of arm 314 is conveyed to one of pedal support arms 240, which in turn causes pedal support 220 to move in the same manner as if brake pedal 210 had been stepped on. Thus, pressing on one of brake buttons 94 causes the solenoid to move pedal support 220 (and pedal 210) in the same manner as if a user had manually stepped on pedal 210. Pressing on one of brake buttons 94 again causes the solenoid to once again move pedal support 220 in the same manner as if a user had manually pressed on pedal 210. The solenoid therefore toggles brake system 200 between the braked and unbraked conditions in the same manner that manually pushing down on brake pedal 210 toggles system 200 between braked and unbraked conditions.

Figure 34:
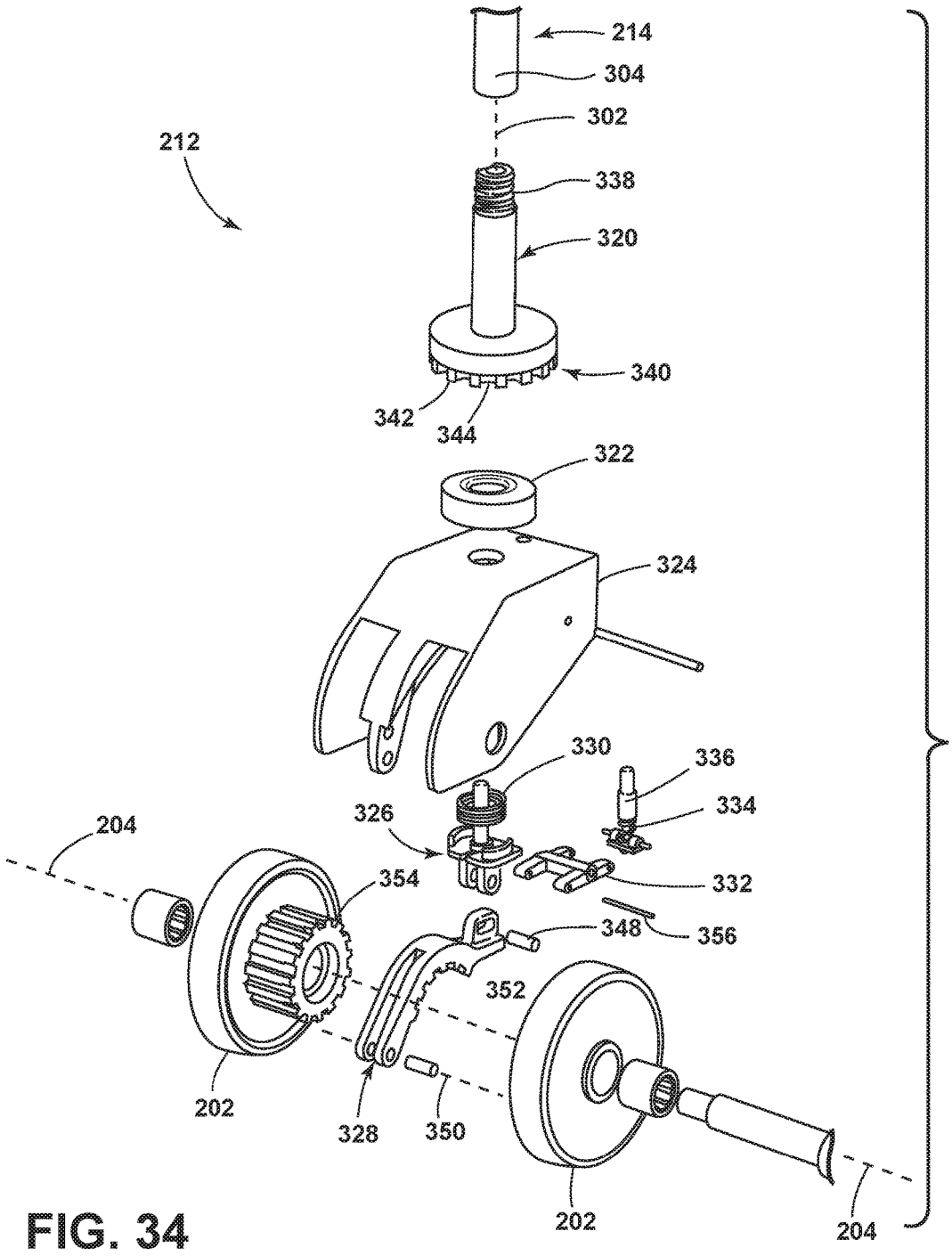
FIG. 34 is an exploded perspective view of an individual brake assembly.
Figure 35:
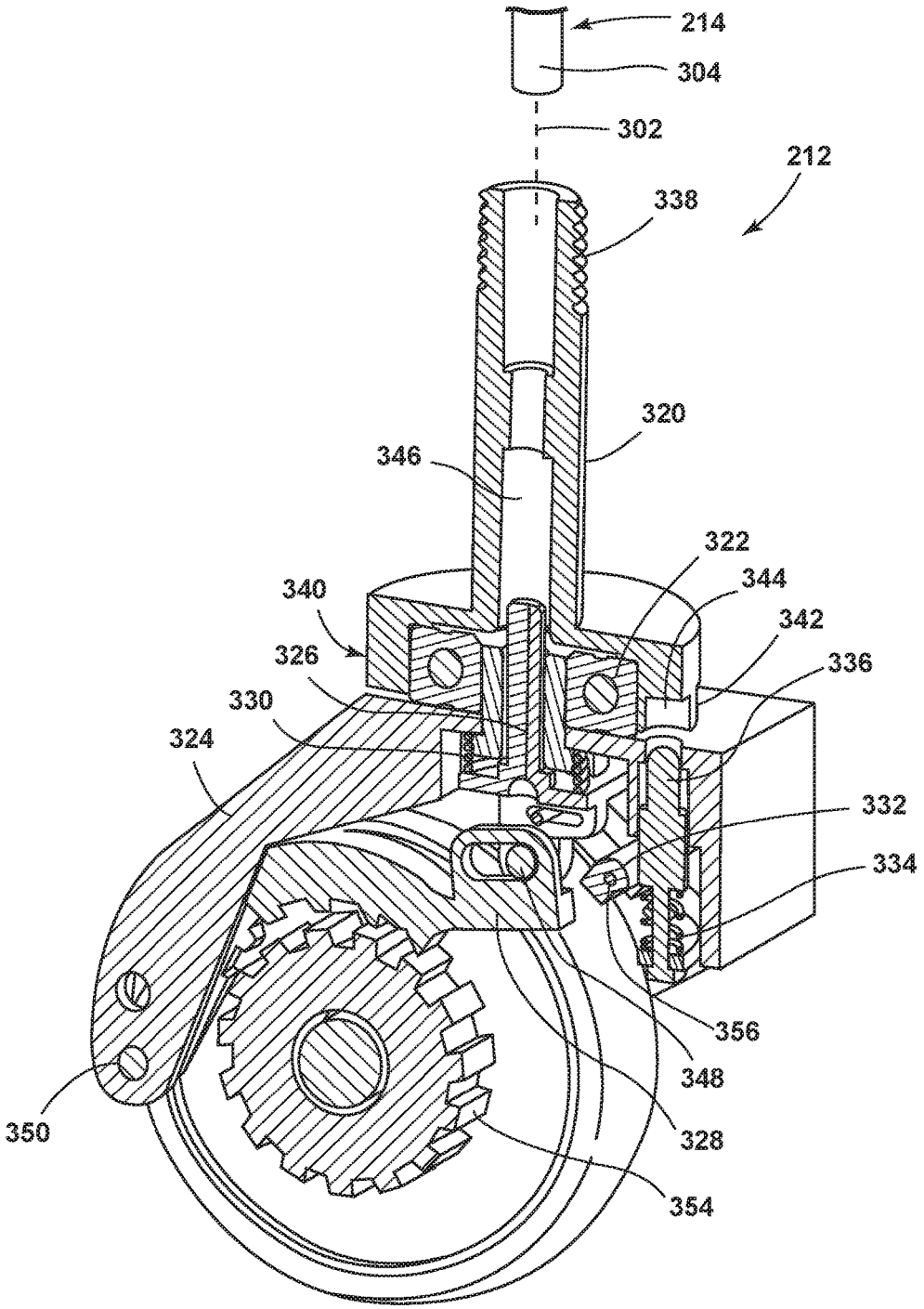
FIG. 35 is a perspective view of the individual brake assembly shown in the unbraked position.
Figure 36:
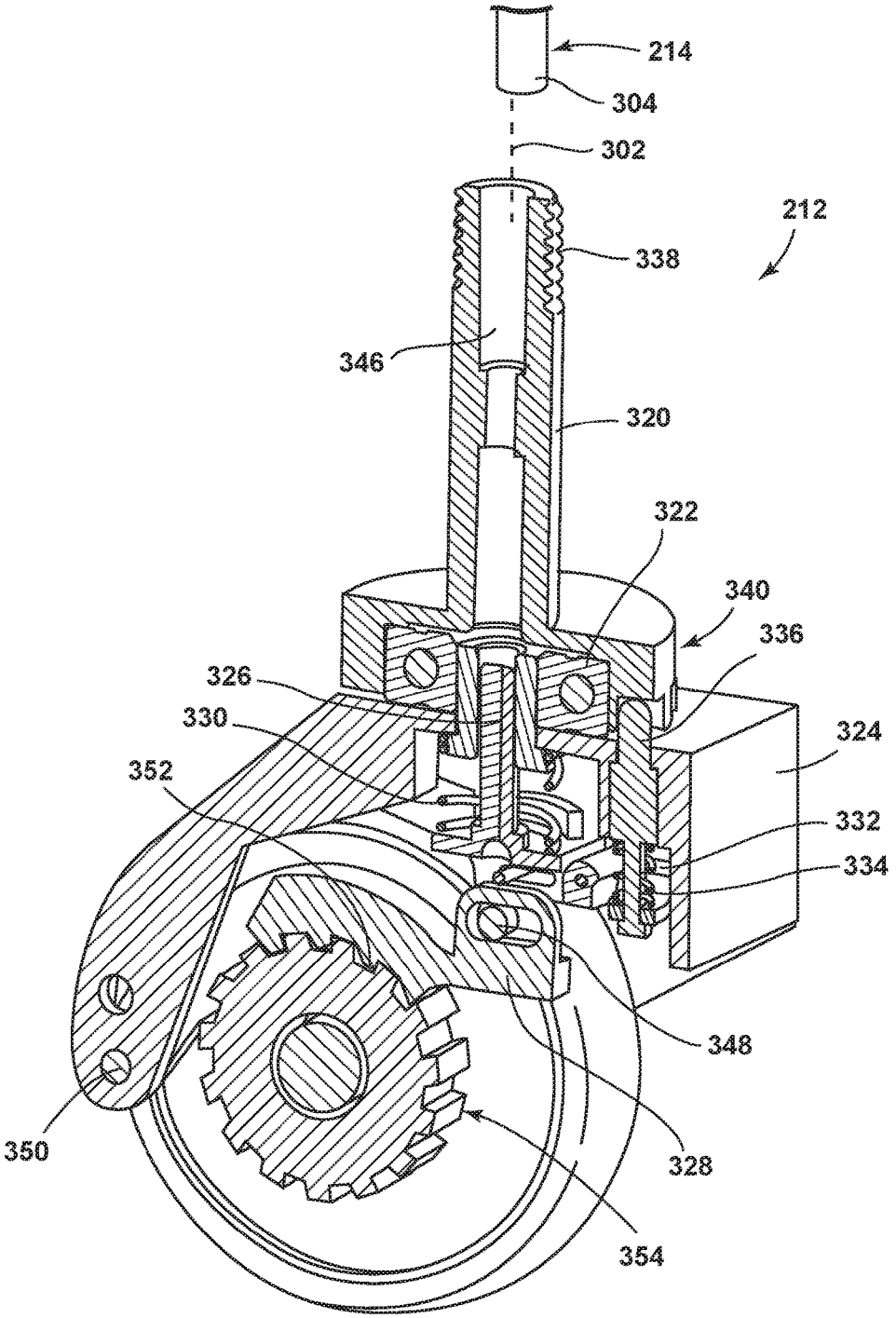
FIG. 36 is a perspective view of the individual brake assembly shown in the braked position.

The effect on the individual brake assemblies 212 of inner cables 302 being pulled and released by brake pedal 210 can be better understood with respect to FIGS. 34-35 which illustrate the components of each individual brake assembly 212. Each brake assembly 212 includes a brake mount 320, a swivel bearing 322, a brake housing 324, a reciprocating member 326, a brake pivot 328, a brake spring 330, a swivel lever 332, a swivel spring 334, a swivel lock pin 336, and a pair of wheels 202. Brake mount 320 includes a plurality of external threads 338 defined at its top end that enable brake mount 320 to be fixedly attached to base 22. Brake mount 320 further includes an annular castle member 340 defined on the underside of its bottom that includes an alternating set of projections 342 and slots 344. Still further, brake mount 320 includes a vertical bore 346 (FIGS. 35 and 36).

Vertical bore 346 provides a space for internal cable 302 of the corresponding mechanical cable 214 to run. The end of internal cable 302 is attached to reciprocating member 326. Consequently, when cable 302 is pulled away from brake assembly 212 by the releasing of pedal 210, reciprocating member 326 moves upwardly. This upward movement of reciprocating member 326 causes brake pivot 328, which is coupled to reciprocating member 326 by way of a pin 348, to also pivot upwardly about a brake pivot axis 350. Brake pivot 328 includes a plurality of teeth 352 defined on its underside that selectively engage and disengage from a toothed gear 354 that is fixedly, or integrally, coupled to wheels 202. More specifically, when internal cable 302 is pulled away from brake assembly 212 (upwardly in FIGS. 34-36), brake pivot 328 pivots upwardly about pivot axis 350, which causes teeth 352 to disengage from toothed gear 354. This allows wheels 202 to rotate about their wheel axis 204.

When a user pushes down on brake pedal 210 to engage brake system 200, the downward movement of pedal 210—as explained above—allows internal cables 302 to move toward brake assemblies 212. More specifically, the downward movement of pedal 210 allows the force of each brake spring 330 to push down its respective reciprocating member 326, which pulls the connected internal cable 302 downward. The downward pushing of spring 330 on reciprocating member 326 also pushes brake pivot 328, causing it to pivot downwardly about pivot axis 350, which brings teeth 352 into engagement with toothed gear 354, and thereby prevents rotation of wheels 202 about their axis 204. Spring 330 therefore stores a greater amount of potential energy when the brakes are disengaged than when the brakes are engaged. The release of this potential energy when brake system 200 is actuated is what provides the motive force for pushing brake pivot 328 into engagement with toothed gear 354.

Swivel bearing 322 enables housing 324 and all of the brake assembly components beneath brake mount 320 to swivel about generally vertical swivel axis 206 (FIG. 29). As mentioned earlier, this swiveling movement is also prevented when brake system 200 is actuated, and enabled when brake system 200 is deactuated. The manner in which this swiveling is selectively enabled and disabled will now be described.

Swivel lever 332 is also coupled to reciprocating member 326 (FIG. 34). This means that the end of swivel lever 332 coupled to reciprocating member 326 will move upward and downward in unison with reciprocating member. Further, because swivel lever 332 has a center portion pivotally coupled to a pivot pin 356, the opposite end of swivel lever 332 will move upward when the end coupled to reciprocating member 326 moves downward, and vice versa. Swivel lock pin 336, and swivel spring 334, which are both coupled to the end of swivel lever 332 opposite reciprocating member 326, will therefore move upward and downward in a manner that is opposite to the upward and downward movement of reciprocating member 326. In other words, when reciprocating member 326 moves upward, swivel lock pin 336 and swivel spring 334 will move downward, and vice versa.

The upward movement of swivel lock pin 336 will drive pin 336 into engagement with annular castle member 340. If pin 336 is aligned with one of the slots 344 defined in castle member 340, the engagement of pin 336 in the slot 344 will prevent the swiveling of the wheel assembly about the vertical swivel axis 206. If pin 336 is not aligned with one of the slots 344, but instead engages all or a portion of one of the projections 342 on annular castle member 340, then swivel spring 334 will be compressed due to the upward movement of the adjacent end of swivel lever 332. While spring 334 remains compressed due to engagement with a projection 342, that particular wheel 202 is not locked against swivel movement. However, as soon as a slight swiveling of that wheel occurs, this will rotate pin 336 with respect annular castle member 340 and will almost immediately cause pin 336 to become aligned with a slot 344. As soon as alignment with a slot 344 occurs, swivel spring 334 will decompress and force pin 336 into the slot 344. That particular wheel 202 will then be locked against swiveling movement. When a user releases brake pedal 210, swivel lock pin 336 will be pulled downward and out of engagement with castle member 340, thereby allowing that particular wheel 202 to swivel again.

Accordingly, the braking system provides a manually operable input mechanism (e.g. brake pedal) and a user interface (e.g. control panel) that can actuate the brake system actuator and further allows either of the manually operable input mechanism and the user interface to actuate the brake system actuator to thereby lock at least one of the caster wheels and to allow either one to release or disengage the actuator to thereby unlock the caster wheels. Thus, the brake system can engage/disengage electrically via the user interface or can engage/disengage based on input from the mechanical foot pedals. Further, the braking system may be configured so that mechanical engagement/disengagement will have precedence over electrical activation or state.

Figure 28A:
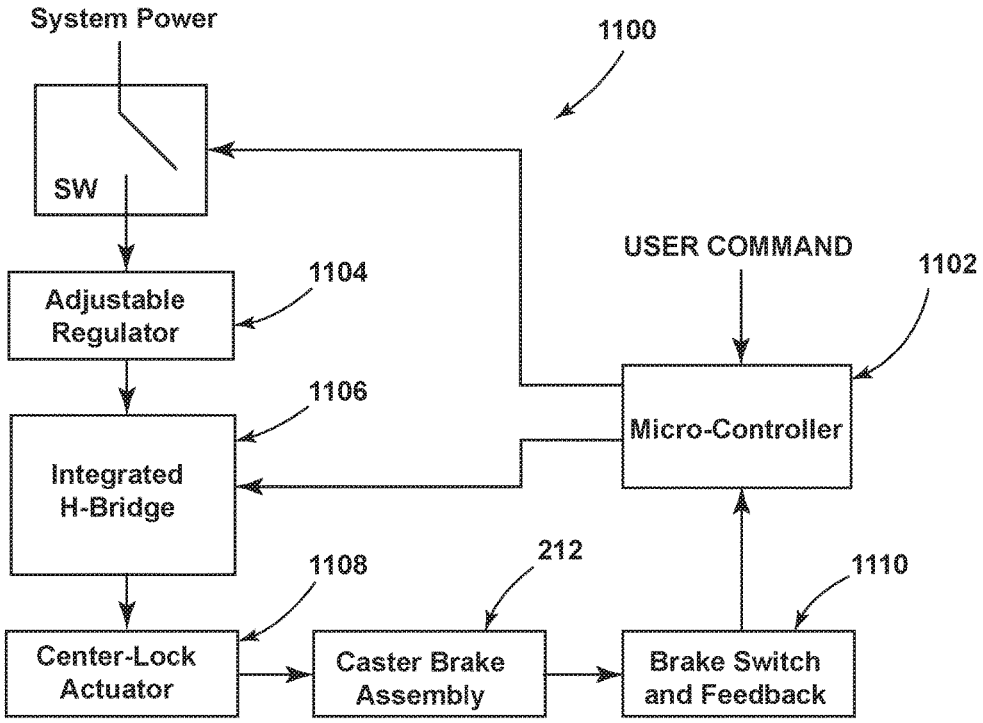
FIG. 28A is a diagram of a braking system circuit.

As noted above, the brake mechanism 308 may comprise a center-lock actuator 1108 (FIG. 28A). Referring to FIG. 28A, a suitable circuit 1100 for powering center-lock actuator 1108 for locking and unlocking the caster brake mechanism 212 of brake system 200 is illustrated. Circuit 1100 is optionally controlled by a designated micro-controller 1102, which receives command from either controller 82 or a separate user input, though it should be understood that controller 82 described above may be configured to control circuit 1100 in lieu of micro-controller 1102. Circuit 1110 includes a voltage regulator 1104, such as an adjustable voltage regulator (e.g. 0-32V, 0-5A), and an integrated H-Bridge integrated circuit 1106 that can drive in forward and reverse directions. When used with an adjustable voltage regulator, the h-bridge may achieve multiple output levels. Circuit 1100 may be used to actuate center-locking actuator 1108, for example, for a specified period of time, e.g. for a period of a fraction of a second, such as about 100 ms, in both the push and pull directions depending on the desired state. Because the system uses a center-lock actuator it can be manually overridden by a foot pedal to engage or disengage the brake. Optionally, feedback signals (e.g. digital feedback signals) from an integrated switch 1110 within the assembly allow the controller 1102 (and/or controller 82) to know what the current state is at all times for use in monitoring the braking system as described herein. Activation can be based on timing, recognition of the brake status switch feedback (see above), or additional feedback directly from the motor including voltage/current or position signals.

Control system 78 may incorporate electrical feedback, for example, one or more switches or sensors that detect a fault condition, including over-current and/or over-temperature in any of the powered devices, such as the actuators for actuating the brakes. Further, as noted control system 78 may incorporate one or more sensors or switches for brake status feedback, for example to indicate the state of the brake, e.g. brake engaged or disengaged. Based on this feedback, control system 78 can know what state the brake is in and can toggle it accordingly. Therefore the switch mechanism is independent of electrical or mechanical control.

As noted above, electrical actuation of the brakes may be achieved via one or more user interfaces, for example, a button on one or both control panels (80). Electrical actuation of the brakes may also be triggered by a condition at the chair, in other words "auto-braking". For example, when a certain configuration of the chair is selected, for example, the sit-to-stand configuration described below, or when the chair has been stationary for a predetermined period of time, control system 78 may be configured to actuate the brakes electrically. In addition or alternately, control system 78 may be configured to prevent the chair from moving to a selected configuration when the brakes are not engaged. For example, when the sit-to-stand configuration, described below, is selected and the brakes are not engaged, controller 82 may be configured to prohibit the actuators from moving support surface 21 from the seated position to the sit-to-stand position, for example, until the brakes are engaged.

Optionally, control system 78 may include an indicator **78*a*, such as a light, including one or more LEDs, to indicate the brake state and provide feedback to the user. For example, the user interface button may include a light to illuminate a specified color that designates one of the brake states or illuminate when the brakes are in a brake engaged state. Alternately, one or more separate lights may be provided, which the control system 78 illuminates in response to detecting the brake is engaged. For example, control system 78** may illuminate one light with one color when the brakes are engaged and another light with another color when they are disengaged.

In yet another aspect, control system 78 may include input from a motion detector 95, such as an accelerometer. The accelerometer may provide a signal to the controller, for example, when the chair is in motion. The controller 82 may then be configured, through hardware or software, to monitor signals from the accelerometer and to disable the electrical brake actuation, for example, by disabling the electric brake user input to prevent braking while the chair is in motion, which could otherwise potentially damage the brake. Alternately, as noted above, controller 82 may be configured, through hardware or software, to monitor signals from the accelerometer and to enable the electrical brake actuation to brake the wheels, for example, after a passage of time to provide "automatic braking".

Figure 38:
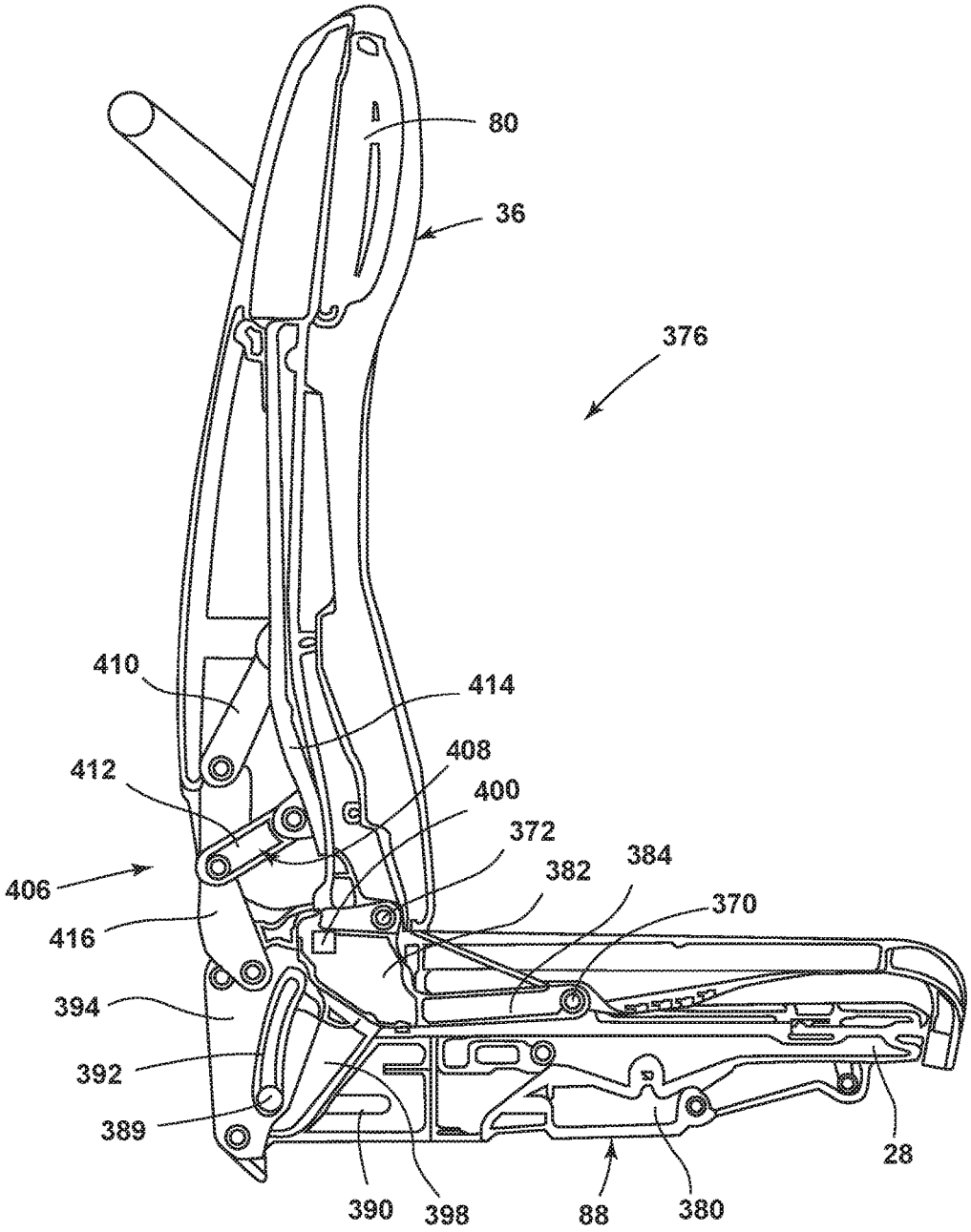
FIG. 38 is a side, elevation view of the backrest, seat frame, backrest bracket, and linkage assembly shown with the backrest in a fully upright position.
Figure 39:
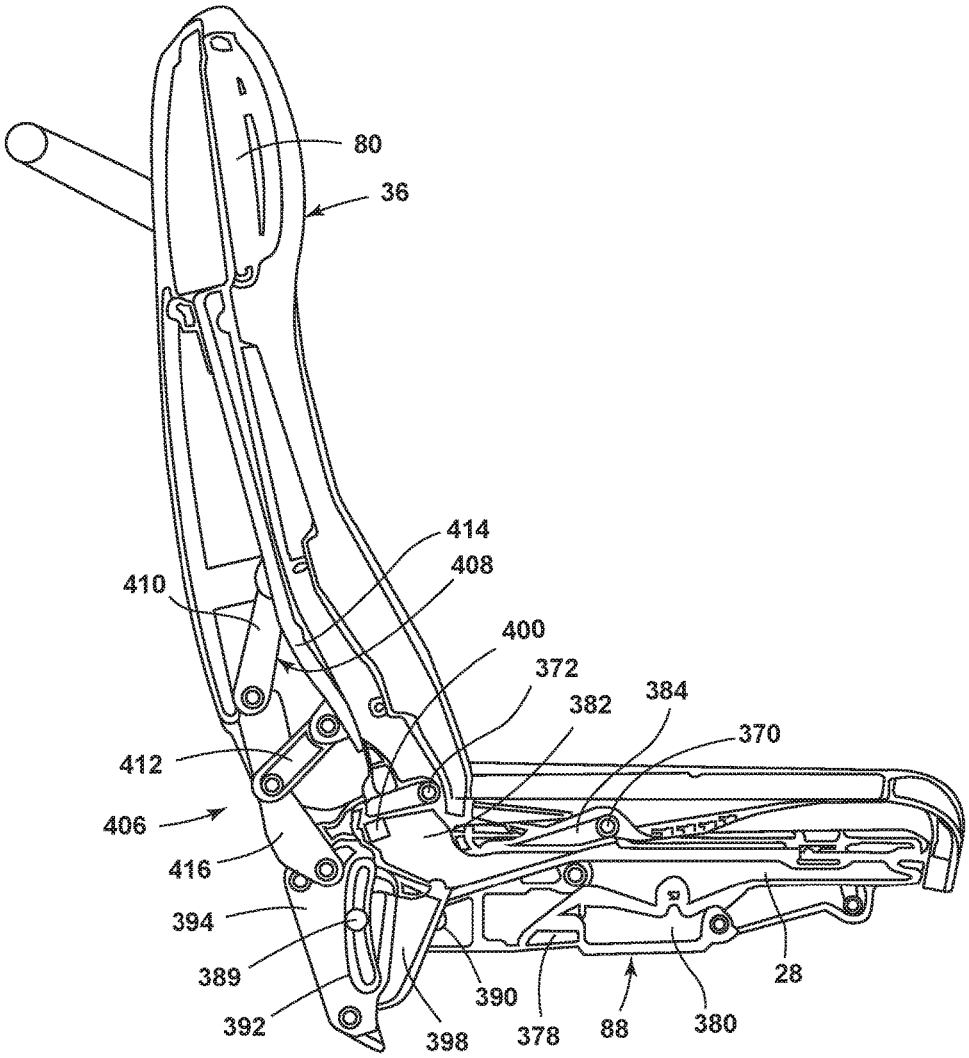
FIG. 39 is a side, elevation view of the backrest, seat frame, backrest bracket, and linkage assembly shown with the backrest in a position tilted slightly backwards from the fully upright position.
Figure 40:
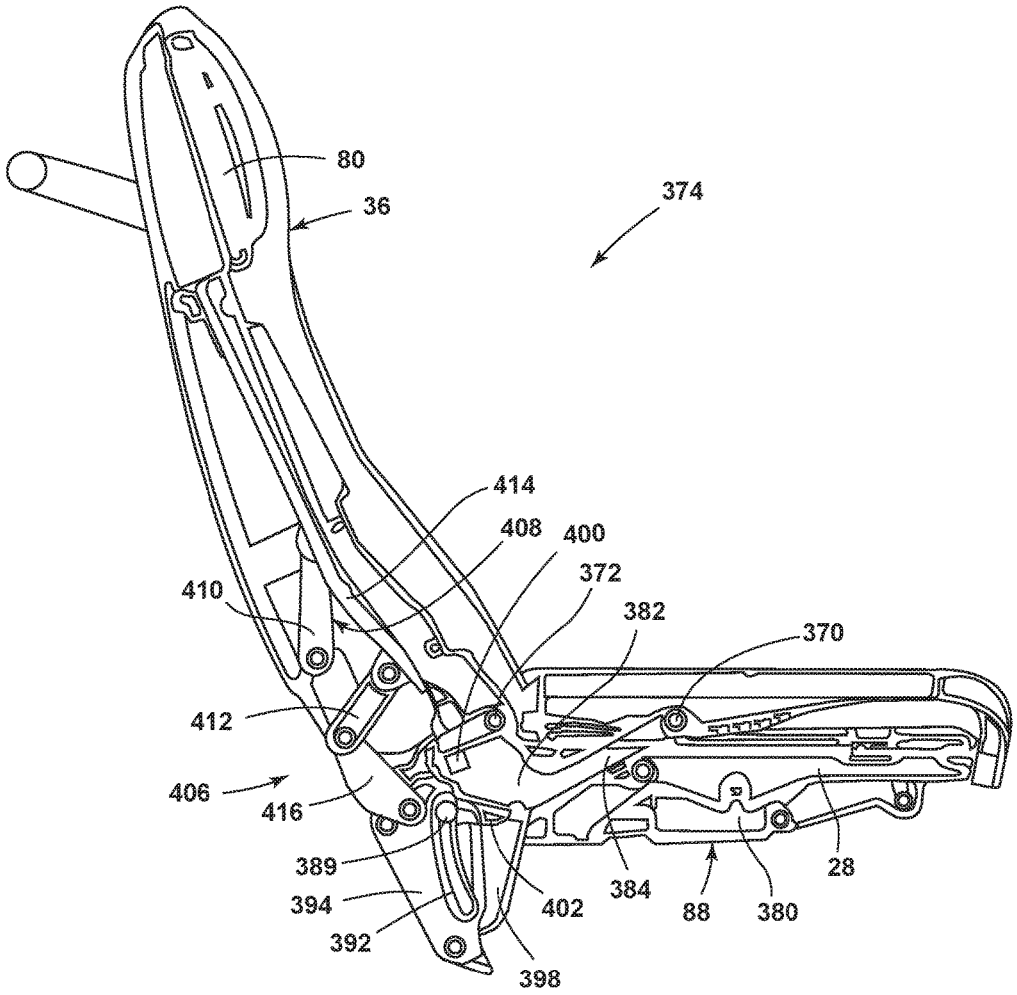
FIG. 40 is a side, elevation view of the backrest, seat frame, backrest bracket, and linkage assembly shown with the backrest tilted back to an intermediate position.
Figure 41:
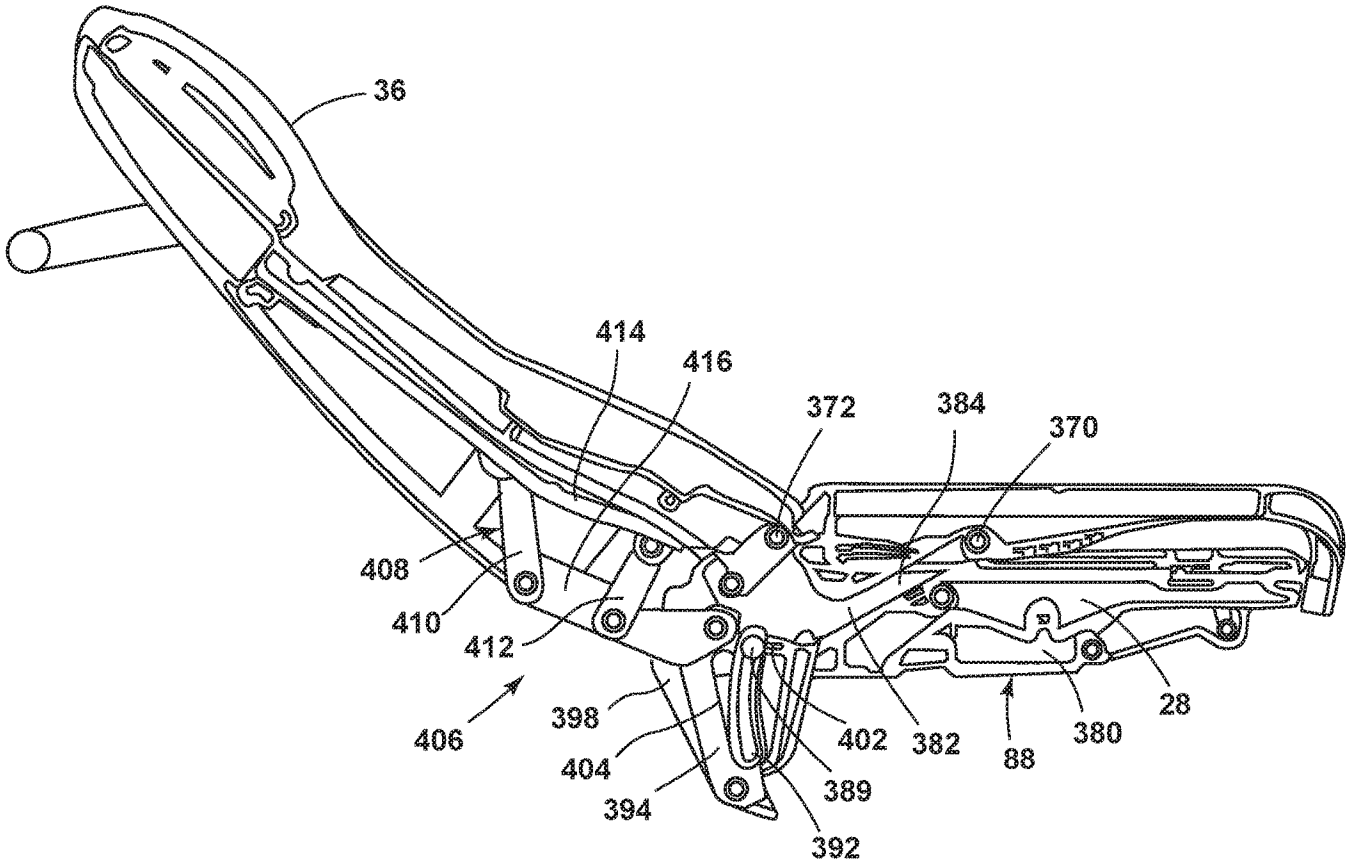
FIG. 41 is a side, elevation view of the backrest, seat frame, backrest bracket, and linkage assembly shown with the backrest tiled backward to a lower position than that of FIG. 40.

As noted above, backrest 36 is adapted to move between a fully upright position 376 (FIG. 38) and any user selected reclined position (e.g. FIG. 39, 40, or 41). In order to provide more comfort to the user of patient support apparatus 10, backrest 36 is adapted to initially pivot backwards from the fully upright position about a first pivot axis 370 (FIGS. 38-44), and subsequently, after backrest 36 reaches an intermediate position 374 (FIGS. 40 and 43), cease to pivot about first pivot axis 370, and instead commence pivoting about a second pivot axis 372. Pivoting about the second pivot axis 372 then occurs throughout the rest of the downward pivoting of backrest 36 to the fully reclined position. Backrest 36 therefore pivots between the upright position 376 and the intermediate position 374 about first pivot axis 370, and pivots about second pivot axis 372 during pivoting between intermediate position 374 and any more fully reclined position. Backrest 36 thus pivots about two pivot axes 372 and 374 during the reclining movement of backrest 36. This double pivoting provides more comfort to the user of patient support apparatus 10.

First pivot axis 370 is located at a height that is slightly lower than a top side of seat 30. First pivot axis 370 is also located in a forward-rearward direction at a location that is in line with where a patient's buttocks would normally rest when the patient is seated in seat 30. This location provides a more comfortable feeling when pivoting the backrest 36 than when a pivot axis is positioned in line with the patient's hips. Second pivot axis 372 is positioned rearwardly of a front end of backrest 36. Second pivot axis 372 is also positioned at a higher elevation than first pivot axis 370 (when backrest 36 is in the fully upright position). During pivoting about first pivot axis 370, second pivot axis 372 initially starts at this higher height, but then pivots to a height that is substantially the same as the height of second pivot axis 372.

Figure 7:
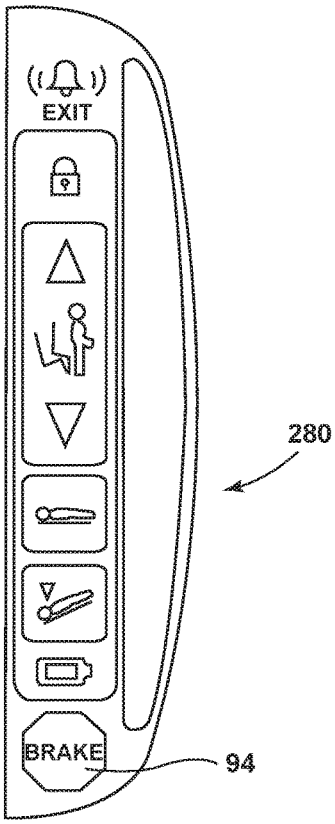
FIG. 7 is an enlarged view of the control unit of FIG. 6.
Figure 8:
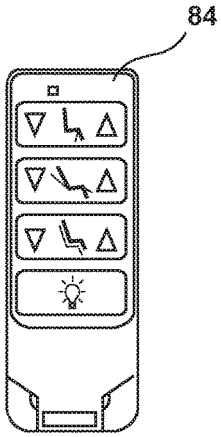
FIG. 8 is an elevation view of a remote control unit that may be used to control the chair.

The control of the pivoting of backrest 36 is carried out by control system 78 and controller 82 in response to commands received from either of the control panels 80 or the user pendant 84. For example, as shown in FIG. 7, control panels 80 (or pendant 84, FIG. 8) may have user actuatable devices, such buttons or a key pad, or the like to actuate the respective actuators to move the various sections of the support surface (seat section, backrest and leg rest) to several positions, such as described above, including the sitting configuration, the standing configuration, the recline configuration, the upright configuration, the lateral transfer configuration, and the Trendelenburg configuration. In addition, user actuatable devices may be provided to control other functions, such as the brake function at button 94. Similar buttons or key pads with similar or a reduced set of functions or other functions may be provided at pendant 84, such as illustrated in FIG. 8.

Further, to ease access to pendant 84, pendant 84 maybe mounted on a flexible arm (see e.g. FIG. 2), which allows the pendant to be lifted, lowered, rotated or moved to the other side for use by a right handed person (currently shown on the left side).

In response to those commands, controller 82 sends the appropriate control signals to a backrest actuator 88 that is responsible for pivoting backrest 36 up and down. Backrest actuator 88 carries out the pivoting of backrest 36 for the pivoting that occurs about both pivot axes 370 and 372. This pivoting is carried out by the linear extension and retraction of an actuator arm 378 into and out of an actuator body 380 of backrest actuator 88. No other motion of actuator 88 is required to carry out the double pivoting of backrest 36 because, as will be explained in greater detail below, the mechanical design of backrest 36 and its connecting structure to seat frame 28 converts the linear movement of actuator 88 into the appropriate motion for carrying out the double pivoting.

Backrest actuator 88 may be any conventional electrical actuator adapted to extend and retract its arm 378. In the illustrated embodiments, backrest actuator 88 is constructed such that it will automatically retain its current extension or retraction after it is done moving. That is, backrest actuator 88 includes an automatic internal brake that locks it into whatever position it ends up in. This locking feature holds backrest 36 in any of the virtually infinite number of reclined positions between the fully upright position 376 and the fully reclined position.

Figure 37:
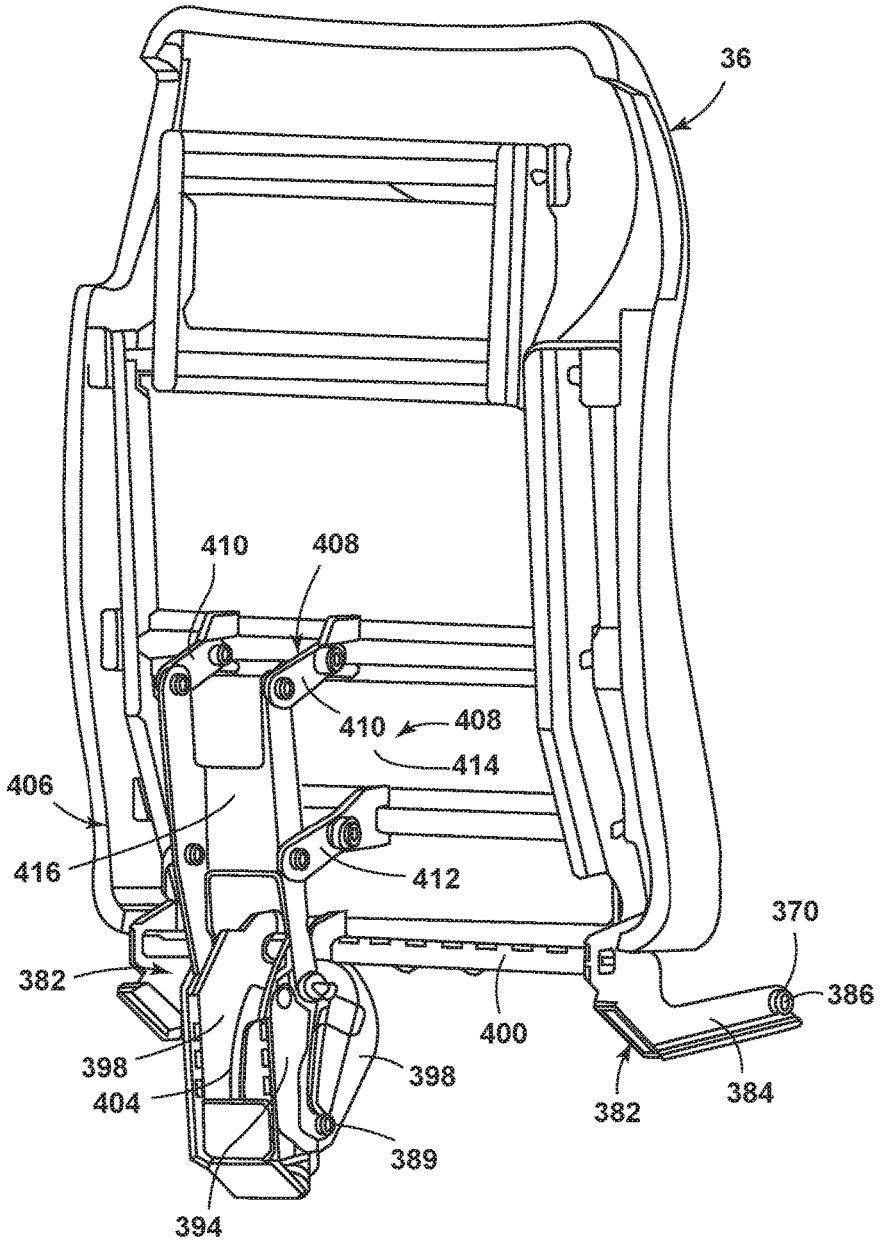
FIG. 37 is a rear perspective view of the backrest, backrest bracket, and linkage assembly.
Figure 42:
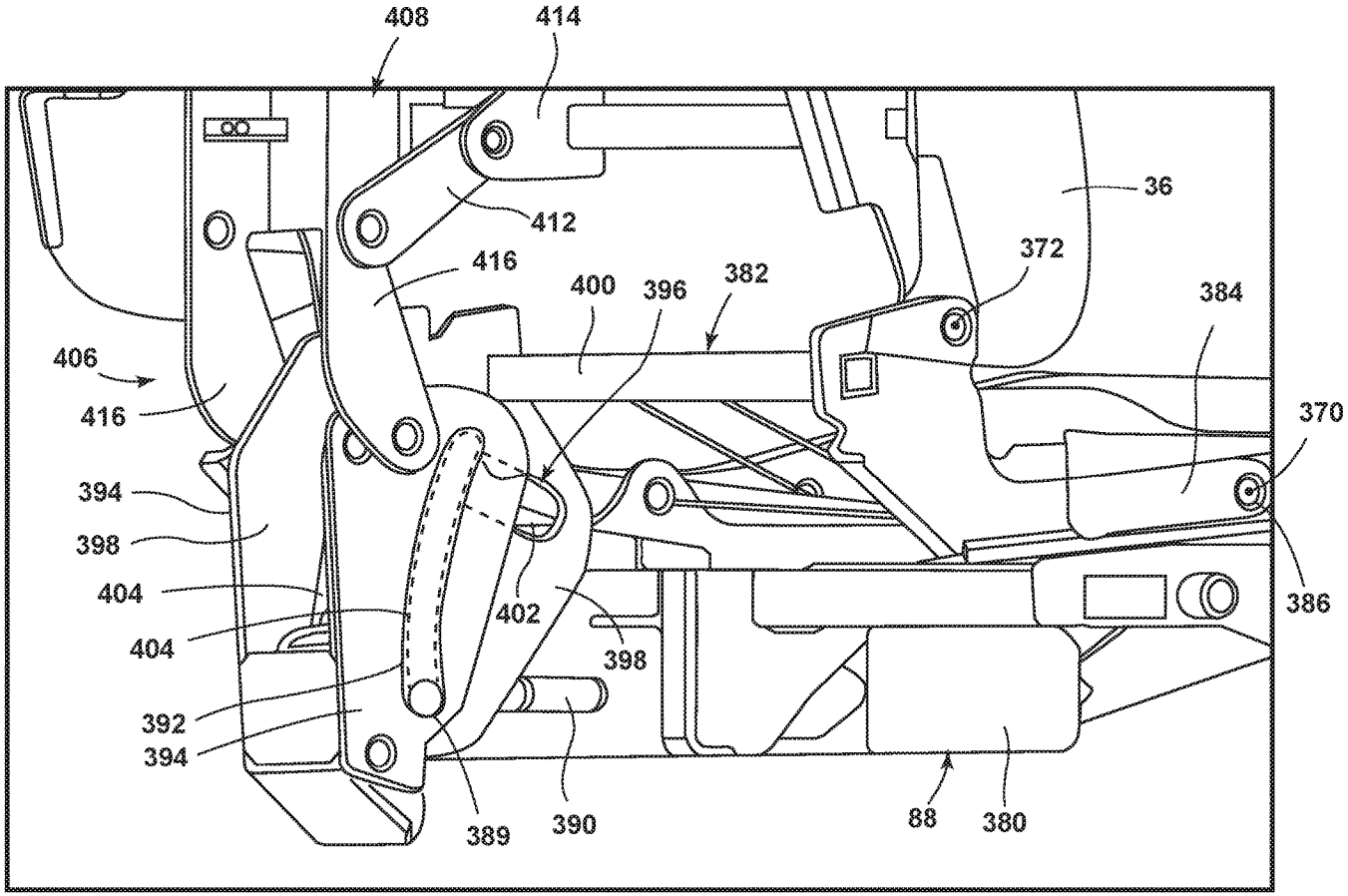
FIG. 42 is a partial perspective view of the backrest, backrest bracket, backrest linkage assembly, and seat frame shown with the backrest in the fully upright position.
Figure 45:
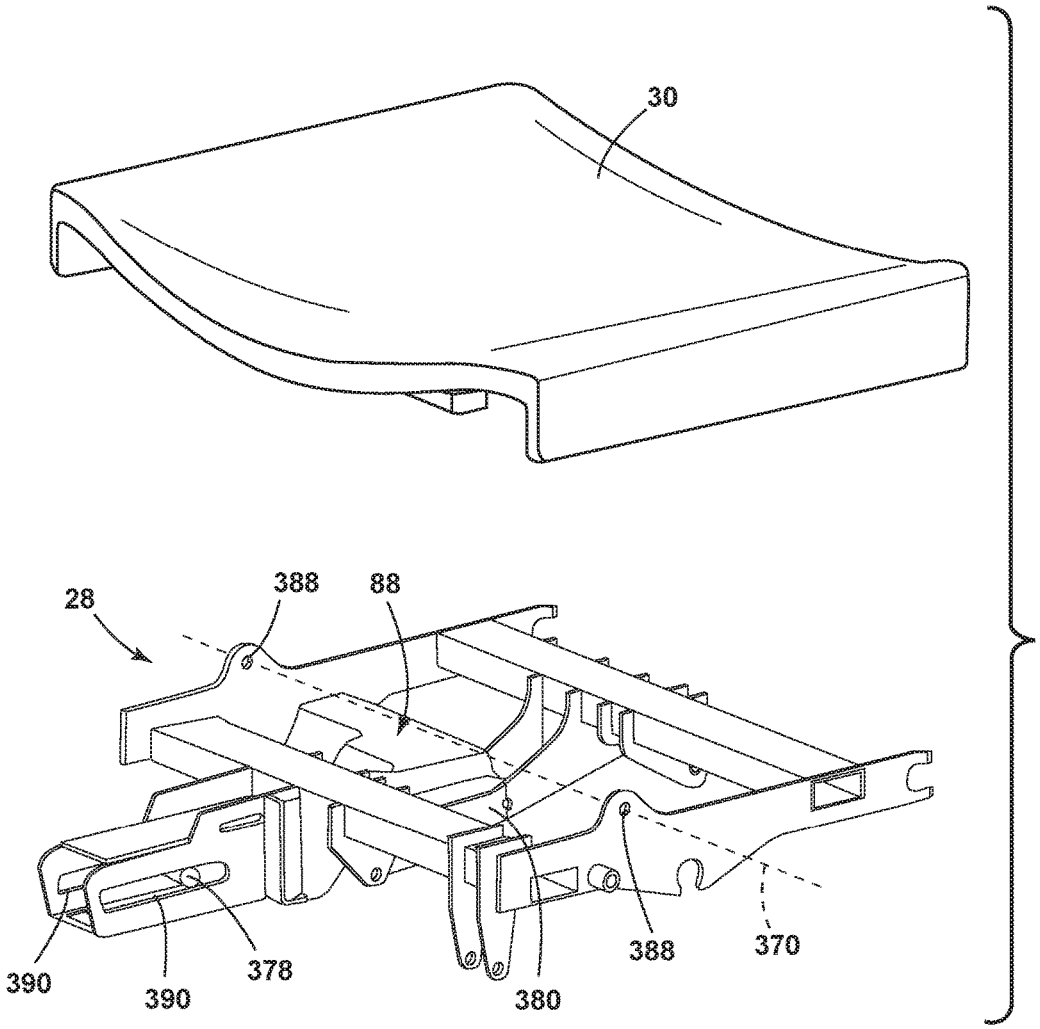
FIG. 45 is a perspective view of the seat frame and seat.

Backrest 36 is pivotally coupled to seat frame 28 by way of a backrest bracket 382 (FIG. 37). More specifically, backrest bracket 382 includes a pair of spaced apart parallel arms 384 with each arm having a pivot aperture 386 defined at the distal end (FIG. 37). A pivot pin, or the like (not shown), fits through each pivot aperture 386 into a corresponding pin aperture 388 defined on the top side of seat frame 28 (FIG. 45). Backrest bracket 382 further includes a cross bar section 400 that extends between each arm 384. Backrest 36 is pivotally coupled to backrest bracket 382 about second pivot axis 372 (FIG. 42). Backrest bracket 382 is therefore pivotal with respect to seat frame 28 about first pivot axis 370, and backrest 36 is pivotal with respect to backrest bracket 382 about second pivot axis 372. Backrest bracket 382 remains stationary when backrest 36 is pivoting about second pivot axis 372.

Figure 43:
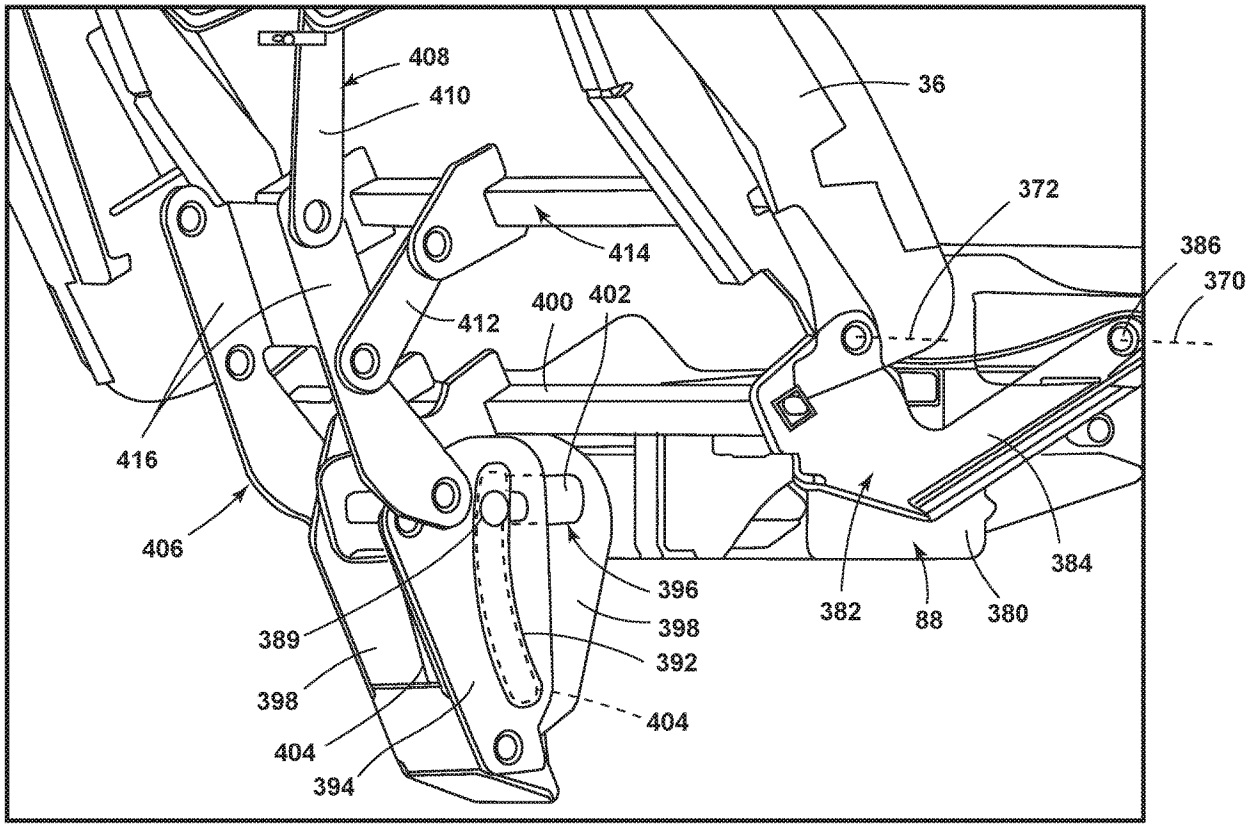
FIG. 43 is a partial perspective view of the backrest, backrest bracket, backrest linkage assembly, and seat frame shown with the backrest in the intermediate position.
Figure 44:
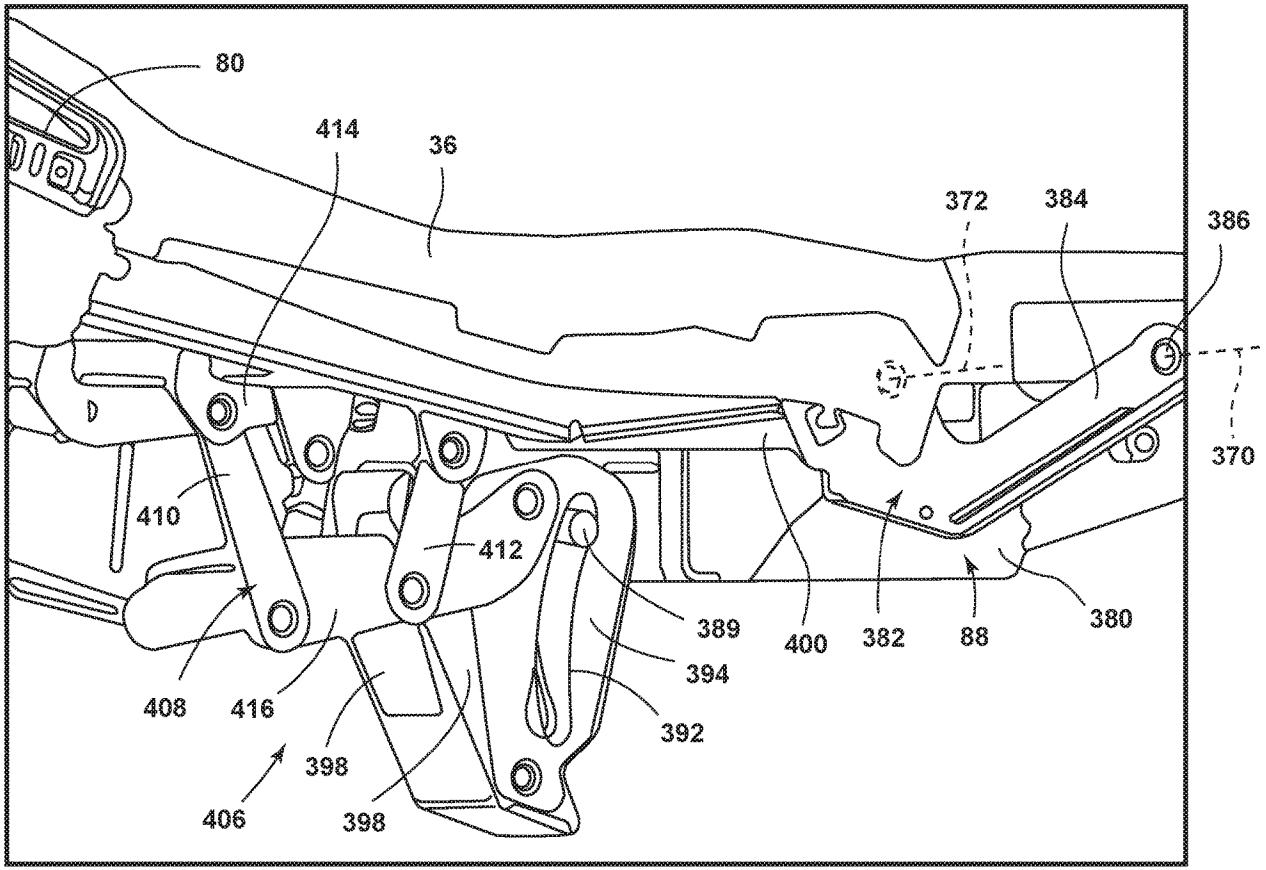
FIG. 44 is a partial perspective view of the backrest, backrest bracket, backrest linkage assembly, and seat frame shown with the backrest in a reclined position.

The distal end of backrest actuator 88 is connected to a guide pin 389 that rides in three pairs of different channels that, in combination, effectuate the double pivoting characteristics of backrest 36. More specifically, guide pin 389 rides in a pair of elongated channels 390 defined at a back end of seat frame 28 (FIG. 45). Guide pin 389 also rides in a pair of arcuate channels 392 defined in a pair of channel link members 394 (FIG. 43). That is, each channel link member 394 defines a single arcuate channel 392. Still further, guide pin 389 rides in a pair of pin channels 396 that are defined in a pair of pin guide members 398.

Each pin guide member 398 is fixedly attached to cross bar section 400 of backrest bracket 382. Pin guide members 398 therefore pivot with backrest bracket 384 between the upright position 376 and the intermediate position 374, but remain stationary during pivoting between the intermediate position 374 and the fully reclined position. Each pin channel 396 defined in each pin guide member 398 has two different sections: a straight section 402 and an arcuately shaped section 404 (FIGS. 42 and 43). Straight section 402 is aligned with elongated channels 390 defined in seat frame 28. Arcuately shaped section 404 has the same arcuate shape as arcuate channels 392 defined in channel link members 394. When backrest 36 pivots between the fully upright position 376 and the intermediate position 374, arcuately shaped channels 404 and arcuate channels 392 are aligned with each other, and straight section 402 and elongated channels 390 are misaligned with respect to each other. However, when backrest 36 pivots between the intermediate position and any of the more reclined positions, arcuately shaped channels 404 and arcuate channels 392 become misaligned with each other while straight section 402 and elongated channels 390 are aligned with each other.

Figure 41A:
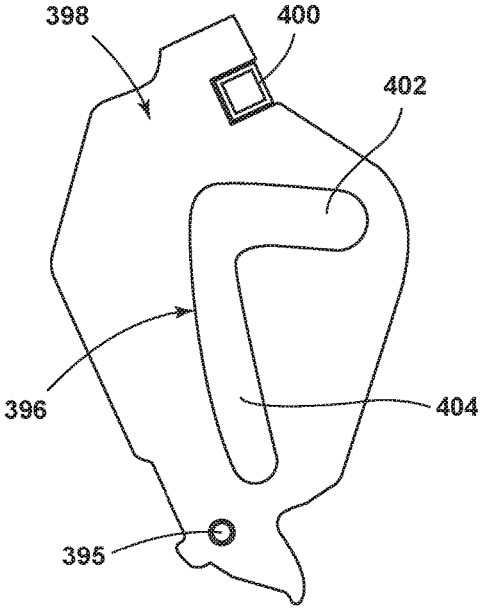
FIG. 41A is a plan view of a pin guide member attacked to a cross bar of the backrest bracket.
Figure 41B:
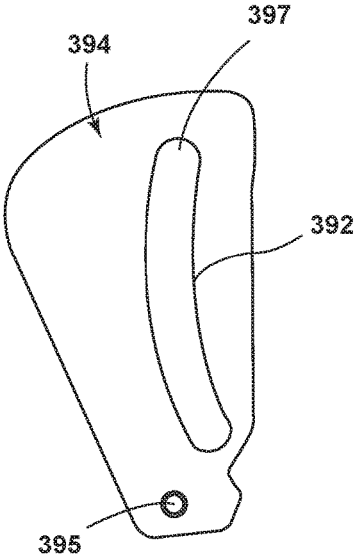
FIG. 41B is a plan view of a channel link member of the linkage assembly.

FIGS. 41A and 41B illustrate in greater detail the shapes of arcuate channels 392 and pin channels 396. Both pin guide member 398 and channel link member 394 are generally flat and planar elements. There are two sets of channel link members 394 and pin guide members 398 in patient support apparatus 10. A first set is positioned on one side of the apparatus 10 and the other set is positioned on the other side of the apparatus. For each set, the channel link member 394 and the guide member 398 are positioned side by side and pivotally connected together. The pivoting of a guide member 398 with respect to its attached channel link member 394 occurs about a pivot axis 395. Each channel link member 394 is positioned on the outside of guide member 398. In other words, when viewing apparatus 10 from behind, channel link members 394 will be positioned farther away from the center line of the apparatus 10 than pin guide members 398.

As was noted, for each pairing of a pin guide member 398 with a channel link member 394, pin guide member 398 is pivotal with respect to its attached channel link about pivot axis 395 (which extends perpendicularly out of the plane of FIGS. 41A and 41B). When guide pin 389 is positioned in arcuately shaped section of channel 396, pin guide member 398 and channel link member 394 will not be able to pivot with respect to each other because arcuate channel 392 and arcuately shaped section 404 of channel 396 have generally the same shape and width. However, when guide pin 389 moves up to a top end 397 of channel 392, the guide pin 389 will be in the straight section 402 of channel 396, where it will be able move laterally within straight section 402. This lateral movement allows channel link member 394 to pivot with respect to pin guide 398 (about axis 395). This area of lateral movability in straight section 402 corresponds to the movement of backrest 36 between the intermediate position and the fully reclined position.

From a study of FIGS. 38 to 44, it can also be seen that guide pin 389 reciprocates back and forth within elongated channels 390 during movement between the fully upright position and fully reclined position of backrest 36. Guide pin 389 moves between opposite ends of arcuate channels 392 defined within channel link member 394 during pivoting between the fully upright position and the intermediate position. Guide pin 389 remains at the upper end 397 of arcuate channels 392 during pivoting of backrest 36 between the intermediate position and the fully reclined position. Further, guide pin 389 moves up and down within arcuately shaped section 404 of pin channel 396 during pivoting of backrest 36 between the fully upright and intermediate positions. And still further, guide pin 389 moves between opposite ends of the straight section 402 during pivoting of backrest 36 between the intermediate position and fully reclined position.

It can also be seen from a study of FIGS. 38 to 44 that backrest actuator arm 378 is in its fully extended position when backrest 36 is in the fully upright position, and backrest actuator arm 378 is in its fully retracted position when backrest 36 is in its fully reclined position. Still further, it can be seen that the engagement of guide pin 389 with the arcuate shaped edges of pin channels 396 and arcuate channels 392 creates upward and downward forces (depending on the direction of movement of pin 389) on backrest 36 and backrest bracket 382. These upward and downward forces are responsible for urging backrest 36 and/or backrest bracket 382 in the corresponding upward and downward direction, thereby causing backrest 36 and/or backrest bracket 382 to pivot accordingly. It should be noted that the intermediate position 374 is the position at which the pivoting of backrest 36 switches between first and second pivot axes 370 and 372.

Each channel link member 394 is pivotally coupled to a linkage assembly 406. Linkage assembly 406 includes a four-bar linkage 408 that includes an upper link 410, a lower link 412, a backrest frame link 414, and a rear link 416 (FIGS. 38-40). This four bar linkage 408 provides support to backrest 36 during pivoting and couples backrest 36 to channel link members 394.

As noted above, patient support apparatus 10 includes, in some embodiments, exit detection system 96. Exit detection system 96 is adapted to issue an alert when it is armed and a patient on the patient support apparatus 10 is about to exit, or has exited, from seat 30. Exit detection system 96 includes a plurality of binary sensors (not shown) that are arranged in a selected pattern and positioned underneath the cushioning on seat 30. Each sensor is adapted to open or close based upon the presence or absence of sufficient pressure exerted by the weight of the patient on seat 30. The outputs from the individual sensors are fed to controller 82 which, in one embodiment, issues an alert if any of the multiple sensors detects an absence of sufficient pressure. In other embodiments, controller 82 is programmed to only issue an alert if a threshold number of sensors detect an absence of pressure, or if one or more specific patterns of sensors detect an absence of patient pressure.

Exit detection system 96 is controlled by a caregiver through the use of control panels 80. Each control panel 80 includes a button that, when pressed, toggles between arming and disarming exit detection system 96. When disarmed, no alerts are issued by exit detection system 96. When armed, exit detection system issues alerts when controller 82 senses that one or more of the binary pressure sensors under seat 30 have detected an absence of patient pressure.

In an alternative embodiment, control system 78 can be modified to include a wireless or wired transceiver that transmits a signal to a healthcare network, or server on the healthcare network, when a patient exit condition is alerted. When so equipped, patient support apparatus 10 includes a control for enabling the caregiver to select whether the exit alert should remain local, or be transmitted remotely to the network or server.

Figure 73:
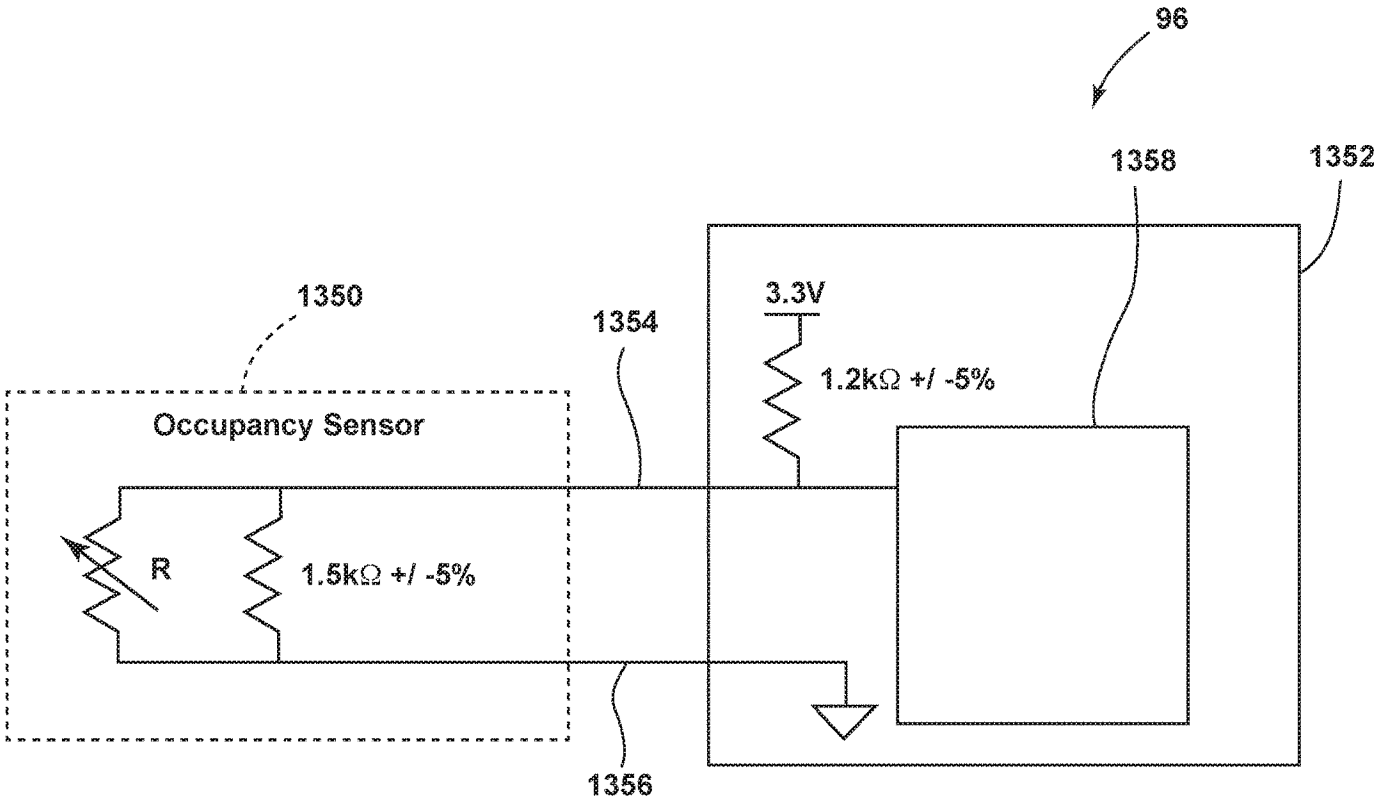
FIG. 73 is a diagram of an exit detection system according to one embodiment.

With reference to FIG. 73, one embodiment of an exit detection system 96 is shown. Other types of exit detection systems may be used. Exit detection system 96 of FIG. 73 includes an occupancy sensor 1350 that is electrically coupled to a circuit board 1352 by way of a supply line 1354 and a ground line 1356. Circuit board 1352 includes a controller 1358 that, in one embodiment, is the same as controller 82. In other embodiments, controller 1358 is separate from controller 82 but in communication therewith. Circuit board 1352 further includes a voltage source 1360 that supplied voltage to occupancy sensor 1350. Occupancy sensor 1350 is a resistive sensor that is positioned underneath a cushion on the seat of the chair. Occupancy sensor 1350 includes multiple binary sensors that are arranged in a selected pattern, as noted above.

Controller 82 is able to determine four different conditions based on the voltage it detects between lines 1354 and 1356. When this voltage is between a first threshold and zero volts, this is indicative of a short circuit. When this voltage is between the first threshold and a second higher threshold, this is indicative of a person occupying the seat. When this voltage is between the second threshold and a third higher threshold, this is a hysteresis range where the chair is either occupied or unoccupied, depending upon whatever the last immediately previous state of the chair was (occupied or unoccupied). When this voltage is between the third threshold and a fourth higher threshold, this is indicative of a person having left the seat (unoccupied). Finally, when this voltage is between the fourth threshold and a fifth higher threshold, this is indicative of an open circuit. In one embodiment, the first, second, third, fourth, and fifth thresholds are 0.23 V, 0.90V, 1.66V, 2.01V, and 3.30V, although it will be understood by those skilled in the art that these are merely illustrative examples and that different thresholds may be used. If controller 82 ever detects that the circuit is open or closed, it is adapted to determine that an error condition exists and to make this information available to a user, such as, for example, by illuminating one or more lights, by recording the error in a memory that can be read by a diagnostic tool, or in still other manners.

Referring to FIGS. 46-49, apparatus 10 includes a plurality of accessories to facilitate line management, providing mounting surfaces for devices, such as the Foley bag, and further to enhance the comfort of a patient seated in apparatus 10. Additionally, apparatus 10 may incorporate IV mounting poles to facilitate movement of IV equipment along with apparatus 10.

Figure 46:
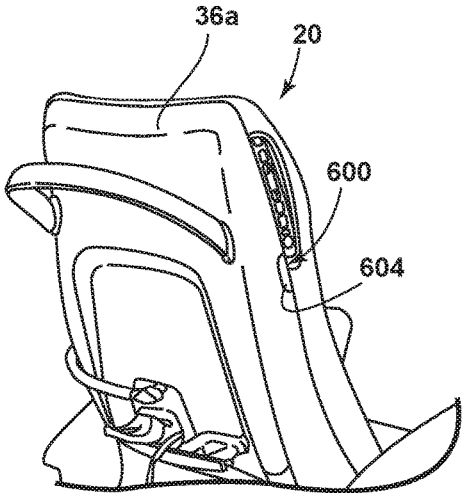
FIG. 46 is a rear perspective view of the recliner chair illustrating a line management hook shown in a stowed position and further a cord wrap integrated in to the back seat section of the chair.
Figure 46A:
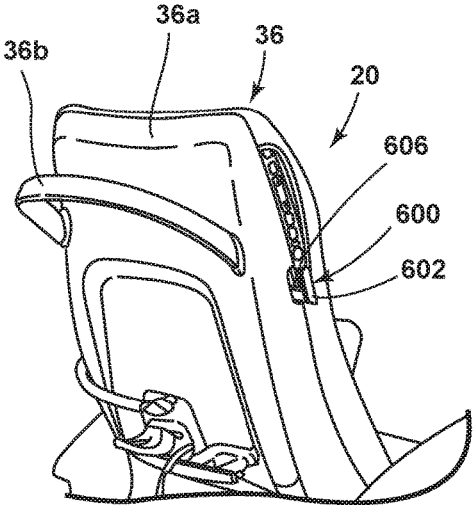
FIG. 46A is a rear perspective view of the recliner chair of FIG. 46 illustrating the line management hook shown in an extended position.

Referring to FIGS. 46 and 46A, backrest 36 includes a back shell 36*a*, for example, formed from a plastic material that forms the back facing side of the backrest, and which abuts the cushion layer as shown. Backrest 36 may include a line management device 600 in the form of a retractable bracket 602. As best understood from FIGS. 46 and 46A, bracket 602 is mounted in an opening 604 provided in the backrest shell and further in a manner to be recessed within the opening so that the outer arm 606 of bracket 602 may be generally flush with the outer surface of back cover 36*a*. Optionally, bracket 602 may be spring mounted, for example by a push push mechanism, so that when pushed into the opening, it may be latched in place but then subsequently released when pressed again. Alternately, bracket 602 may simply be manually pivoted from its stowed position to its extended position, and may include an engagement surface to allow a user to grab the edge of the bracket to facilitate the movement between the stowed and operative position.

Figure 47:
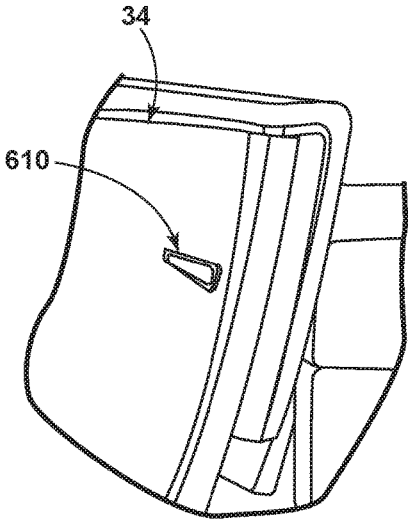
FIG. 47 is an enlarged view of a Foley hook incorporated in to the arm rest of the chair showing the Foley hook in a stowed position.
Figure 47A:
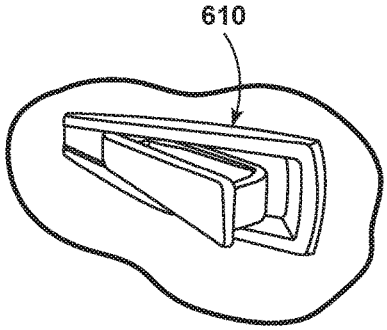
FIG. 47A is an enlarged view of the Foley hook of FIG. 47 shown in an extended position.
Figure 51:
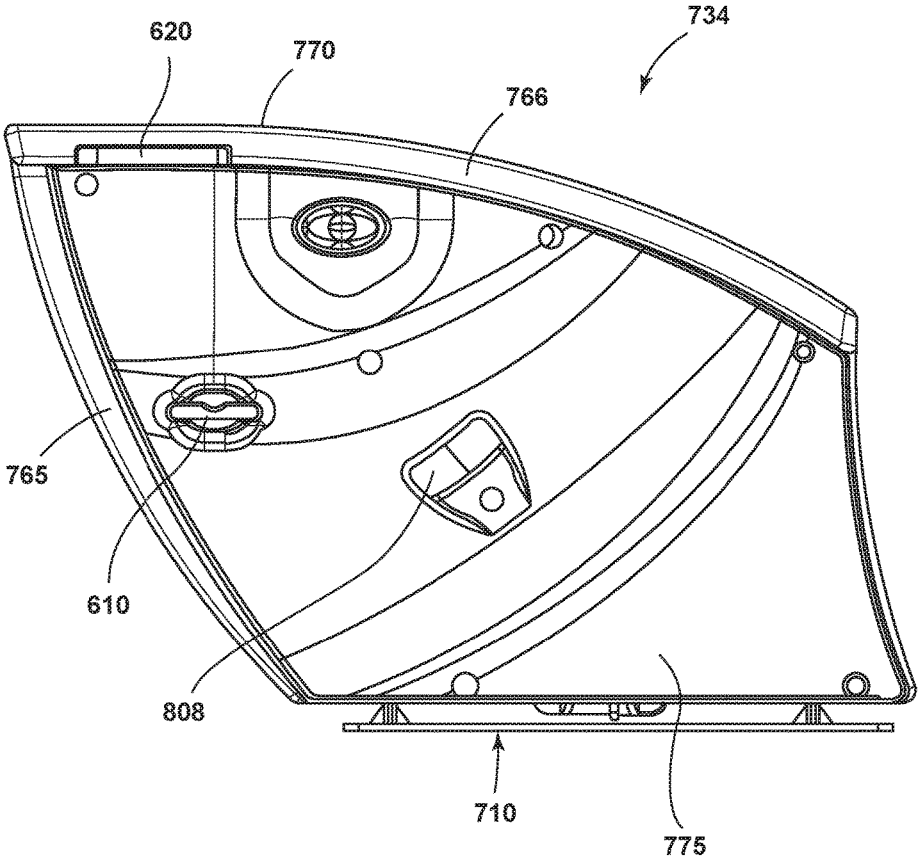
FIG. 51 enlarged elevation view of the arm rest.
Figure 52:
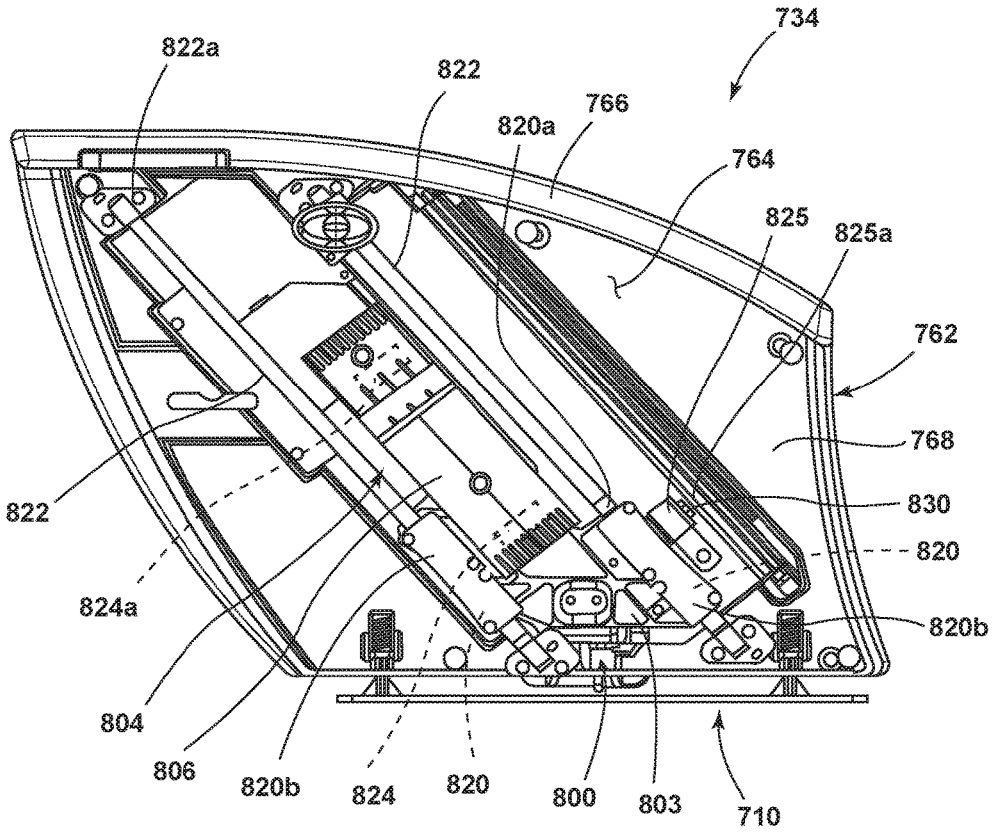
FIG. 52 is a similar view to FIG. 51 with the cover removed.
Figure 52A:
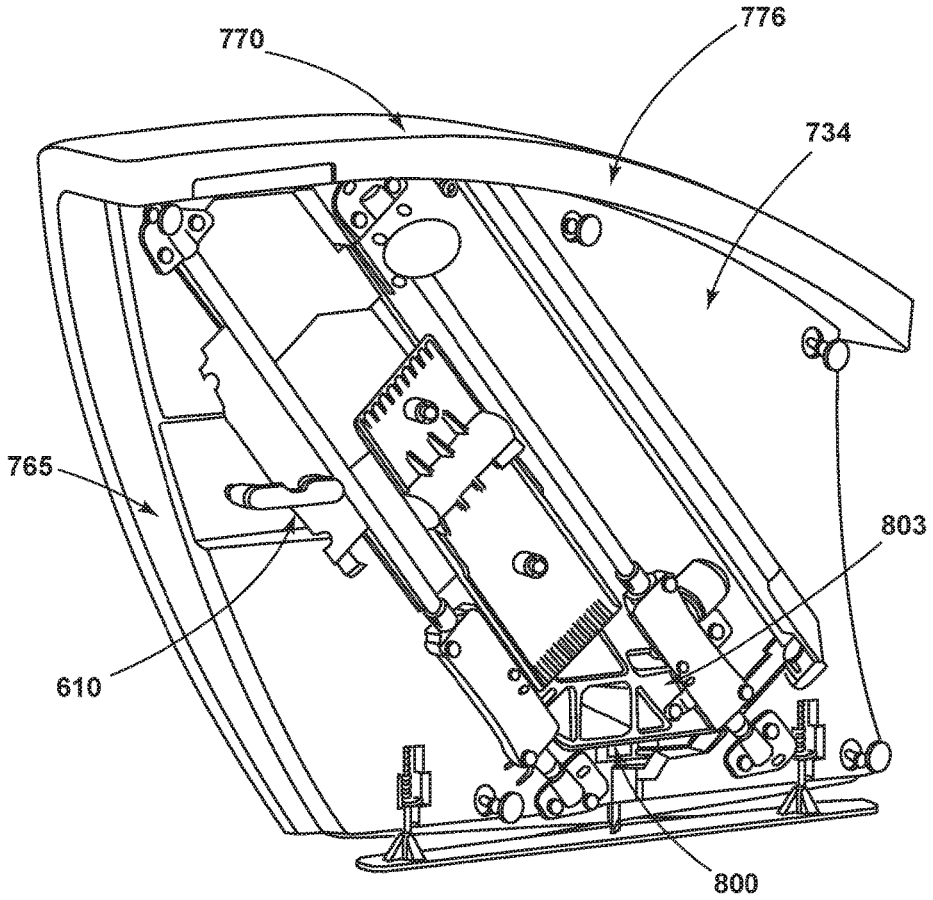
FIG. 52A is an enlarged perspective view of the arm rest with the cover removed.

Referring to FIGS. 47 and 47A, recliner chair 20 may also include a Foley bag hook 610 which may be mounted in arm rest 34 and further positioned adjacent to the forward edge of arm rest. Hook 610 may comprise a spring mounted hook that when pressed or released and moved to an open position, such as shown in FIG. 47A, and then returned to its stowed position, such as shown in FIG. 47, when pressed again. For example, hook 610 may include an over center spring or a push-push mechanism to allow it to be easily moved between retracted position and its operative position such as shown in FIGS. 47 and 47A. Alternately, Foley bag hook 610 may comprise a fixed loop, such as shown in FIGS. 51 and 52A in reference to arm rest 734.

Figure 48:
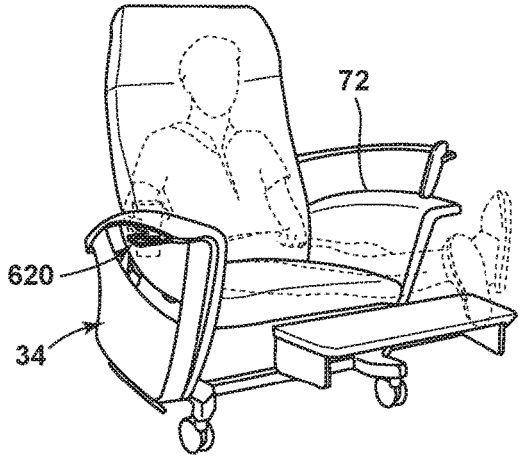
FIG. 48 is a perspective view of the chair illustrating a cup holder integrated to the arm rest.
Figure 48A:
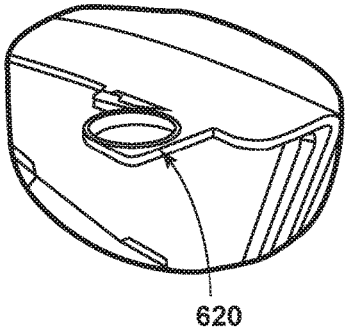
FIG. 48A is an enlarged perspective view of the cup holder of FIG. 48.

Referring to FIGS. 48 and 48A, arm rests 34 may incorporate a cup holder 620 which is pivotally mounted in arm rest 34 and optionally similarly mounted beneath arm rest cushion 72. Optionally, as shown in FIG. 48, cup holder 620 may be positioned between cushion 72 and mounting surface 70 and further may be mounted between an operative position, such as shown in FIGS. 48 and 48A, and a stowed position underneath cushion 72. For example, cup holder 620 may also incorporate over center spring mechanism to bias it between its stowed position and its operative position.

Figure 49:
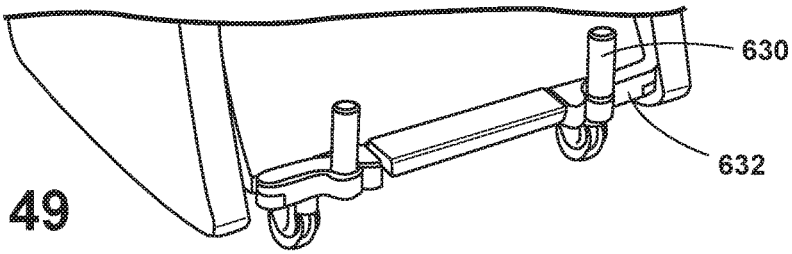
FIG. 49 is a rear perspective view of the base of the chair illustrating the brake bar and the IV pole mounts shown in contracted positions.
Figure 49A:
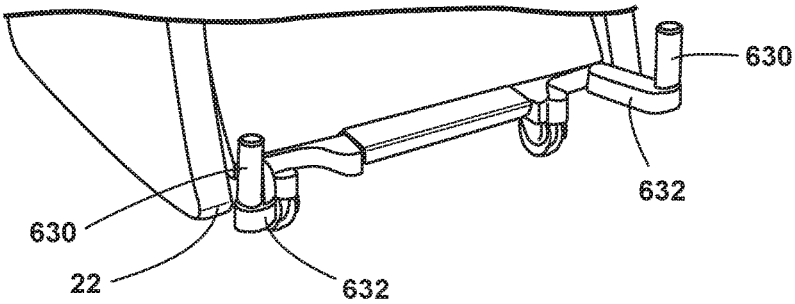
FIG. 49A is a rear perspective view of the base of the chair of FIG. 49 illustrating the IV pole mounts in extended positions.

Referring to FIGS. 49 and 49A, base 22 of apparatus 10 may incorporate one or more IV supports 630 with the back side of apparatus 10 adjacent to the brake pedal or bar such as shown in FIGS. 49 and 49A. Furthermore, apparatus 10 may incorporate a pair of IV poles 630, which are pivotally mounted to base 22 by arms 632 to allow the IV pole holders 630 to move between the extended position, such as shown in FIG. 49A, and a folded or contracted position, such as shown in FIG. 49. For example, each arm 632 may incorporate an over center spring which defines the fully retracted position and the stowed position.

Back shell 36*a* of backrest 36 may also have molded therein or joined therewith a handle 36*b* to facilitate movement of apparatus, and also a cord wrap structure to manage wires and or cabling.

Referring to FIG. 51, the numeral 734 designates another embodiment of an arm rest that may be mounted to chair 20. Similar to arm rests 34, arm rest 734 includes an arm rest body 762, which is formed, for example, from a web of material, such as sheet metal or plastic or a composite material, which includes a central web 764. Arm rest body may support a Foley hook 610 and a cup holder 620 both noted above. Mounted to the inwardly facing side of web 764 is an inwardly facing shell or cover 765, which may be formed from metal or plastic or a composite material. Cover 765 includes an upper flange 766 that extends along the upper edge of web 764 to form a mounting surface 770 for mounting an arm rest cushion (not shown). Arm rest 734 also includes an outwardly facing cover or shell 775, which together with cover 765 and web 764, form a cavity for housing a locking mechanism 804 for the arm rest and also an obstruction sensor assembly 710 described below.

Figure 54:
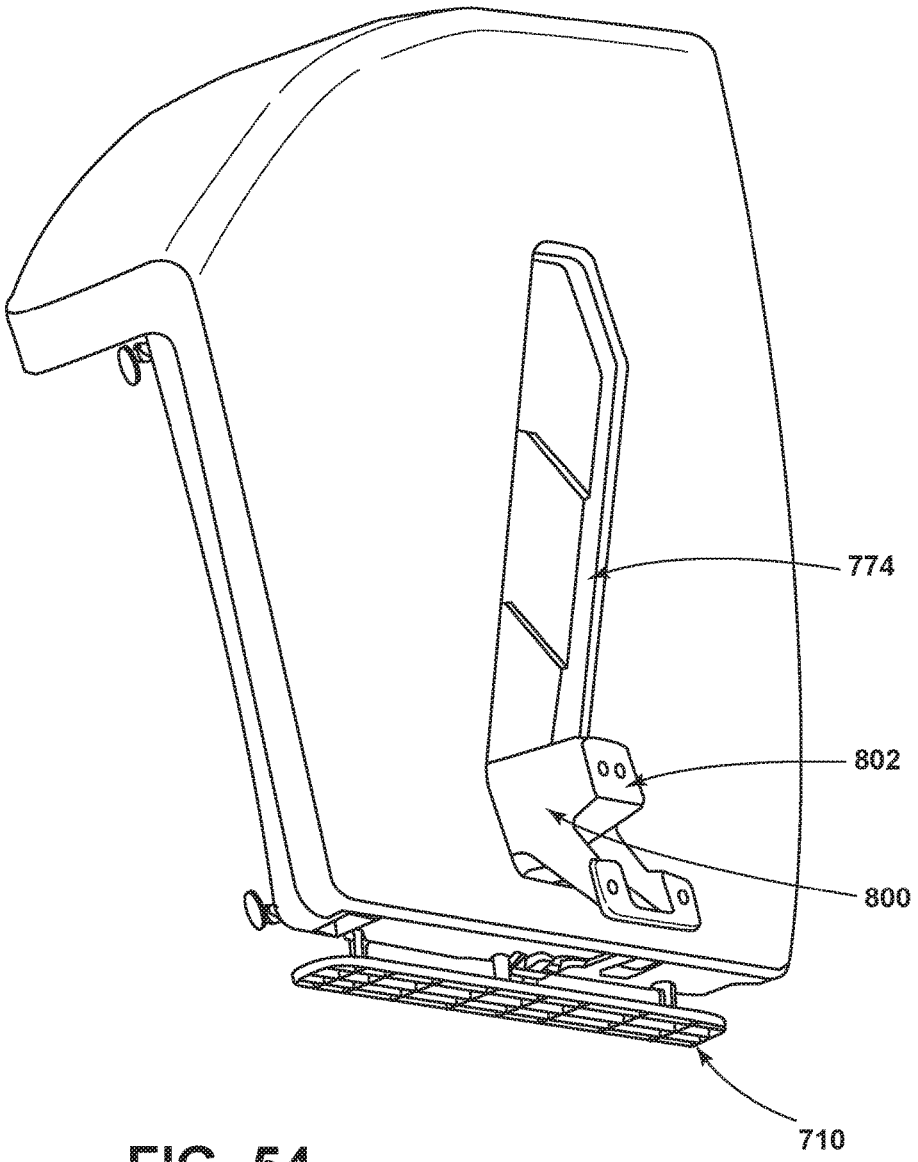
FIG. 54 is an enlarged perspective view of the inwardly facing side of the arm rest.

Arm rest 734 is mounted to the chair chassis (e.g. chassis 26 described above) by a slide mount 800 (FIGS. 52, 52A, ad 52B). Mount 800 includes a bracket 802 (which may be integrally formed with body or comprise a separate bracket which is then secured to mount 800), which extends through a slotted opening 774, formed in web 764 and cover 765 (FIG. 54) to mount arm rest 734 to the chassis. Mount 800 includes a mounting body 803, which may be formed from an extrusion, and which includes a pair of channel or tubular members 820 that slidably mount to a pair of guide rods 822. Rods 822 are mounted at their opposed ends to web 764 by brackets 822*a* so that they remain fixed relative to web 764. For example, channel members 820 may support bushings 820*a* which slidably mount to rods 822 and which are secured to channel members 820 via mounting plates 820*b*. Thus, arm rest body 762 can move up and down with respect to the chassis. In the illustrated embodiment, rods 822 form a linear slide so that when raised, arm rest(s) 734 move upward and away from the seat section of the chair (or upward and forward relative for a person seated in the chair).

Figure 52B:
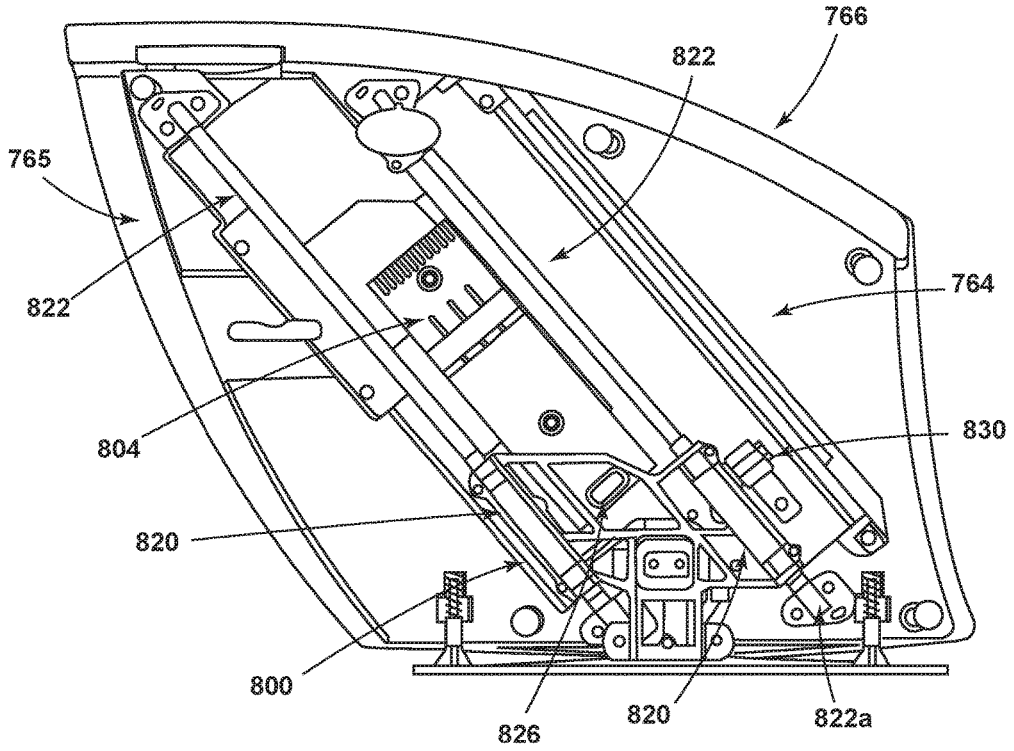
FIG. 52B is another enlarged view of the arm rest with the cover removed with a partially fragmentary view to reveal to slide mount.

Also mounted in cavity 768 is a locking mechanism 804 for locking the position of the arm rest with respect to the slide mount. Locking mechanism 804 includes a body 806, which is mounted to central web 764 of arm rest 734 by fasteners, such as pins, which allow body 806 to move relative to web 764 as described below. Optionally, on or both of the pins may support a spring or springs to bias body 806 in a desired position. Body 806 includes at least one recess 824 (FIG. 52) for receiving a projection 826 (FIG. 52B) formed on body 803 of slide mount 800. In this manner, when projection 826 is received in recess 824, arm rest 734 will be locked in position. To release engagement, body 806 is coupled to a handle 808, which is accessible at cover 775. When pulled, handle 808 pulls body 803 toward the inwardly facing side of cover 775, which disengages projection 826 from recess 824. As noted above, body 806 may be biased, for example, toward slide mount 800 so that the force on the handle need only be sufficient to overcome the bias force of the spring or springs.

Optionally, body 806 includes at least a second recess 824*a* (FIG. 52), for example, near or at its opposed end to define a second locked position when projection 826 is extended into the second recess. Similarly, when pulled, handle 808 will again pull body 803 toward the inwardly facing side of cover 775, which disengages projection 826 from the second recess 824*a*.

Also mounted in cavity 728 is an optional spring 825 to provide an assist by reducing the apparent weight of the arm rest. In the illustrated embodiment, spring 825 comprises a constant force spring. For example, spring 825 may be formed from a rolled ribbon of metal, typically spring steel, which is secured on one end to the web 764, for example by a fastener, and then coiled at its opposed end about a sleeve 825*a*, which is then coupled to mount 800. For example, mount 800 may include a projecting member 830, such as projecting rod, which extends into and rotatably mounts the sleeve to mount 800 so that the second end of the coil is free to uncoil or recoil as mount 800 moves relative to rods 822. The spring is therefore relaxed when it is fully rolled up. As it is unrolled, a restoring force is generated. Thus, when arm rest 734 is translated along mount 800, spring 824 will generate resistance to reduce the apparent weight of arm rest 734.

Figure 50:
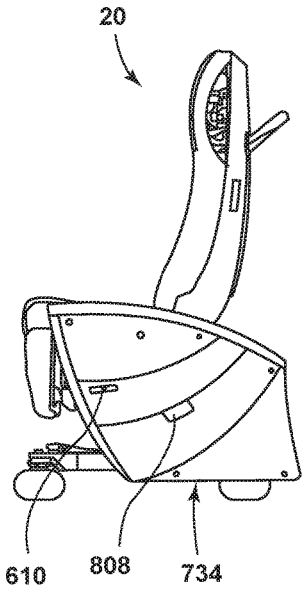
FIG. 50 is a side elevation view of another embodiment of a chair illustrating the arm rests in a lowered position.
Figure 50A:
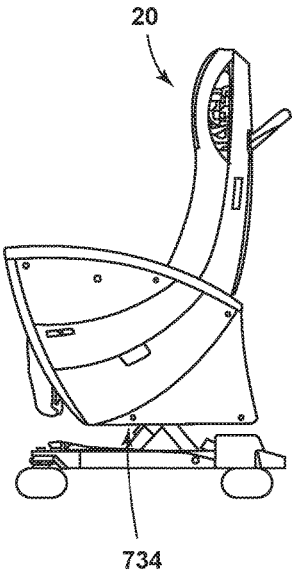
FIG. 50A is a side elevation view of the chair of FIG. 50 showing the arm rests in an intermediate position.
Figure 50B:
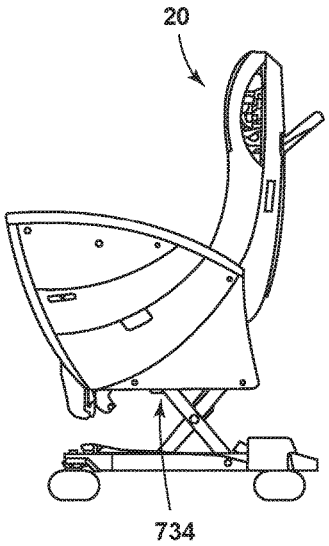
FIG. 50B is a side elevation view of the chair of FIG. 50 showing the arm rests in a raised position.

Referring to FIGS. 50, 50A, and 50B, when arm rest 734 is raised, arm rest 734 moves forward and upward (or away from the seat section), which allows a patient to support themselves on the forward portion of the arm rest to facilitate their transition between a sitting and standing position. Furthermore, because of the curved shape of the arm rest, the arm rest pad (which could extend along the full length of flange 766) provides support for a person when seated in support apparatus 10 when in a seated configuration but also provides similar support to the patient when the patient has been moved by the articulation of the seat to its sit-to-stand position and provides a higher support surface for the patient, again such as shown in FIG. 50B.

Figure 53:
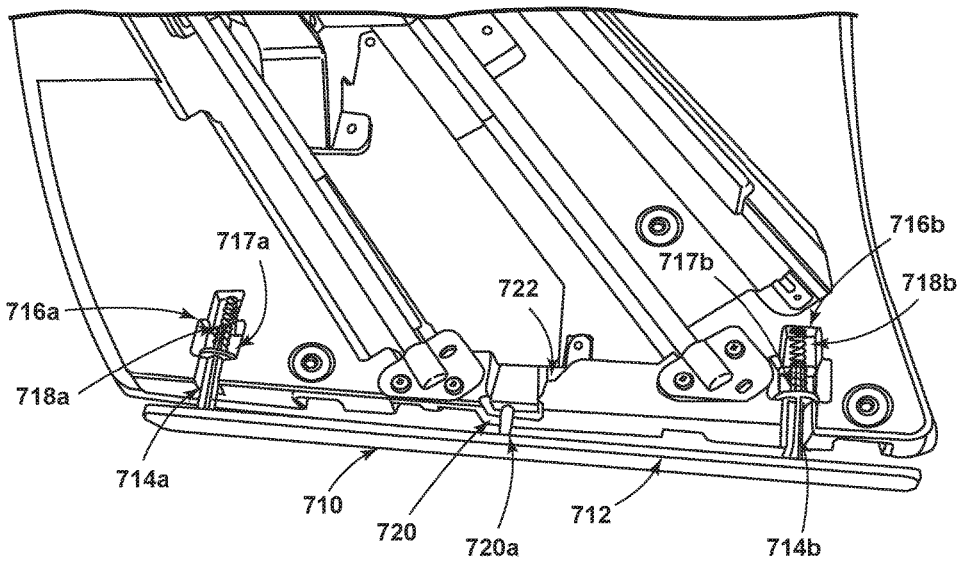
FIG. 53 is an enlarged view of the obstruction sensor assembly.

Referring to FIG. 53, the numeral 710 designates another embodiment of a safety mechanism which may be incorporated into the arm rests. Safety mechanism 710 is configured as an obstruction detection system and acts as a sensor that is in communication with controller 82 described above (and shown in FIG. 28) to interrupt or stop downward motion of the chair when an obstruction is detected.

In the illustrated embodiment, safety mechanism 710 includes a transverse member 712, for example a bar or rod, including a plastic bar or rod, which is mounted to the lower end of a respective arm rest. Optionally transverse member 712 extends the along the entire length of the lower end of the arm rest and further may be relatively flexible so that is will deflect, as will be more fully explained below. Transverse member 712 includes a pair of upwardly extending arms or guides 714*a* and 714*b*, which extend into recesses 716*a* and 716*b* provided at the lower end of arm rests 734, for example, at the lower edge of central web 764. Upwardly extending arms 714*a* and 714*b* include flanges 717*a* and 717*b* that retain arms 714*a* and 714*b* in recesses 716*a* and 716*b*. Recesses 716*a* and 716*b* are each shaped to include a shoulder on which flanges 717*a* and 717*b* rest when transverse member 712 is in its lowermost position relative to the respective arm rest. Also located in recesses 716*a* and 716*b* are springs 718*a* and 718*b*. Springs 718*a* and 718*b* bias transverse member 712 in a downward direction and are optionally mounted about the upper ends of arms 714*a* and 714*b* above flanges 717*a* and 717*b* so that they are captured between the top of the recesses (as viewed in FIG. 15A) and the upper sides of flanges 717*a* and 717*b*.

Figure 56:
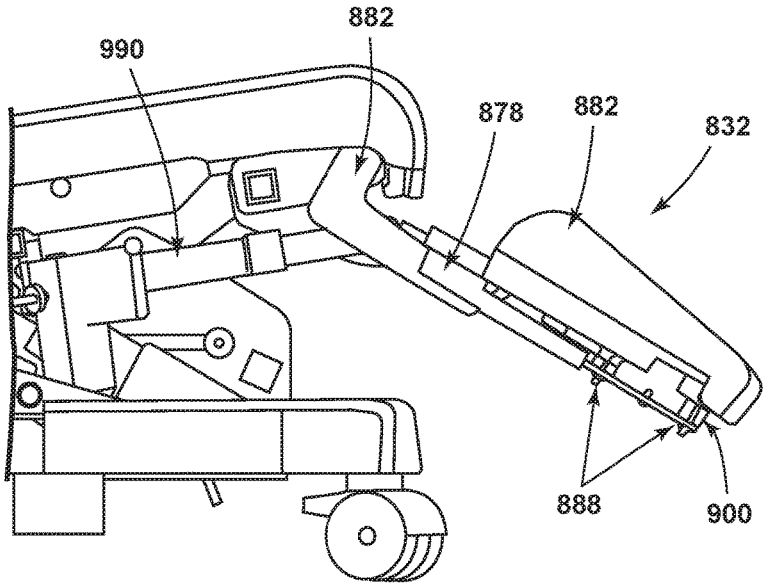
FIG. 56 a side elevation view illustrating the leg rest in a partial extended position.
Figure 57:
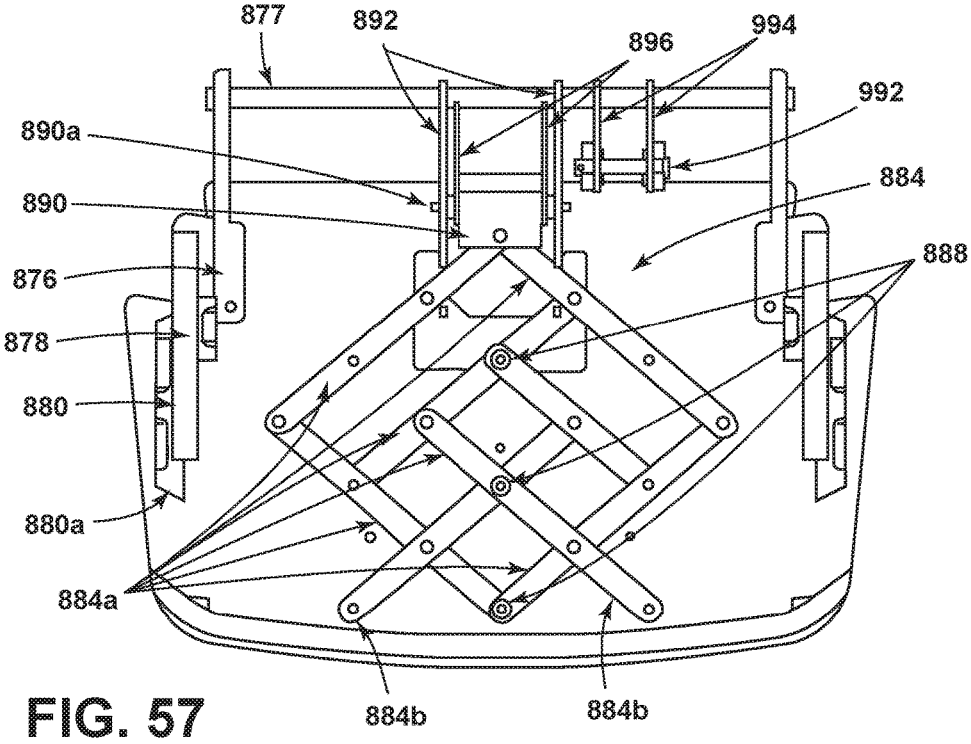
FIG. 57 is a bottom plan view of the leg rest in FIG. 56.
Figure 58:
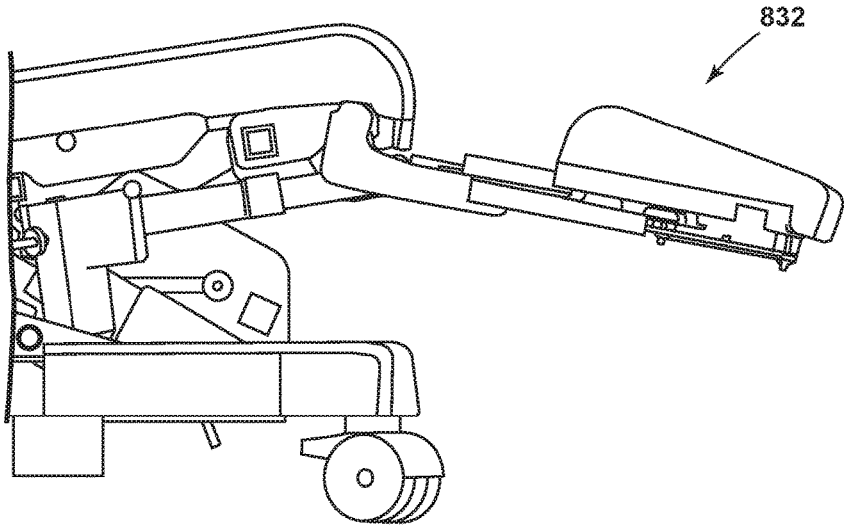
FIG. 58 is a perspective fragmentary view of another embodiment of the chair base and braking system.
Figure 59:
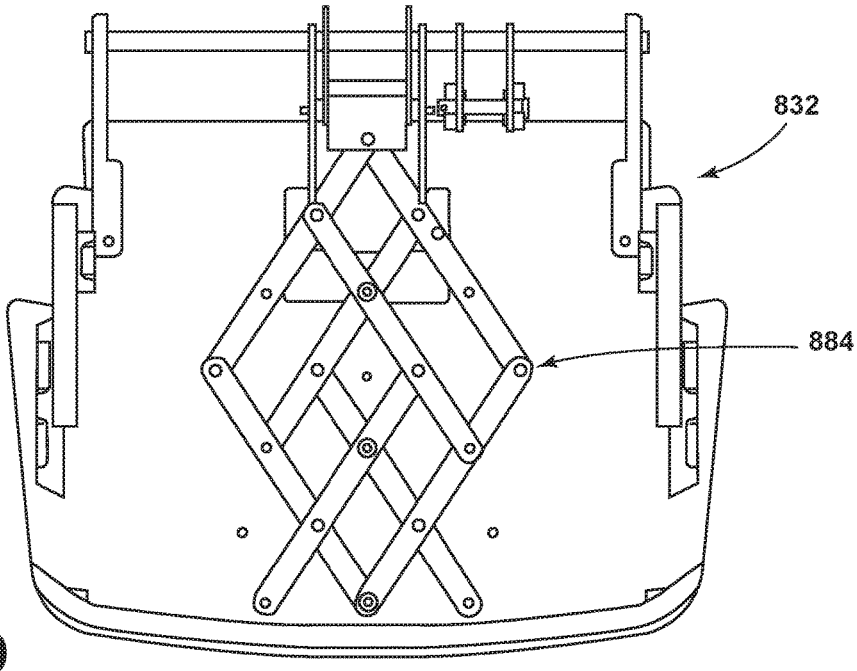
FIG. 59 is a bottom plan view of the leg rest in FIG. 58.
Figure 60:
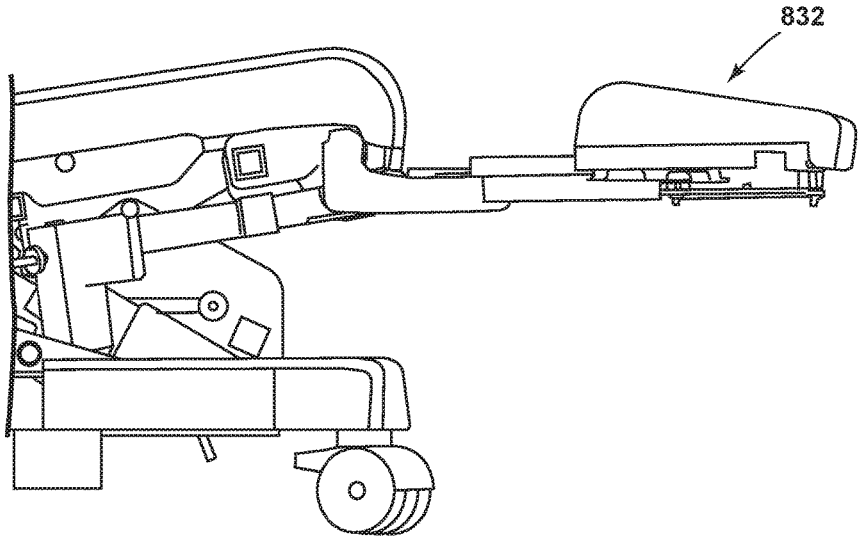
FIG. 60 a side elevation view illustrating the leg rest in a fully extended position.
Figure 61:
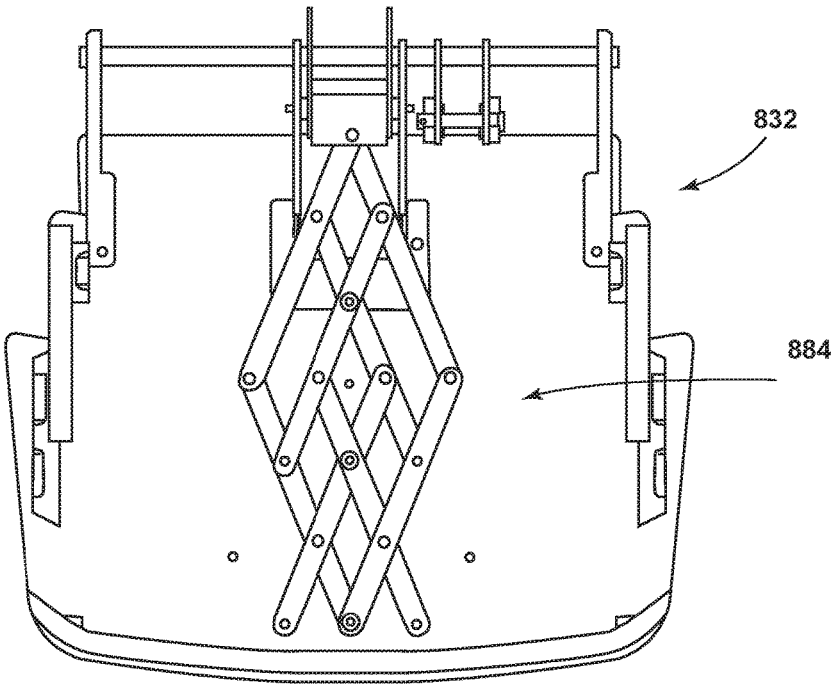
FIG. 61 is a bottom plan view of the leg rest in FIG. 60.

Similarly, when actuator 90 contracts its driving end, actuator will pull on rod 992, which will cause section 870 to pivot in a clockwise direction about rod 877 (as view in FIGS. 56, 58, and 60). As section 870 is pivoted downwardly, linkages 896, which are of fixed length and pinned to the seat frame, will push on plate 890, which will in turn push on the scissor mechanism causing it to contract and shorten and pull on sections 872 and 874. When scissor mechanism 884 is contracted, each of the overlapping sections are then pulled into their respective retracted overlapping configuration with section 874 straddling each of the intermediate and inner most sections (872 and 870).

Figure 55:
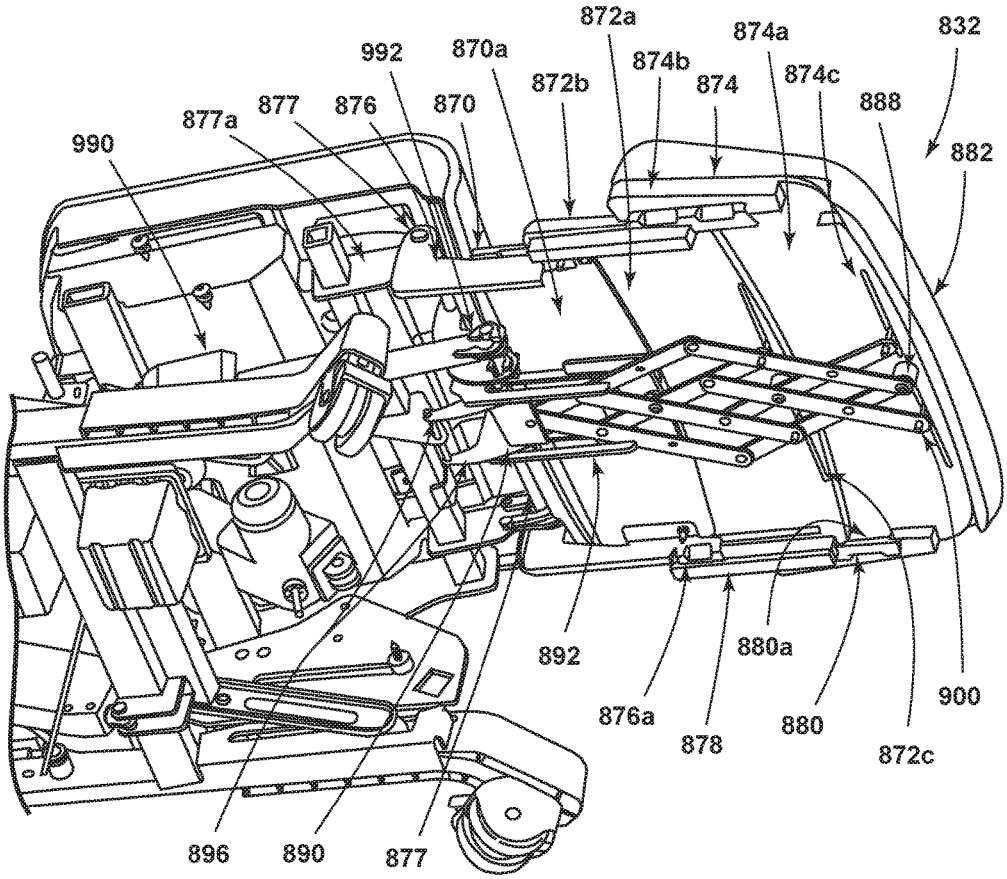
FIG. 55 is an enlarged bottom perspective view of another embodiment of the leg mechanism shown in a fully extended position.

Referring again to FIG. 55, to facilitate expansion and contraction of scissor mechanism 884, scissor mechanism 884 may include guide posts 900 at the distal end of linkages 884*b* and at intermediate linkage pivot points, which extend into slotted grooves 872*c* and 874*c* formed at the underside of sections 872 and 874 to thereby guide the extension or contraction of scissor mechanism 884.

Figure 62:
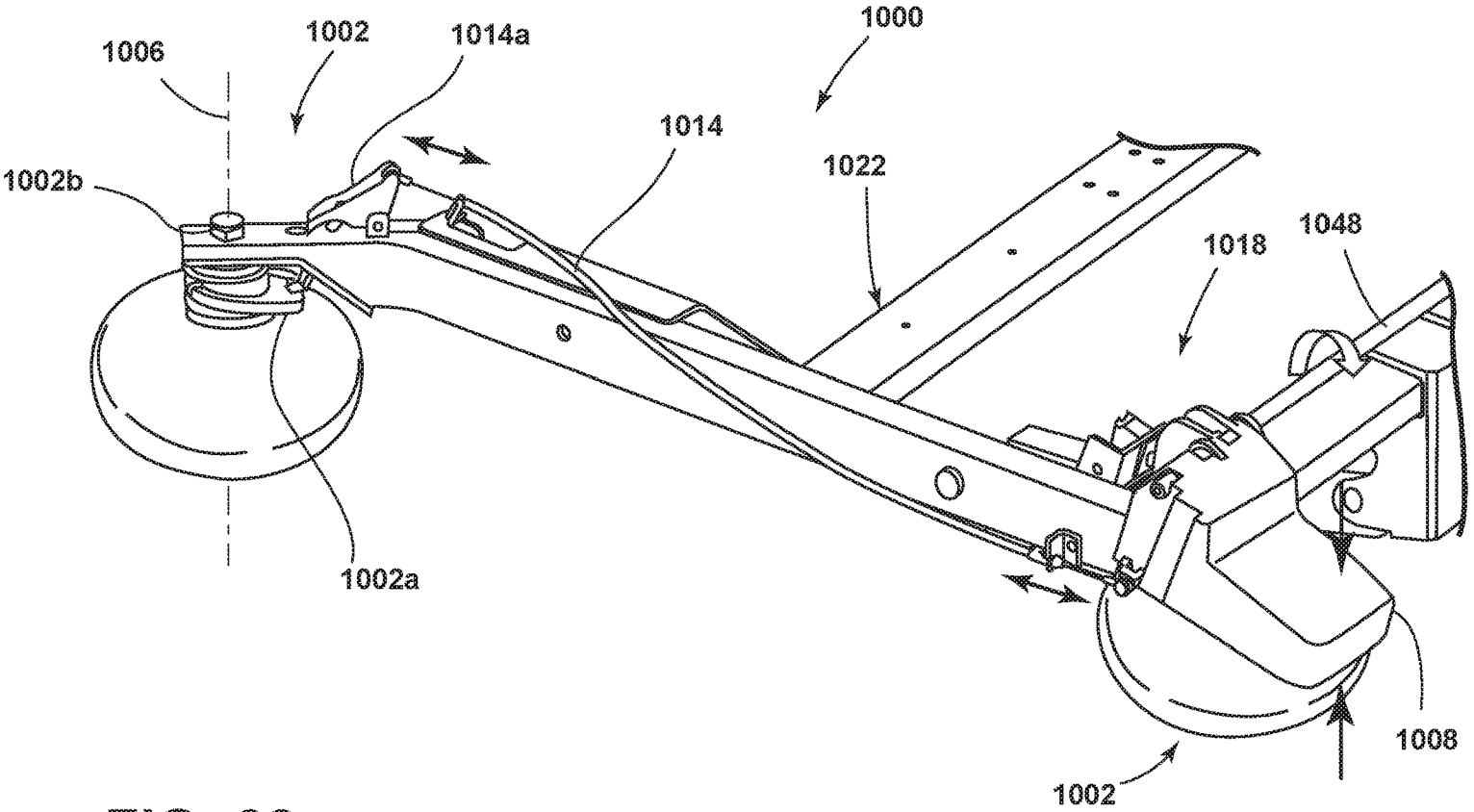
FIG. 62 is a perspective fragmentary view of another embodiment of the chair base and braking system.

Referring to FIG. 62-67, the numeral 1000 designates another embodiment of a braking system of the present invention. In the illustrated embodiment, braking system 1000 is configured to brake all the caster wheels 1002, which are mounted to chair base 1022 (which is similar to chair base 22), from either rear corner of the chair using a single pedal 1008 or alternately based on input from the control system 78, described above. Each wheel 1002 is configured to be able to rotate about its generally horizontal wheel axis and, further, each wheel is configured to be able to swivel about a generally vertical swivel axis 1006 (FIG. 62). When actuated, braking system 1000 prevents all four wheels 1002 from both rotating about their respective horizontal wheel axes and swiveling about their respective vertical swivel axes 1006. Actuating brake system 1000 therefore effectively immobilizes patient support apparatus 10 from movement across the floor in any direction.

Wheels 1002 are available from Fallshaw and will, therefore, not be described in great detail herein other than referencing that each wheel includes a mechanical brake actuator 1002 that when pushed downward actuates the caster brake (not shown) and a mounting post 1002*b*, which mount the wheels to base 1022. Reference is made to U.S. Pat. No. 8,203,297 for further details of caster wheel and its brake, which patent is incorporated by reference herein in its entirety.

Figure 63:
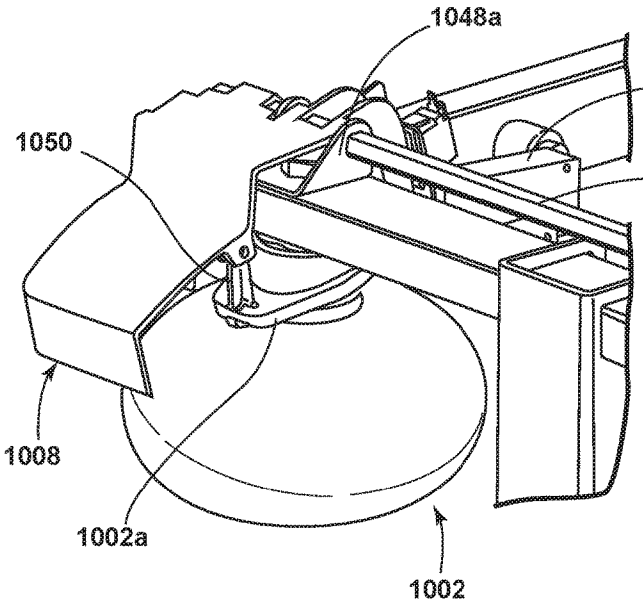
FIG. 63 is an enlarged perspective view of one of the rearward wheels and brake pedal of the braking system.
Figure 64:
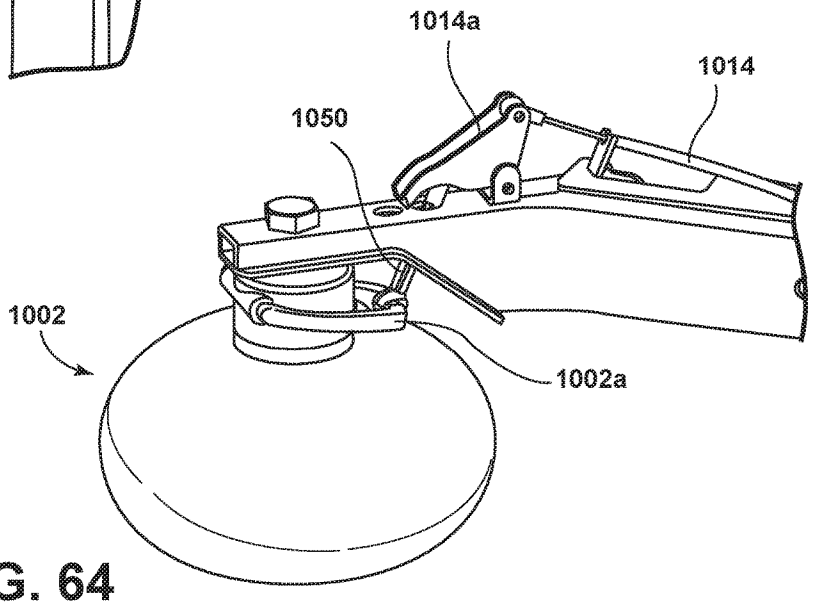
FIG. 64 is an enlarged perspective view of the forward wheel and cable of the braking system.
Figure 65:
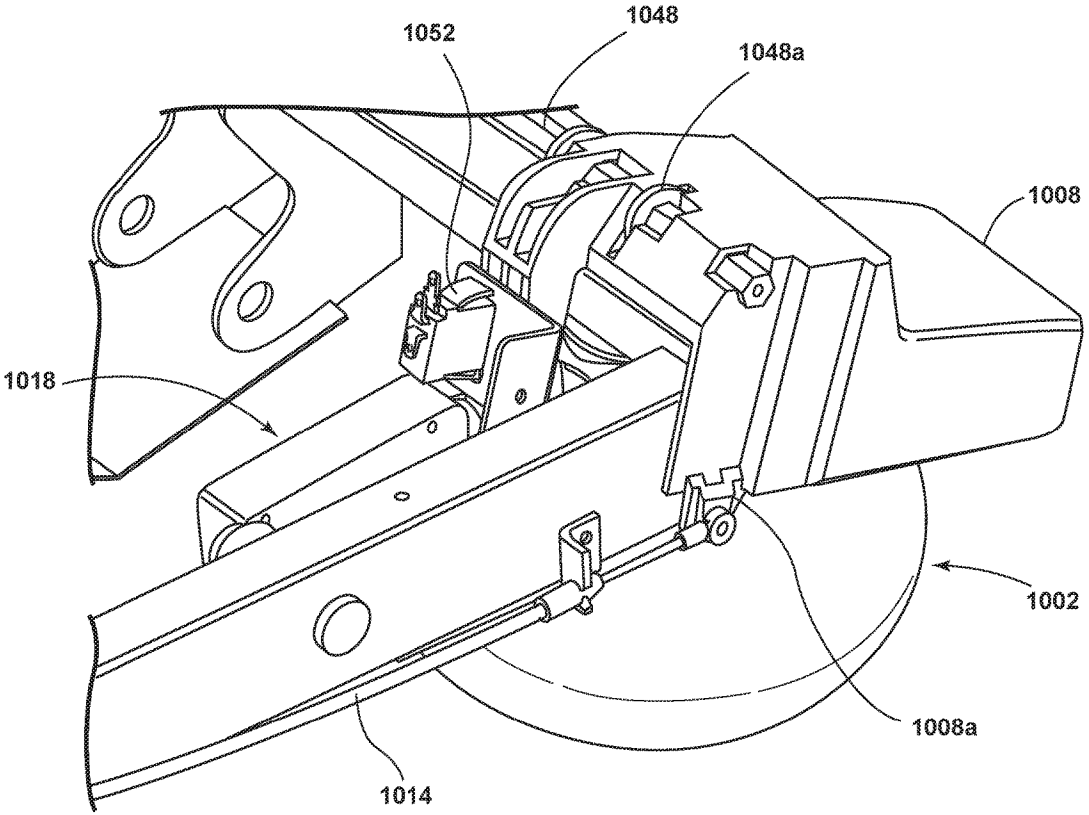
FIG. 65 is another enlarged perspective view of one of the rearward wheels and brake pedal of the braking system.

Referring to FIGS. 62-64, in addition to brake pedals 1008 on both its rear wheels, brake system 1000 includes a pair of mechanical cables 1014 (e.g. Boden cables) that extend along each side of the base between the respective wheels on that side of the base. For further details of how the cables operate reference is made above to mechanical cables 1014. Brake pedals 1008 are optionally positioned near the back rear side of the patient support apparatus where they do not interfere with the ingress and egress of a patient into and out of the patient support apparatus. Each cable 1014 is coupled to the mechanical brake actuator 1002 of its respective wheel. For example, in the illustrated embodiment, each cable 1014 is coupled to the forward wheel via a bracket 1014*a* and to the rearward wheel via pedal 1008. Each bracket 1014*a* is in turn coupled to its respective mechanical brake actuator 1002 via links or struts 1050. Pedals 1008 are similarly coupled to their respective mechanical brake activators 1002 via links or struts 1050. In this manner, when a pedal 1008 is pressed downwardly, its strut 1050 will press downwardly on its corresponding mechanical brake actuator 1002 and its corresponding cable will push on its bracket 1014*a* to push down on its corresponding mechanical brake actuator 1002 to brake the corresponding forward wheel. Similar, when pedal 1008 is listed up (as viewed in FIG. 62), its cable will pull on its bracket 1014*a* to lift its mechanical brake actuator 1002 to unbrake the corresponding forward wheel.

Referring to FIG. 63, brake pedals 1008 are both mounted to a transverse rod 1048, such as a hex rod, which is supported on base 1022 by mounting brackets 1048*a*, so that when a user pushes down on one pedal, the rod transfers the rotary motion to the other rearward pedal, so that both rearward wheels are braked. As described above, the downward motion of either rearward pedal will induce the cables 1014 to push on their respective brackets 1014*a*, which push down on mechanical brake activators 1002.

Figure 66:
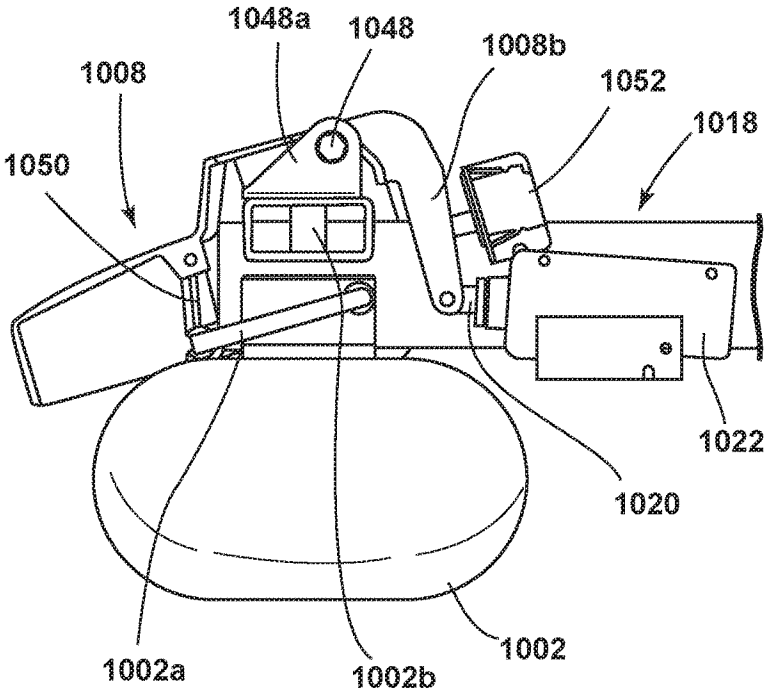
FIG. 66 is a side elevation of a rearward wheel showing the wheel in a braked configuration.
Figure 67:
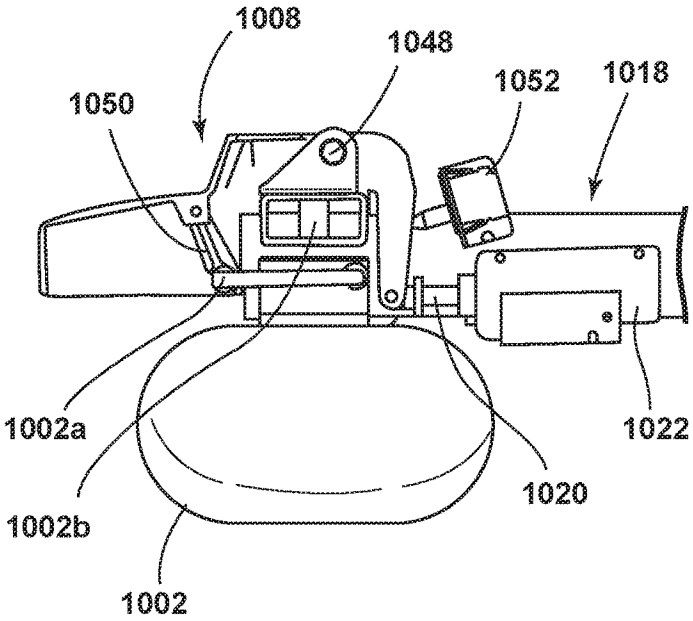
FIG. 67 is a side elevation of a rearward wheel showing the wheel in an unbraked configuration.

As best seen in FIGS. 63 and 64, each pedal 1008 includes a mounting structure 1008 coupling the end of the cable 1014 to the pedal. Further, as best seen in FIGS. 66 and 67, each pedal 1008 optionally may be electrically driven by an electrically powered actuator 1018. For example, in the illustrated embodiment, electrically powered actuator 1018 comprises a linear actuator. A suitable actuator may be a solenoid or a center-lock actuator with an extendable and retractable plunger or shaft 1020 that selectively extends out of, and retracts into, a body 1022, which is controlled by controller 82, based on input at the chair (e.g. based on user input) or based on signals generated at the chair (e.g. based on lack of motion or a certain configuration of the chair being selected). The distal end of shaft 1020 is coupled to an arm 1008*b* of bracket 1008 so that when shaft 1020 extends out of, and retracts into, body 1022 (which remains generally stationary with respect to base 1022), the movement of shaft 1020 causes pedal 1008 to pivot, which intern induces rotary motion of rod 1048 and actuating of the other rearward pedal.

In addition, braking system, 1000 may incorporate a sensor 1052, which is in communication with controller 82, to detect the status of the brakes, for example when the brakes are engaged. As described above, controller 82 may use this information to generate other signals or to disable signals or provide indications, for example, at the control panel to provide visual or audible feedback to the user that the brakes are engaged.

FIGS. 68-72 illustrate various components of a chair 1220 according to another embodiment. Any one or more of the components of chair 1220 shown in FIGS. 68-72 may be incorporated into any of the other chair embodiments disclosed herein. Further, any of the chair components that are not shown in FIGS. 68-72, but that are shown or described elsewhere herein, can be added to the chair 1220, such as, but not limited to, for example, the arm rests 34. Those components of chair 1220 that are the same as the components previously described in other chair embodiments are labeled with the same reference number and operate in the same manner as has been described herein. Those components that have been modified from the previously described components are labeled with a reference number having the same last two digits but increased into the 1200s. Those components that are new have been given a new number in the 1300s.

Figure 68:
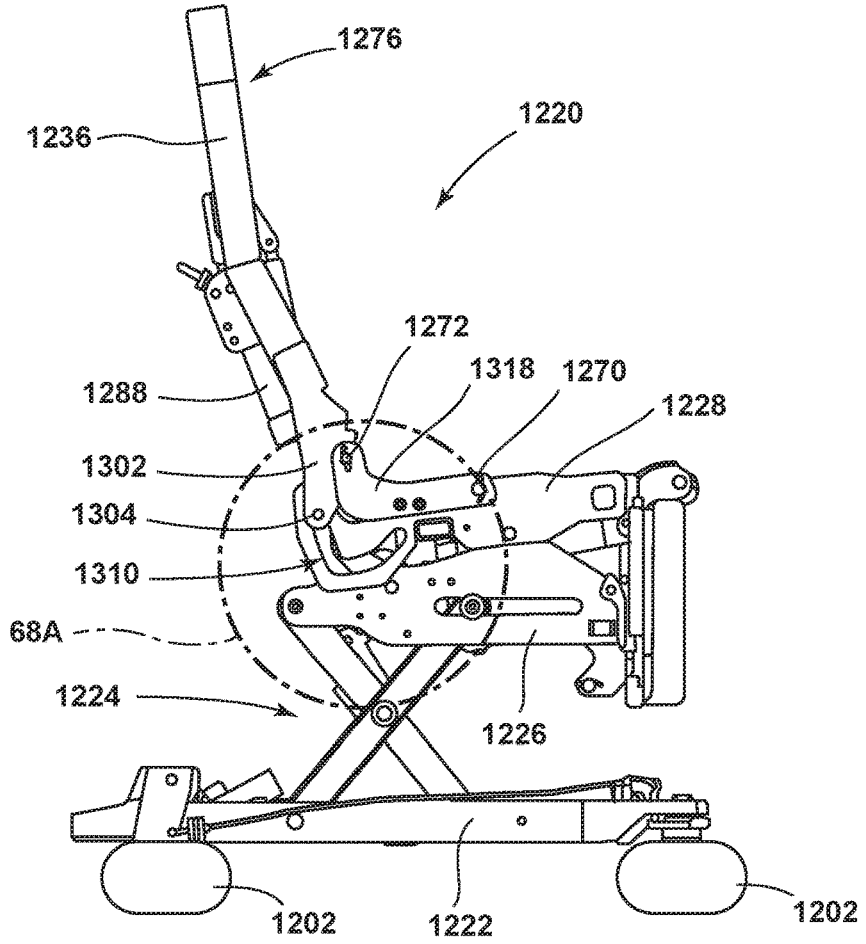
FIG. 68 is a side elevational view of the seat frame, backrest, chassis, lift mechanism, and base according to another embodiment, the backrest being shown in a generally upright position.
Figure 68A:
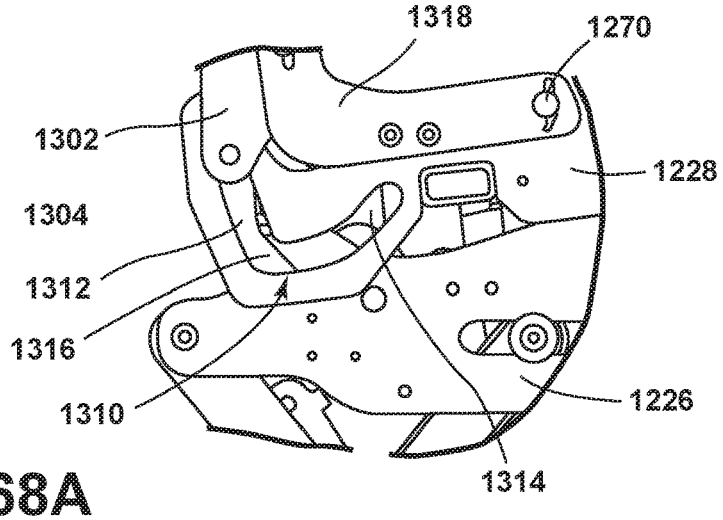
FIG. 68A is an enlarged view of the section labeled "A" in FIG. 68.
Figure 69:
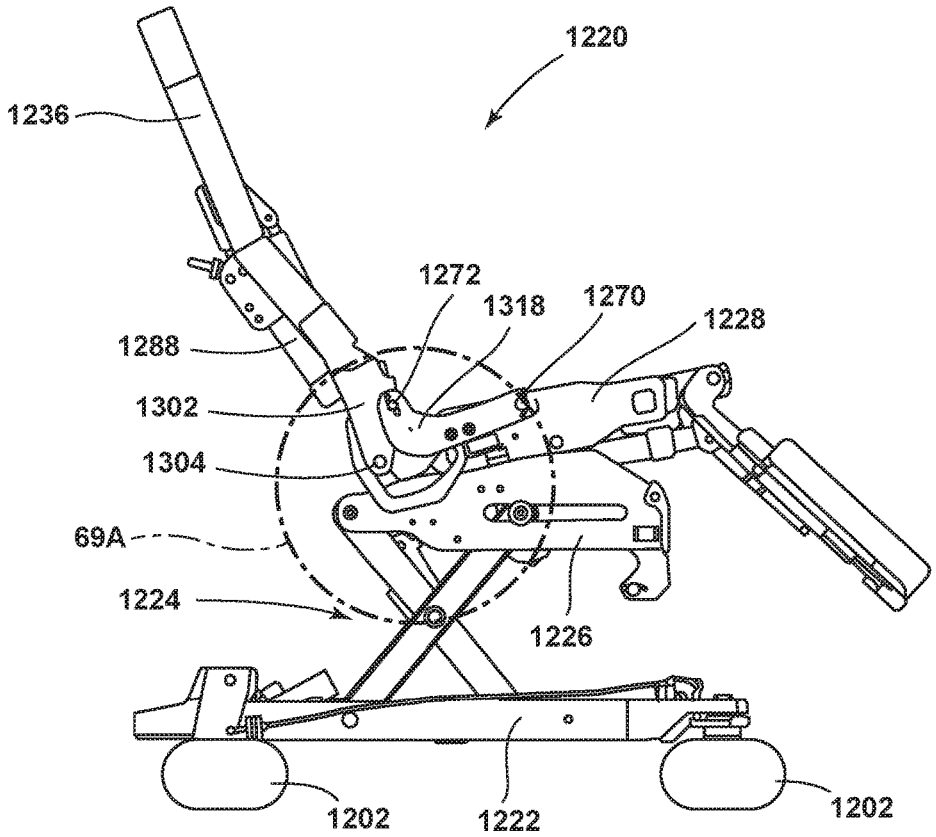
FIG. 69 is a side elevational view of the components of FIG. 68 shown with the backrest tilted backwards from the position shown in FIG. 68.
Figure 69A:
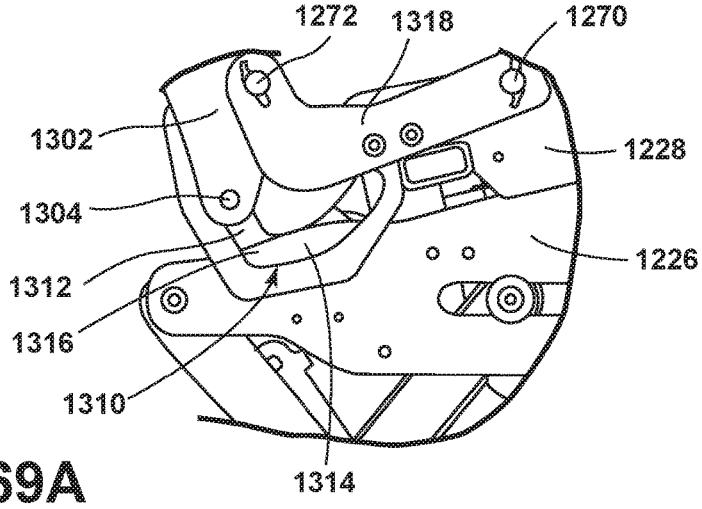
FIG. 69A is an enlarged view of the section labeled "B" in FIG. 69.
Figure 70:
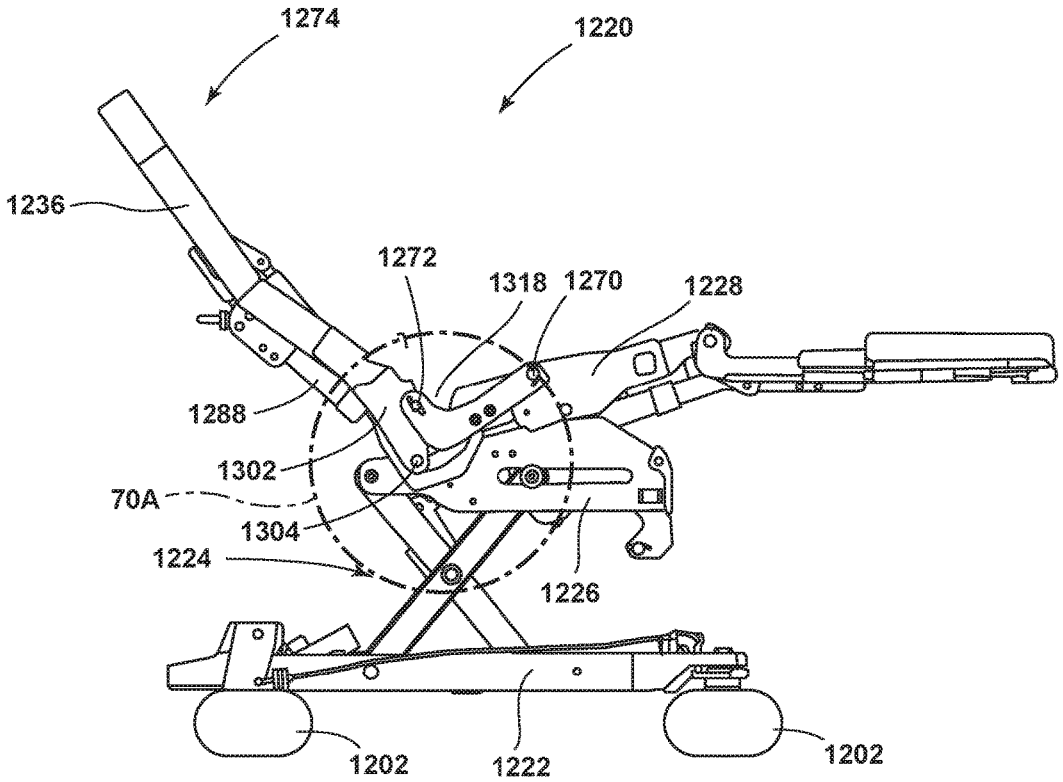
FIG. 70 is a side elevational view of the components of FIG. 68 shown with the backrest tilted backwards from the position shown in FIG. 69 to an intermediate position.
Figure 70A:
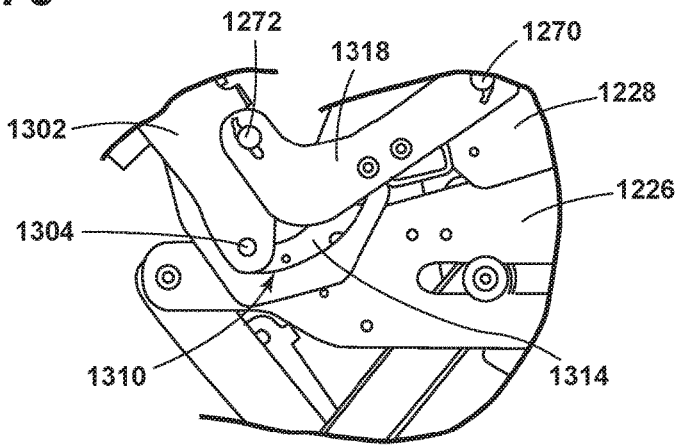
FIG. 70A is an enlarged view of the section labeled "C" in FIG. 70.
Figure 71:
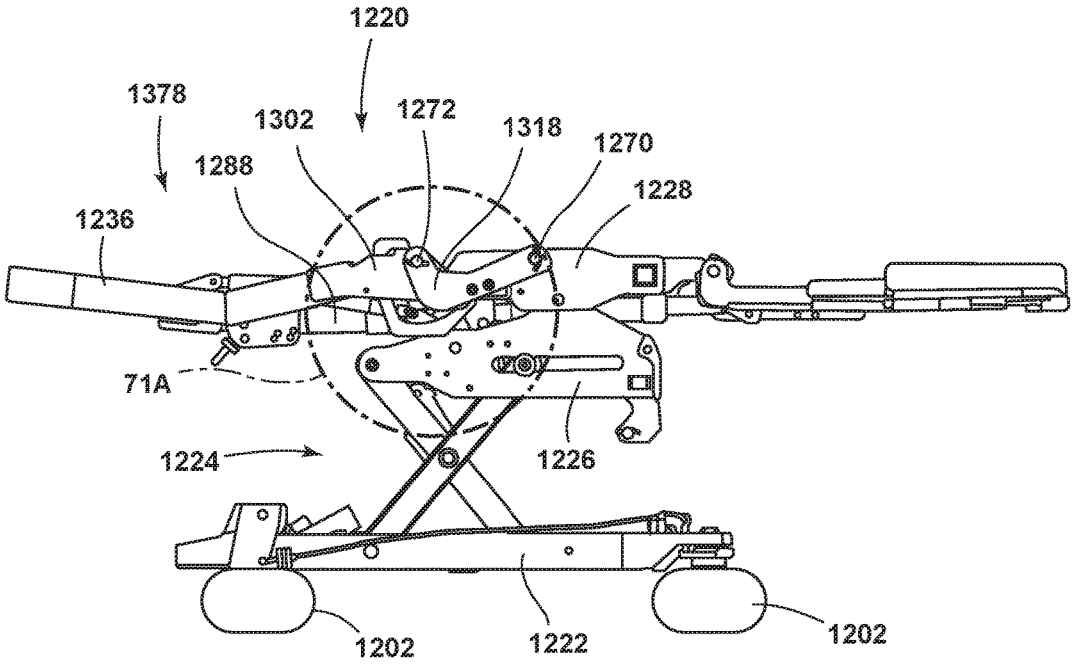
FIG. 71 is a side elevational view of the components of FIG. 68 shown with the backrest tilted backwards from the position shown in FIG. 70 to a lowered position.
Figure 71A:
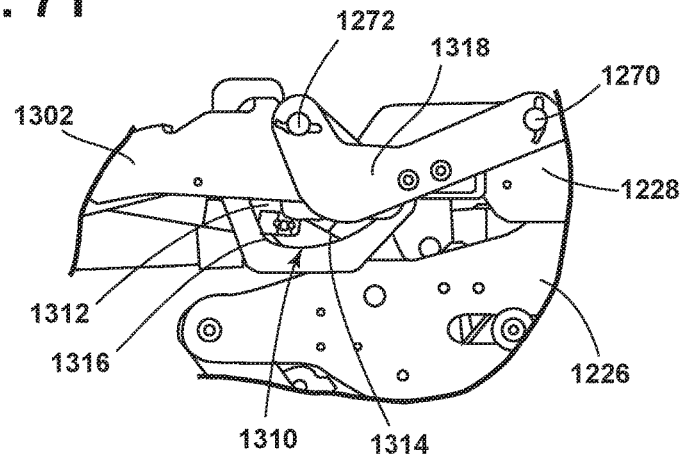
FIG. 71A is an enlarged view of the section labeled "D" in FIG. 71.

FIGS. 68-71 collectively illustrate the motion of a backrest 1236 as it tilts backward from an upright position 1276 shown in FIG. 68 to a lowered position 1378 shown in FIG. 71. When backrest 1236 initially tilts backwards from the upright position 1276 of FIG. 68, backrest 1236 pivots with respect to a seat frame 1228 about a first pivot axis 1270. As backrest 1236 continues its backward movement, it eventually reaches an intermediate position 1274 shown in FIG. 70. At intermediate position 1274 backrest 1236 transitions from pivoting with respect to seat frame 1228 about first pivot axis 1270 to pivoting with respect to seat frame 1228 about a second pivot axis 1272. From intermediate position 1274 all the way down to lowered position 1378, backrest 1236 pivots with respect to seat frame 1228 about second pivot axis 1272. When backrest 1236 pivots with respect to seat frame 1228 about first axis 1236, backrest 1236 does not simultaneously pivot with respect to seat frame 1228 about second pivot axis 1272, and vice versa. In other words, the pivoting of backrest 1236 with respect to seat frame 1228 is exclusively done about first or second pivot axes 1270 or 1272, but never both at the same time.

Figure 72:
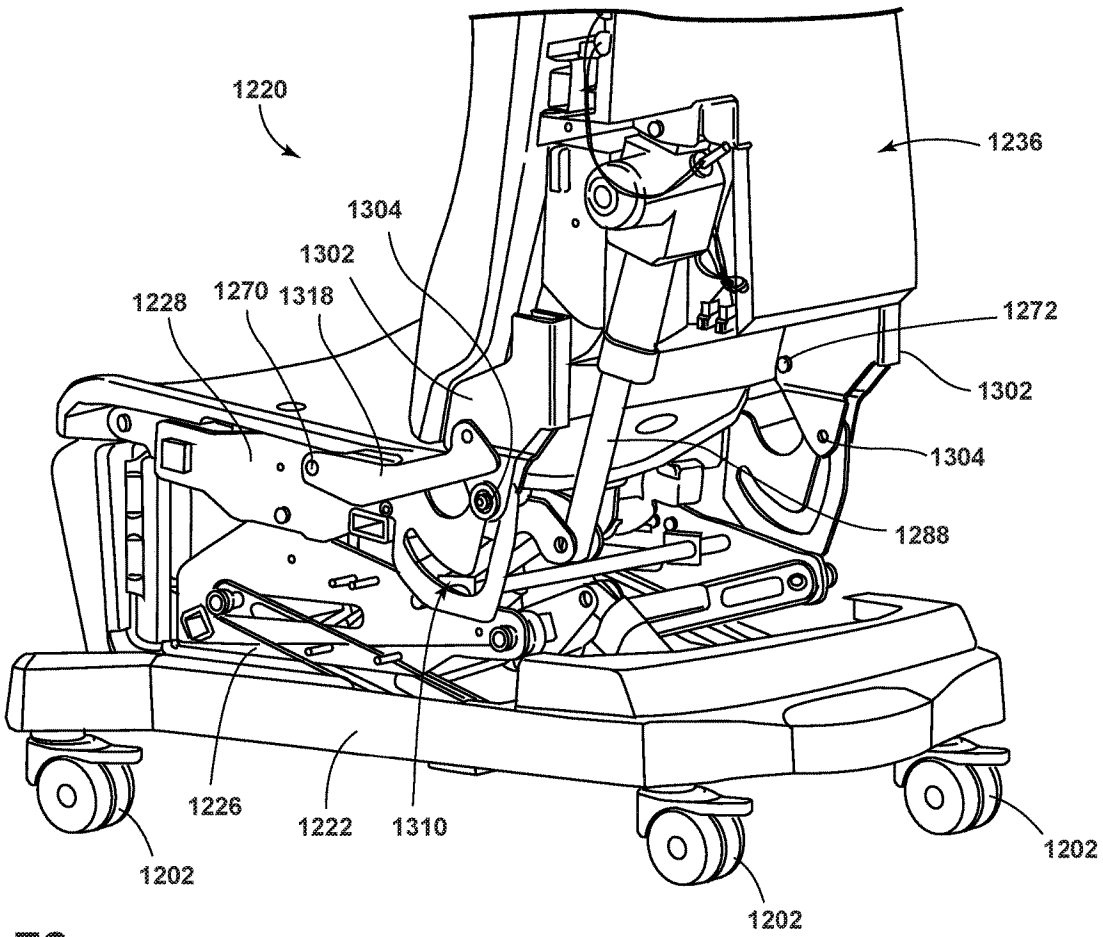
FIG. 72 is a rear perspective view of the seat frame, backrest, chassis, lift mechanism, and base of FIG. 68.

The pivoting of backrest 1236 is carried out automatically by a backrest actuator 1288. Backrest actuator 1288 is pivotally coupled at a first end to backrest 1236 and at a second end to seat frame 1228 (FIG. 72). Backrest actuator 1288 is configured to move under the control of controller 82. Backrest actuator 1288 moves between an extended position shown in FIGS. 68 and 72 in which the backrest is in the upright position 1276, and a retracted position shown in FIG. 71 in which the backrest is in the lowered position 1378. The extension and retraction of backrest actuator 1288 carries out the pivoting of backrest 1236 with respect to seat frame 1228 about first pivot axis 1270 as well as second pivot axis 1272. That is, backrest actuator 1288 is responsible for the pivoting movement of backrest 1236 about both of these axes 1270 and 1272.

The transition between pivot axes 1270 and 1272 is accomplished through mechanical structures that will now be described in greater detail. Backrest 1236 includes a pair of backrest brackets 1302 fixedly coupled thereto (FIGS. 68-72). A first one of the backrest brackets 1302 is coupled to a first rear side of backrest 1236 and a second one of the backrest brackets 1302 is coupled to a second rear side of backrest 1236 (FIG. 72). Each backrest bracket 1302 supports a bearing 1304 that is adapted to slide or otherwise move within a corresponding channel 1310 defined in each side of seat frame 1228. Each channel 1310 includes a first section 1312 and a second section 1314 that meet at a junction 1316. In combination, first and second sections 1312 and 1314 generally define an L-shape. First section 1312 is generally straight and vertically oriented when seat frame 1228 is generally horizontally oriented. Second section 1314 is somewhat arcuately shaped and predominately perpendicular to second first section 1312.

When backrest 1236 moves between the upright position 1276 and the intermediate position 1274, each bearing 1304 rides within first section 1312 of its corresponding channel 1310. When backrest 1236 moves between the intermediate position 1274 and the lowered position 1378, each bearing 1304 rides in the corresponding second section 1314. Bearings 1304 each generally have a dimension equal to the width of the first section of 1312 of channel 1310. The contact of bearings 1304 with the inside edges of first sections 1312 prevents backrest 1236 from pivoting about second pivot axis 1272 while bearings 1304 are positioned within first section 1312. However, while bearings 1304 are positioned within first section 1312, they are generally free to move upward and downward, thereby allowing backrest 1236 to pivot about first pivot axis 1270. When bearings 1304 reach second section 1314, further downward movement of bearings 1304 within the channels 1310 is prevented, and the shape of second section 1314 forces backrest 1236 to switch to pivoting from pivoting about first axis 1270 to pivoting about second pivot axis 1272 for any further downward movement of backrest 1236.

A pair of links 1318 is pivotally coupled between each backrest bracket 1302 and respective sides of seat frame 1228. That is, each link is pivotally coupled at a first end to one of the backrest brackets 1202 and pivotally coupled at a second end to a corresponding side of seat frame 1228. The pivotal coupling of link 1318 to backrest bracket 1302 occurs at a location that is aligned with second pivot axis 1272. The pivotal coupling of link 1318 to seat frame 1228 occurs at a location that is aligned with first pivot axis 1270.

The pivoting of backrest 1236 about first and second pivot axes 1270 and 1272 in the manner described herein is intended to provide the chair occupant with less discomfort (including shear forces) during the transition between the upright and lowered positions, or any positions therebetween. More particularly, the initial pivoting about first pivot axis 1270, which is located generally underneath the occupant's hips, recognizes that the occupant's body—when initially tilting backward from an upright position—tends to pivot about a location generally defined at the interface between the occupant's buttocks and the top face of the seat. In other words, the occupant generally does not pivot backward about his or her hip joint, but rather about an axis that is lower than the hip joint and very close, if not aligned with, first pivot axis 1270. First pivot axis 1270 is therefore positioned in this location in order to match the natural pivoting motion of the occupants body during initial backward movement of the occupant's back.

However, it has been found that after continued backward movement of the occupant's back, the occupant's back tends to switch to a pivoting motion that is more heavily influenced by the occupant's vertebrae straightening out with respect to each other. The location of second pivot axis 1272 at a location rearwardly of first pivot axis 1270 and a higher elevation than first pivot axis 1270 (at least until backrest 1236 reaches its lowered position 1378) tends to more closely align the pivoting motion of backrest 1236 with the pivoting movement of the occupant's back. This alignment helps reduce the shear forces exerted between the occupant's back and the backrest 1236 and/or the re-adjusting that the occupant might tend to desire upon continued backward pivoting of backrest 1236. When the occupant later moves from the lowered position 1378 to the upright position 1276, the pivoting motions of both the occupant's back and backrest 1236 occur in the same reverse order to what has been described, thereby reducing the shear forces and discomfort during the raising of backrest 1236 as well as during its lowering.

As shown in FIGS. 68-72, chair 1220 includes a base 1222 having a plurality of wheels 1202. A lifting mechanism 1224 is mounted on top of the base 1222 and is adapted to selectively raise and lower a chassis 1226 with respect to base 1222. This raising and lowering occurs by way of a separate lift actuator that is not shown in FIGS. 68-71. Seat frame 1228 is pivotally mounted to chassis 1226 to enable it to tilt with respect to chassis 1226. A seat actuator (also not visible in FIGS. 68-71) is adapted to drive the tilting of seat frame 1228 with respect to chassis 1226. Both the lift actuator and the seat actuator are under the control of controller 82, as well as the backrest actuator 1288. In one embodiment, controller 82 is adapted to control the seat actuator in such a manner that a rear end of the seat frame 1229 initially pivots downwardly and then subsequently upwardly during movement of backrest 1236 from the upright position 1276 to the lowered position 1378.

While several embodiments have been shown and described, the above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert but which can be used independently and/or combined with other features. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

What is claimed is:

1. A medical chair comprising:

a base configured to resting on a floor;

a seat;

a leg rest pivotally mounted relative to the seat and adapted to move between an extended position and a retracted position;

a first actuator for tilting the seat with respect to the base;

a second actuator for lifting the seat with respect to the base;

a leg rest actuator adapted to move the leg rest; and a controller adapted to control the first and second actuators to move the seat between a first position and a second position such that the seat is both lifted and tilted at the same time as the seat moves from the first position to the second position, and wherein the controller is adapted to control the leg rest actuator such that the leg rest maintains a substantially constant orientation with respect to the floor.

2. The medical chair of claim 1, wherein the first position is a sitting position, and the second position is a standing position.

3. The medical chair of claim 1, wherein the leg rest includes a plurality of overlapping sections.

4. The medical chair of claim 1, wherein the leg rest further includes a scissor mechanism coupled to the seat and to the overlapping sections to extend and contract the overlapping sections when the leg rest actuator pivots the leg rest about the seat.

5. The medical chair of claim 4, wherein the scissor mechanism includes at least guide post extending into a corresponding groove in one of the overlapping sections to guide the scissor mechanism when the scissor mechanism is extended or contracted.

6. The medical chair of claim 4, wherein the leg rest actuator extends or contracts in a non-orthogonal direction to the extension or contraction of the scissor mechanism.

7. The medical chair of claim 4, wherein the scissor mechanism is coupled to the seat via a sliding pin connection.

8. The medical chair of claim 1, further comprising a backrest pivotally coupled to the seat, wherein the backrest and the seat form a first angle therebetween when the seat is in the first position, and the backrest and the seat form a second angle therebetween when the seat is in the second position, the second angle being greater than the first angle.

9. The medical chair of claim 8, wherein the backrest is substantially vertically oriented when the seat is in the second position.

10. The medical chair of claim 8, wherein the controller is further adapted to move the backrest in such a manner that a person's upper body remains generally vertically aligned with the person's hips during movement of the seat from the first position to the second position.

11. A medical chair comprising:

a base;

a seat;

a leg rest pivotally mounted relative to the seat and adapted to move between an extended position and a retracted position;

a first actuator for tilting the seat with respect to the base;

a second actuator for lifting the seat with respect to the base;

a leg rest actuator adapted to move the leg rest; and a controller adapted to control the first and second actuators to move the seat between a first position and a second position such that the seat is both lifted and tilted at the same time as the seat moves from the first position to the second position, and wherein the controller is adapted to control the leg rest actuator such that an angle defined between the seat and the leg rest changes during movement of the seat from the first position to the second position.

12. The medical chair of claim 11, further comprising a backrest pivotally coupled to the seat, wherein the backrest and the seat form a first angle therebetween when the seat is in the first position, and the backrest and the seat form a second angle therebetween when the seat is in the second position, the second angle being greater than the first angle.

13. The medical chair of claim 12, wherein the backrest is substantially vertically oriented when the seat is in the second position.

14. The medical chair of claim 12, wherein the controller is further adapted to move the backrest in such a manner that a person's upper body remains generally vertically aligned with the person's hips during movement of the seat from the first position to the second position.

15. The medical chair of claim 11, wherein the leg rest includes a scissor mechanism.

16. The medical chair of claim 15, wherein the leg rest actuator extends or contracts in a non-orthogonal direction to the extension or contraction of the scissor mechanism.

17. The medical chair of claim 16, wherein the scissor mechanism is coupled to the seat, and the leg rest actuator pivots the leg rest about the seat to extend or contract the scissor mechanism.

18. A medical chair comprising:

a base;

a seat;

a backrest pivotally mounted relative to the seat, the backrest forming a backrest angle relative to the seat;

a leg rest pivotally mounted relative to the seat and adapted to move between an extended position and a retracted position;

a backrest actuator for tilting the backrest with respect to the seat;

a leg rest actuator adapted to move the leg rest; and a controller adapted to control the backrest actuator to adjust the backrest angle, and wherein the controller is adapted to control the leg rest actuator and delay actuation of said leg rest actuator when the backrest is being lowered until the backrest is lowered to a preselected angle.

19. The medical chair of claim 18, further comprising:

a first seat actuator for tilting the seat with respect to the base;

a second seat actuator for lifting the seat with respect to the base; and wherein the control system is adapted to control the first and second seat actuators to move the seat between a sitting position and a standing position.

20. The medical chair of claim 19, wherein the control system is further adapted to coordinate movement of the seat actuators and the backrest actuator during movement of the seat from the sitting position to the standing position.

21. The medical chair of claim 19, wherein the control system is further adapted to both lift and tilt the seat at the same time as the seat moves from the sitting position to the standing position.

* * * * *